US010026586B2

(12) United States Patent
Canfield et al.

(10) Patent No.: US 10,026,586 B2
(45) Date of Patent: Jul. 17, 2018

(54) X-RAY TUBE HAVING PLANAR EMITTER AND MAGNETIC FOCUSING AND STEERING COMPONENTS

(71) Applicant: VAREX IMAGING CORPORATION, Salt Lake City, UT (US)

(72) Inventors: Bradley D. Canfield, Orem, UT (US); Colton B. Woodman, West Valley City, UT (US)

(73) Assignee: VAREX IMAGING CORPORATION, Salt Lake City, UT (US)

( * ) Notice: Subject to any disclaimer, the term of this patent is extended or adjusted under 35 U.S.C. 154(b) by 502 days.

(21) Appl. No.: 14/660,584

(22) Filed: Mar. 17, 2015

(65) Prior Publication Data

US 2015/0187536 A1 Jul. 2, 2015

Related U.S. Application Data

(63) Continuation-in-part of application No. 14/642,283, filed on Mar. 9, 2015, which is a continuation-in-part (Continued)

(51) Int. Cl.
*H01J 35/14* (2006.01)
*H01J 35/30* (2006.01)

(Continued)

(52) U.S. Cl.
CPC ..... *H01J 35/14* (2013.01); *H01J 35/06* (2013.01); *H01J 35/30* (2013.01); *H01J 35/305* (2013.01); *H05G 1/10* (2013.01); *H05G 1/52* (2013.01)

(58) Field of Classification Search
CPC ..... H01J 35/14; H01J 35/30; H01J 35/305; H05G 1/10; H05G 1/52
See application file for complete search history.

(56) References Cited

U.S. PATENT DOCUMENTS 5,298,757 A * 3/1994 Okayama ..... H01J 37/12 250/396 ML
5,812,632 A * 9/1998 Schardt ..... H01J 35/14 378/137

(Continued)

FOREIGN PATENT DOCUMENTS

WO 2012/167822 A1 12/2012
WO 2015066246 A1 5/2015

OTHER PUBLICATIONS

International Search Report and Written Opinion; PCT/US2014/063015, dated Feb. 3, 2015.

(Continued)

*Primary Examiner* — Glen Kao
(74) *Attorney, Agent, or Firm* — Maschoff Brennan

(57) ABSTRACT

An X-ray tube can include: a cathode planar emitter that emits an inhomogeneous electron beam; an anode to receive the electron beam; a first magnetic quadrupole having a first yoke with four evenly distributed first pole projections extending from the first yoke and oriented toward a central axis of the first yoke and each of the four first pole projections having a first quadrupole electromagnetic coil; a second magnetic quadrupole having a second yoke with four evenly distributed second pole projections extending from the second yoke and oriented toward a central axis of the second yoke and each of the four second pole projections having a second quadrupole electromagnetic coil; and at least one coil of a first pair of opposing coils with alternating current offset from the power supply.

20 Claims, 43 Drawing Sheets

Related U.S. Application Data of application No. PCT/US2014/063015, filed on Oct. 29, 2014.

(60) Provisional application No. 61/897,181, filed on Oct. 29, 2013.

(51) Int. Cl.

| | |
|---|---|
| ***H05G 1/10*** | (2006.01) |
| ***H05G 1/52*** | (2006.01) |
| ***H01J 35/06*** | (2006.01) |

(56) References Cited

U.S. PATENT DOCUMENTS

| | | | | |
|---|---|---|---|---|
| 5,907,595 | A * | 5/1999 | Sommerer | H01J 35/06 378/119 |
| 6,464,551 | B1 | 10/2002 | Lipkin et al. | |
| 7,839,979 | B2 | 11/2010 | Hauttmann et al. | |
| 2003/0025429 | A1 | 2/2003 | Hell et al. | |
| 2010/0020937 | A1 * | 1/2010 | Hautmann | H01J 35/14 378/137 |
| 2010/0195797 | A1 | 8/2010 | Hauttmann | |
| 2010/0207508 | A1 | 8/2010 | Terletska et al. | |
| 2010/0316192 | A1 | 12/2010 | Hauttmann et al. | |
| 2012/0177185 | A1 * | 7/2012 | Koppisetty | H01J 35/14 378/137 |
| 2015/0110251 | A1 * | 4/2015 | Wiedmann | H01J 35/14 378/138 |
| 2015/0187530 | A1 | 7/2015 | Canfield et al. | |
| 2015/0187536 | A1 | 7/2015 | Canfield et al. | |
| 2015/0187537 | A1 | 7/2015 | Canfield | |
| 2015/0187538 | A1 | 7/2015 | Canfield et al. | |

OTHER PUBLICATIONS

International Search Report and Written Opinion dated Jun. 30, 2016 in Application No. PCT/US2016/022485.

* cited by examiner

X-RAY TUBE HAVING PLANAR EMITTER AND MAGNETIC FOCUSING AND STEERING COMPONENTS

CROSS-REFERENCE

This patent application is a continuation-in-part application of PCT Patent Application Serial No. PCT/US2014/063015 filed Oct. 29, 2014, which claims priority to U.S. Provisional Application Ser. No. 61/897,181 filed Oct. 29, 2013, and a continuation-in-part of U.S. patent application Ser. No. 14/642,283 filed Mar. 9, 2015, which patent applications are incorporated herein by specific reference in their entireties.

BACKGROUND

X-ray tubes are used in a variety of industrial and medical applications. For example, X-ray tubes are employed in medical diagnostic examination, therapeutic radiology, semiconductor fabrication, and material analysis. Regardless of the application, most X-ray tubes operate in a similar fashion. X-rays, which are high frequency electromagnetic radiation, are produced in X-ray tubes by applying an electrical current to a cathode to cause electrons to be emitted from the cathode by thermionic emission. The electrons accelerate towards and then impinge upon an anode. The distance between the cathode and the anode is generally known as A-C spacing or throw distance. When the electrons impinge upon the anode, the electrons can collide with the anode to produce X-rays. The area on the anode in which the electrons collide is generally known as a focal spot.

X-rays can be produced through at least two mechanisms that can occur during the collision of the electrons with the anode. A first X-ray producing mechanism is referred to as X-ray fluorescence or characteristic X-ray generation. X-ray fluorescence occurs when an electron colliding with the material of the anode has sufficient energy to knock an orbital electron of the anode out of an inner electron shell. Other electrons of the anode in outer electron shells fill the vacancy left in the inner electron shell. As a result of the electron of the anode moving from the outer electron shell to the inner electron shell, X-rays of a particular frequency are produced. A second X-ray producing mechanism is referred to as Bremsstrahlung. In Bremsstrahlung, electrons emitted from the cathode decelerate when deflected by nuclei of the anode. The decelerating electrons lose kinetic energy and thereby produce X-rays. The X-rays produced in Bremsstrahlung have a spectrum of frequencies. The X-rays produced through either Bremsstrahlung or X-ray fluorescence may then exit the X-ray tube to be utilized in one or more of the above-mentioned applications.

In certain applications, it may be beneficial to lengthen the throw length of an X-ray tube. The throw length is the distance from the cathode electron emitter to the anode surface. For example, a long throw length may result in decreased back ion bombardment and evaporation of anode materials back onto the cathode. While X-ray tubes with long throw lengths may be beneficial in certain applications, a long throw length can also present difficulties. For example, as a throw length is lengthened, the electrons that accelerate towards an anode through the throw length tend to become less laminar resulting in an unacceptable focal spot on the anode. Also affected is the ability to properly focus and/or position the electron beam towards the anode target, again resulting in a less than desirable focal spot— either in terms of size, shape and/or position. When a focal spot is unacceptable, it may be difficult to produce useful X-ray images.

The subject matter claimed herein is not limited to embodiments that solve any disadvantages or that operate only in environments such as those described above. Rather, this background is only provided to illustrate one exemplary technology area where some embodiments described herein may be practiced.

SUMMARY

Disclosed embodiments address these and other problems by improving X-ray image quality via improved electron emission characteristics, and/or by providing improved control of a focal spot size and position on an anode target. This helps to increase spatial resolution or to reduce artifacts in resulting images.

In one embodiment, an electron emitter can include: a plurality of elongate rungs connected together end to end from a first emitter end to a second emitter end in a plane so as to form a planar pattern, each elongate rung having a rung width dimension; a plurality of corners, wherein each elongate rung is connected to another elongate rung through a corner of the plurality of corners, each corner having a corner apex and an opposite corner nadir between the connected elongate rungs of the plurality of elongate rungs; a first gap between adjacent non-connected elongate rungs of the plurality of elongate rungs, wherein the first gap extends from the first emitter end to a middle rung; a second gap between adjacent non-connected elongate rungs of the plurality of elongate rungs, wherein the second gap extends from the second emitter end to the middle rung, wherein the first gap does not intersect the second gap; and one or more cutouts at one or more of the corners of the plurality of corners between the corner apex and corner nadir or at the corner nadir.

In one embodiment, a method of designing an electron emitter can include: determining a desired cross-sectional profile of an electron emission from an electron emitter, where the parameters of the electron emitter can be input into a computer; determining a desired temperature profile for the electron emitter that emits the desired cross-sectional profile; and determining desired emitter dimensions for a defined electrical current through the electron emitter that produces the desired temperature profile, which can be determined through simulations run on the computer under instructions input by the user. The emitter dimensions can include: each rung width dimension; each first gap segment dimension; each second gap segment dimension; and each web dimension. The electron emitter can include: a plurality of elongate rungs connected together end to end at corners, each corner having a corner apex and an opposite corner nadir, each elongate rung having a rung width dimension; a first gap between adjacent non-connected elongate rungs from the first emitter end to a middle rung, the first gap including a plurality of first gap segments each having a first gap segment width; a second gap between adjacent non-connected elongate rungs from the second emitter end to the middle rung, the second gap including a plurality of second gap segments each having a second gap segment width; and one or more body portions of each corner between the corner apex and corner nadir together define a web dimension for each corner.

In one embodiment, a method of manufacturing an electron emitter can include: obtaining a sheet of electron emitter material; obtaining an electron emitter pattern; and laser cutting the electron emitter pattern into the electron emitter material. The electron emitter pattern can include: a plurality of elongate rungs connected together end to end from a first emitter end to a second emitter end in a plane so as to form a planar pattern, each elongate rung having a rung width dimension; a plurality of corners, wherein each elongate rung is connected to another elongate rung through a corner of the plurality of corners, each corner having a corner apex and an opposite corner nadir between the connected elongate rungs of the plurality of elongate rungs; a first gap between adjacent non-connected elongate rungs of the plurality of elongate rungs, wherein the first gap extends from the first emitter end to a middle rung; a second gap between adjacent non-connected elongate rungs of the plurality of elongate rungs, wherein the second gap extends from the second emitter end to the middle rung, wherein the first gap does not intersect the second gap; and one or more cutouts at one or more of the corners of the plurality of corners between the corner apex and corner nadir or at the corner nadir. In one aspect, the method can further include determining that the electron emitter pattern produces a desired temperature profile for a defined electrical current.

In one embodiment, an X-ray tube can include: a cathode including an electron emitter that emits an electron beam; an anode configured to receive the emitted electrons of the electron beam; a first magnetic quadrupole core between the cathode and the anode and having a first quadrupole yoke with four evenly distributed first quadrupole pole projections extending from the first quadrupole yoke and oriented toward a central axis of the first quadrupole yoke and each of the four first quadrupole pole projections having a first quadrupole electromagnetic coil operably coupled to a power supply system that provides a constant current to each first quadrupole electromagnetic coil to produce a first focusing magnetic quadrupole field; a second magnetic quadrupole core between the first magnetic quadrupole and the anode and having a second quadrupole yoke with four evenly distributed second quadrupole pole projections extending from the second quadrupole yoke and oriented toward a central axis of the second quadrupole yoke and each of the four second quadrupole pole projections having a second quadrupole electromagnetic coil operably coupled to the power supply system that provides a constant current to each second quadrupole electromagnetic coil to produce a second focusing quadrupole field; and at least one coil of a pair of opposing quadrupole electromagnetic coils of the first or second quadrupole electromagnetic coils operably coupled to the power supply system that provides an alternating current offset to at least one coil of the pair of opposing quadrupole electromagnetic coils to shift the first and/or second focusing quadrupole field from the central axis of the first and/or second quadrupole yokes. In one aspect, the X-ray tube can include two coils of a pair or two pairs of opposing quadrupole electromagnetic coils of the first and/or second quadrupole electromagnetic coils, which pair of coils include at least one coil and optionally two coils operably coupled to the power supply system that provides an alternating current offset (e.g., AC offset) to one or both coils of one or two pairs of opposing quadrupole electromagnetic coils to shift the first and/or second focusing quadrupole field from the central axis of the first and/or second quadrupole yokes.

In one embodiment, a method of focusing and steering an electron beam in an X-ray tube can include: providing an X-ray tube of one of the embodiments (e.g., having at least one coil of a pair of opposing quadrupole electromagnetic coils with constant current for focusing and AC offset for steering); operating the electron emitter so as to emit the electron beam from the cathode to the anode along an electron beam axis; operating the first magnetic quadrupole to focus the electron beam in a first direction; operating the second magnetic quadrupole to focus the electron beam in a second direction orthogonal with the first direction; and operating a power supply to provide an AC offset to at least one coil of a pair of opposing quadrupole electromagnetic coils so as to steer the electron beam away from the electron beam axis. In one aspect, the method can include operating two orthogonal pair of opposing quadrupole electromagnetic coils by providing AC offset to at least one coil of each pair so as to steer the electron beam away from the electron beam axis. In one aspect, the opposing quadrupole magnetic coils of a coil pair can be operated independently (e.g., one coil with offset the other coil without offset or at a different offset) so as to perturb the quadrupole field and move the center of the quadrupole field away from the central axis, thereby moving the electron beam away from the central axis.

In one embodiment, a method of focusing and steering an electron beam in an X-ray tube can include: providing the X-ray tube of one of the embodiments; operating the electron emitter so as to emit the electron beam from the cathode to the anode along an electron beam axis; operating the first magnetic quadrupole to focus the electron beam in a first direction; operating the second magnetic quadrupole to focus the electron beam in a second direction orthogonal with the first direction; offsetting the first magnetic quadrupole to steer the electron beam away from the electron beam axis in a first direction; and offsetting the second magnetic quadrupole to steer the electron beam away from the electron beam axis in a second direction that is orthogonal to the first direction.

In one embodiment, an X-ray tube can include: a cathode including an electron emitter that emits an electron beam; an anode configured to receive the emitted electrons of the electron beam; a first magnetic quadrupole between the cathode and the anode and having a first quadrupole yoke with four evenly distributed first quadrupole pole projections extending from the first quadrupole yoke and oriented toward a central axis of the first quadrupole yoke and each of the four first quadrupole pole projections having a first quadrupole electromagnetic coil; a second magnetic quadrupole between the first magnetic quadrupole and the anode and having a second quadrupole yoke with four evenly distributed second quadrupole pole projections extending from the second quadrupole yoke and oriented toward a central axis of the second quadrupole yoke and each of the four second quadrupole pole projections having a second quadrupole electromagnetic coil; and two opposing pole projections of the first or second quadrupole pole projections having electromagnetic steering coils formed thereof. That is, the steering coils are collocated on the same pole projections that include quadrupole coils. The steering coils produce an offset quadrupole field by one steering coil or a pair of steering coils having an AC offset that perturbs the quadrupole field that is generated by the quadrupole electromagnetic coils, which shifts the center of the quadrupole field from a central axis (e.g., electron beam axis, center of cores, center of X-ray tube, etc.). The shifted quadrupole field steers the electron beam passing therethrough. The electromagnetic steering coils can be formed adjacent to quadrupole electromagnetic coils of the first or second quadrupole electromagnetic coils. In one aspect, the X-ray tube can include one steering coil, one pair of steering coils, three steering coils, or two pairs of steering coils. Each of the pairs of steering coils having steering coils on opposing pole projections of the first and/or second quadrupole pole projections. Accordingly, a first single steering coil or first pair of steering coils can shift the quadrupole field in a first direction, and a second single coil or second pair of steering coils can shift the quadrupole in a second direction that is orthogonal with the first direction.

In one embodiment, a method of focusing and steering an electron beam in an X-ray tube can include: providing an X-ray tube of one of the embodiments (e.g., having at least one steering coil or one pair of steering coils on opposing quadrupole pole projections); operating the electron emitter so as to emit the electron beam from the cathode to the anode along an electron beam axis; operating the first magnetic quadrupole to focus the electron beam in a first direction; operating the second magnetic quadrupole to focus the electron beam in a second direction orthogonal with the first direction; and operating at least one steering coil or the pair of steering coils to steer the electron beam away from the center of the quadrupole cores or away from the natural electron beam axis (e.g., without steering) that is aligned with the center axis of the X-ray tube. In one aspect, the method can include operating at least one coil of opposing steering coils to have different currents to form an asymmetric quadrupole moment. That is, each steering coil of a pair can be operated at different currents to form and move an asymmetric quadrupole field in one direction. Also, each steering coil of each pair (e.g., all four steering coils) can be operated at different currents to form and move an asymmetric quadrupole field in two orthogonal directions. Operating one or two pairs of steering coils can shift the quadrupole field off axis to steer the electron beam. However, only one steering coil of each pair needs to be provided with AC offset for steering the electron beam. Activating one coil with AC offset can be considered to be operating the pair of opposing coils that has that one coil with AC offset because the other coil of the pair can have zero AC offset.

In one embodiment, a method of focusing and steering an electron beam in an X-ray tube can include: providing the X-ray tube of one of the embodiments (e.g., having at least two pairs of steering coils on two pairs of quadrupole pole projections); operating the electron emitter so as to emit the electron beam from the cathode to the anode along an electron beam axis; operating the first magnetic quadrupole to focus the electron beam in a first direction; operating the second magnetic quadrupole to focus the electron beam in a second direction orthogonal with the first direction; operating at least one coil of a first pair of steering coils on an opposing pair of quadrupole pole projections to steer the electron beam away from the electron beam axis in a first direction; and operating at least one coil of a second pair of steering coils on a pair of opposing quadrupole pole projections to steer the electron beam away from the electron beam axis in a second direction that is orthogonal to the first direction. In one aspect, the method can include operating opposing steering coils to have different powers to form a first asymmetric quadrupole moment. In one aspect, the method can include operating two pair of opposing steering coils so that each steering coil (e.g., all four steering coils) has a different current from the other coils so as to form a first asymmetric quadrupole moment. In one aspect, the method can include operating opposing steering coils of a second pair of steering coils to have different currents to form a second asymmetric quadrupole moment.

In one embodiment, one quadrupole (e.g., of a quadrupole core) is used to focus in the first direction and the second quadrupole (e.g., of a quadrupole core) to focus in the second direction and a dipole (e.g., of a dipole core) is used to steer in one or both directions. Additionally, the dipole core can be configured for two axis beam steering. In one aspect, the dipole core can be configured for high dynamic response. This provides three separate cores, one for focusing in the width (e.g., $1^{st}$ quadrupole core), one for focusing in the length (e.g., $2^{nd}$ quadrupole core), and one for beam steering (e.g., dipole core). The dipole core can be operated similarly to the embodiment having the steering coils, where the dipole coils can be steering coils, or similarly to embodiments where the quadrupole coils have AC offset, where the dipole coils are operated with AC offset.

In yet another embodiment, an electron source is provided in the form of an electron emitter, such as a flat emitter, for the production of electrons. The emitter has a relatively large emitting area with design features that can be tuned to produce the desired distribution of electrons to form a primarily laminar beam. The emission over the emitter surface is not uniform or homogenous; it is focused and steered with the quadrupole and dipole cores to meet the needs of a given application. As the beam flows from the cathode to the anode, the electron density of the beam spreads the beam apart significantly during transit. The increased beam current levels created by higher power requirements exacerbate the spreading of the beam during transit. In disclosed embodiments, to achieve the focal spot sizes required, the beam is focused by two quadrupoles and then steered by the two dipoles as it transits from the cathode to the anode. This also provides for creating a multiplicity of sizes from a single emitter; the size conceivably could be changed during an exam as well. This allows for the focal spot to be changed on the fly. The increased emitter area of the flat and planar geometry of the emitter allows production of sufficient electrons flowing laminarly to meet the power requirements. To address the requirement of steering the beam in two dimensions so as to provide the desired imaging enhancements, a pair of magnetic dipoles is used to deflect the beam to the desired positions at the desired time. One dipole pair set is provided for each direction.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE FIGURES

The foregoing and following information as well as other features of this disclosure will become more fully apparent from the following description and appended claims, taken in conjunction with the accompanying drawings.

Understanding that these drawings depict only several embodiments in accordance with the disclosure and are, therefore, not to be considered limiting of its scope, the disclosure will be described with additional specificity and detail through use of the accompanying drawings.

FIG. 11B shows a focused quadrupole field that is shifted in the x-direction, and FIG. 11C shows a focused quadrupole shifted in the y-direction.

DETAILED DESCRIPTION

Figure 1A:
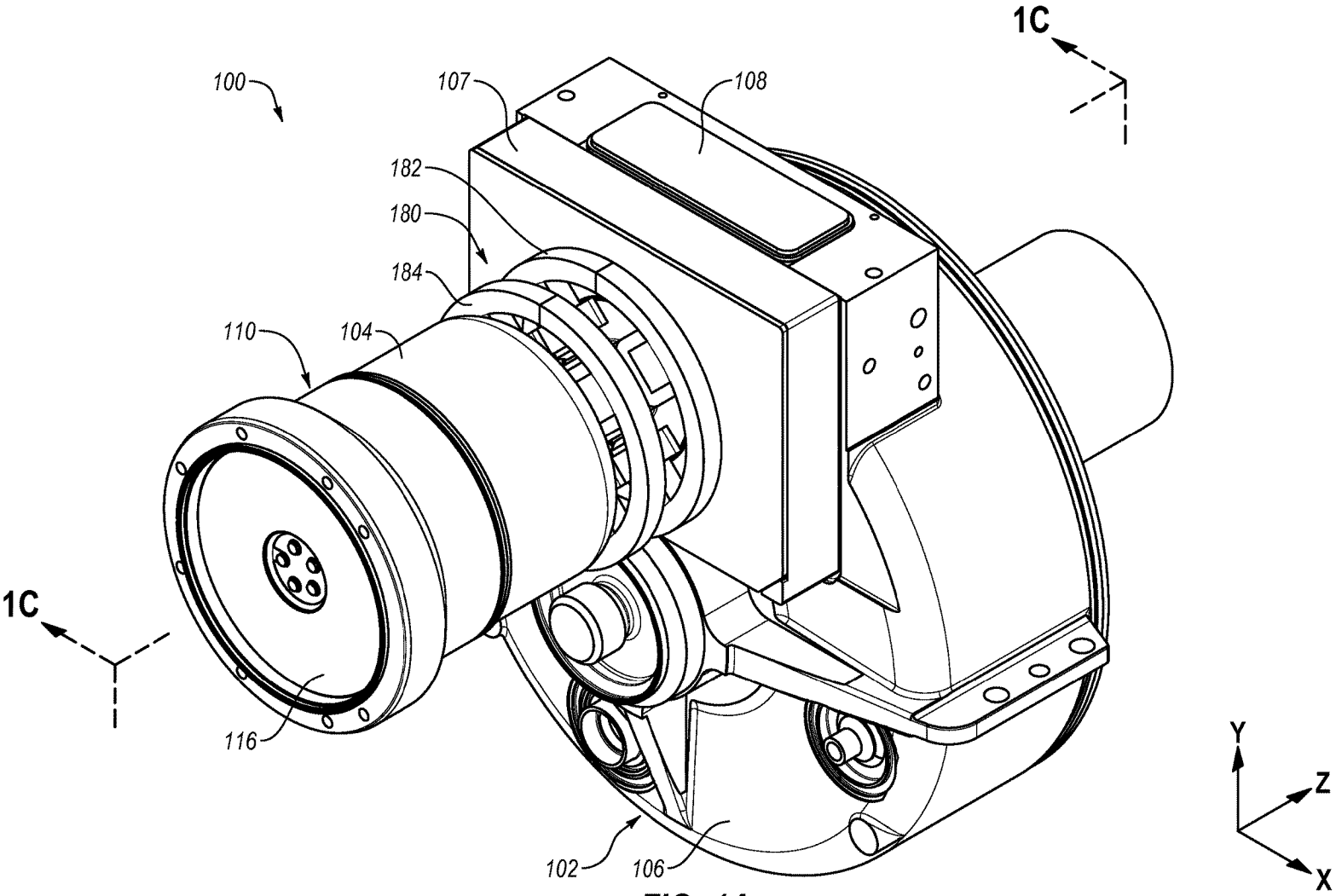
FIG. 1A is a perspective view of an example X-ray tube in which one or more embodiments described herein may be implemented.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented herein. It will be readily understood that the aspects of the present disclosure, as generally described herein, and illustrated in the figures, can be arranged, substituted, combined, separated, and designed in a wide variety of different configurations, all of which are explicitly contemplated herein.

I. General Overview of an Exemplary X-Ray Tube

Embodiments of the present technology are directed to X-ray tubes of the type having a vacuum housing in which a cathode and an anode are arranged. The cathode includes an electron emitter that emits electrons in the form of an electron beam that is substantially perpendicular to a face of the emitter, and the electrons are accelerated due to a voltage difference between the cathode and the anode so as to strike a target surface on the anode in an electron region referred to as a focal spot. Embodiments can also include electron beam focusing and/or steering components that are cooperatively configured to manipulate the electron beam by: (1) deflecting, or steering, the electron beam, and thereby altering the position of the focal spot on the anode target; and/or (2) focusing the electron beam so as to alter the dimensions of the focal spot. Different embodiments utilize different configurations of such focusing and/or steering components, such as magnet systems, including combinations of electromagnets formed as quadrupoles and/or as dipoles via coil elements with current flowing therein and disposed on a carrier/yoke comprised of a suitable material.

Disclosed embodiments illustrate an electron emitter having a planar electron emitter structure. Moreover, the planer emitter is designed and configured to provide tunable emission characteristics for the emitted electron beam, which results in the ability to tailor—and thus optimize—the focal spot size, shape and position for a given imaging application. The tailoring of the planar electron emitter pattern can result in an enhanced emitter configuration that avoids image quality issues due to a less-than-optimal focal spot. For example, an increase in spatial resolution and reduction in image artifacts is possible with the designed planer electron emitter patterns. However, the planar emitter described herein can be used in various X-ray tube embodiments, such as those with or without beam focusing and/or steering.

In general, example embodiments described herein relate to a cathode assembly with a planar electron emitter that can be used in substantially any X-ray tube, such as for example, in long throw length X-ray tubes. In at least some of the example embodiments disclosed herein, the difficulties associated with a long throw length of an X-ray tube can be overcome by employing a planar electron emitter having a planar emitting surface. In a disclosed embodiment, the planar emitting surface can be formed by a continuous and cutout shaped planar member with a substantially flat emitting surface that extends between two electrodes. The continuous flat emitting surface can have a plurality of sections connected together at bends or elbows that are defined by the cutout. When a suitable electrical current is passed through the emitter, the planar emitting surface emits electrons that form an electron beam that is substantially laminar as it propagates through an acceleration region and a drift region (e.g., with or without magnetic steering or focusing) to impinge upon a target surface of an anode at a focal spot.

In yet another embodiment, an electron source is provided in the form of a flat emitter for the production of electrons. The emitter has a relatively large emitting area with design features that can be tuned to produce the desired distribution of electrons to form a primarily laminar beam. The emission over the emitter surface is not uniform or homogenous; it is tuned to meet the needs of a given application. As the beam flows from the cathode to the anode, the electron density of the beam spreads the beam apart significantly during transit. The increased beam current levels created by higher power requirements exacerbate the spreading of the beam during transit. In disclosed embodiments, to achieve the focal spot sizes required, the beam is focused by two quadrupoles as it transits from the cathode to the anode. This also provides for creating a multiplicity of sizes from a single emitter; the size conceivably could be changed during an exam as well. The increased emitter area of the flat geometry of the emitter allows production of sufficient electrons flowing laminarly to meet the power requirements. To address the requirement of steering the beam in two dimensions so as to provide the desired imaging enhancements, a pair of dipoles is used to deflect the beam to the desired positions at the desired time. One dipole set is provided for each direction.

Certain embodiments include a magnetic system implemented as two magnetic quadrupoles disposed in the electron beam path of an X-ray tube. The quadrupoles are configured to focus in both directions perpendicular to the beam path, and to steer the beam in both directions perpendicular to the beam path. The two quadrupoles form a magnetic lens (sometimes referred to as a "doublet") and the focusing is accomplished as the beam passes through the quadrupole lens. The steering is accomplished by offsetting the coil alternating current in one quadrupole coil or corresponding pairs of the quadrupole coils while maintaining the focusing coil constant current which results in an overall shift in the quadrupole's magnetic field. Steering of the beam occurs through appropriate coil or coil pair energizing and can be done in one axis or a combination of axes perpendicular to the beam path. In one example, one quadrupole is used to focus in the first direction and the second quadrupole to focus in the second direction as well as steer in both directions. The two quadrupoles together form the quadrupole lens.

The embodiments can include an electron beam focusing component that includes two magnetic quadrupole cores. A quadrupole core is considered to be any core that has a quadrupole for beam focusing. Generally, each magnetic quadrupole core can have a yoke with four pole projections evenly distributed therearound, and each pole projection can include a quadrupole electromagnetic coil so that all four electromagnets provide the magnetic quadrupole moment. One quadrupole core can narrow the electron beam in the length direction, and the other quadrupole core can narrow the electron beam in the width direction. Thereby, the combination of the two quadrupole cores can cooperate to focus the electron beam, which allows precise length and width dimension control of the focal spot on the anode. However, either or both quadrupole cores can focus in the length and width directions. The quadrupoles can include coils that have constant current to achieve the focusing effect. Also, a pulse width modulated circuit coupled with the coils can create constant current in the coils because the coils are current integrating devices. For example, a current pulse train into the coil can cause the coil to create a constant current in the coil, which can be changed by changing the current pulse train. Also a DC power supply can provide constant current (e.g., DC current).

In one embodiment, the cathode emits an electron beam that flows from the cathode toward the anode such that the beam spreads the electrons apart during transit, and one or more of the quadrupole cores focus the electron beam to a defined focal spot. In one aspect, both quadrupole cores provide a focusing effect on the electron beam. This allows for both beam width (e.g., X axis) and beam length (e.g., Y axis) focusing, wherein one quadrupole core focuses in the length and the other quadrupole core focuses in the width. This also allows for the ability of the X-ray tube to create a plurality of different types of focal spot sizes and shapes from a single planar emitter, where such changes of focusing and change of beam length and/or width can be performed during imaging, such as during a CT examination.

In one embodiment, the X-ray tube can perform beam focusing with high magnetic flux in a small throw volume or space. The magnetic material suitable for high magnetic flux can be a material that does not saturate and can be used for the quadrupole cores in the yokes, such as the yokes for two adjacent quadrupole cores. Also, the quadrupole pole projections can be the same material as the yokes. Such a material can be iron.

However, movement of the X-ray in the Z axis may be desirable, and due to the angle of the anode target surface, steering of the electron beam in the Y axis can cause the X-ray to move in the Z axis.

The embodiments can include an electron beam steering component that includes one of the magnetic quadrupole cores being configured to operate each quadrupole electromagnet separately to change the magnetic field in order to move the electron beam in two dimensions away from the central axis, such as movement of the focal spot on the anode target surface. The quadrupole core closest to the anode (e.g., anode quadrupole core) can have a yoke with four pole projections evenly distributed therearound that each have a quadrupole magnetic coil with independent current control. Accordingly, the anode quadrupole core can have electromagnet coils wound around the pole projections on the yoke that can steer the electron beam in any direction or toward any quadrant. The anode quadrupole core can impart a magnetic field that nudges and deflects the electron beam, and then the electron beam coasts to the target anode. However, the quadrupole core closest to the cathode (e.g., cathode quadrupole core) can be configured for focusing and steering while the anode quadrupole core only focuses. In an alternative configuration, the cathode quadrupole core can focus and steer in a first direction, and the anode quadrupole core can focus and steer in a second direction that is perpendicular to the first direction.

Steering can be accomplished by moving the center of the quadrupole field away from a central axis, where the central axis can be the natural (e.g., unperturbed) electron beam axis or aligned central axis of the quadrupole cores. Introducing an AC offset to one coil, a pair of coils, three coils, or two pair of coils of the coils of the quadrupole cores can provide the shift of the quadrupole field. This may be an asymmetric quadrupole field that has focusing that is focused off the central axis. The quadrupole field can be shifted off axis from the central axis or off the central axes of the cores. The quadrupole still provides focusing by the center being shifted off axis, and the electron beam follows the center of the shifted quadrupole field. While the constant focusing current provides focusing, the AC offset to one coil or a pair of coils or three coils or two pairs of coils can shift the center of the quadrupole field away from center of the quadrupole cores. The shifted quadrupole field is similar to a dipole effect being superimposed over a quadrupole field. The AC offset to each coil for a core can be independent and different to get steering. The AC offset to one or more coils can apply to the steering coils and dipole coils of the different embodiments. The AC offset can be time vary steering current.

The embodiments can include an electron beam steering component that includes one of the magnetic quadrupole cores having at least one steering coil, or a pair or two orthogonal pairs of steering coils collocated on the pole projections with quadrupole coils. Each pair of steering coils can be included on a pair of oppositely disposed pole projections and collocated with electromagnetic quadrupole coils. The steering system can be configured to operate each steering coil separately to shift the quadrupole magnetic field in order to move the electron beam on the focal spot on the anode target surface. In one aspect, the quadrupole core closest to the anode (e.g., anode quadrupole core) can have a yoke with four pole projections evenly distributed thereabout that each have a quadrupole electromagnetic coil and a steering coil with independent current control. Accordingly, the anode quadrupole core can have quadrupole and steering coils wound around the pole projections on the yoke. The anode quadrupole core can steer the electron beam in any direction or toward any quadrant relative to the electron beam axis by independently operating the different steering coils. The steering coils can modulate the quadrupole magnetic field that nudges and deflects the electron beam, and then the electron beam coasts to the target anode. However, the quadrupole core closest to the cathode (e.g., cathode quadrupole core) can be configured for focusing with quadrupole coils and steering with steering coils, while the anode quadrupole core only focuses with quadrupole coils. In an alternative configuration, the cathode quadrupole core can focus and steer in a first direction, and the anode quadrupole core can focus and steer in a second direction that is perpendicular to the first direction, whereby the combination of both cores can be configured in such a manner to steer the electron beam in any direction desired.

Steering can be accomplished by moving the center of the quadrupole field away from a central axis, where the central axis can be the natural (e.g., unperturbed) electron beam axis or aligned central axis of the quadrupole cores or central axis of the X-ray tube. Introducing an AC offset to at least one of the steering coils of the quadrupole cores can provide the shift of the quadrupole field. This may be an asymmetric quadrupole field that has focusing that is focused off the central axis. The quadrupole field can be shifted off axis from the central axis or off the central axes of the cores. The quadrupole still provides focusing with the center being shifted off axis, and the electron beam follows the center of the shifted quadrupole field. While the constant focusing current in the quadrupole coils provides focusing, the AC offset in at least one steering coil can shift the center of the quadrupole field away from center of the quadrupole cores. The shifted quadrupole field is similar to a dipole effect being superimposed over a quadrupole field. The AC offset to each coil of a core can be independent and different to perform the steering of the electron beam. The AC offset can be time vary steering current.

Embodiments can include an electron beam steering component that includes one magnetic dipole core that has two different dipole pairs. The dipole core can have a yoke with four electromagnets evenly distributed therearound so as to form two dipole pairs that are orthogonal. The electromagnets can be wound around the yoke, or alternatively the electromagnetics can be wound around pole protrusions on the yoke. The dipole core can steer the electron beam in any direction or toward any quadrant. The dipole core can impart a magnetic field that nudges and deflects the electron beam, and then the electron beam coasts to the target anode. This gives precise location control for the spot. The dipole coils on the dipole core can be operated similarly to the steering coils described herein.

Certain embodiments include a magnetic system implemented as two magnetic quadrupole cores and one magnetic dipole core disposed in the electron beam path of an X-ray tube. The quadrupole cores are configured to focus in both directions perpendicular to the beam path. The primary steering function is accomplished by offsetting the coil current in corresponding magnetic pairs of the dipole (e.g., two orthogonal dipole pairs) which results in an overall shift in the magnetic field to nudge the electrons in a certain direction. Steering of the beam occurs through appropriate coil pair energizing of both dipole coil pairs, and can be done in one axis or a combination of axes.

Certain embodiments include a magnetic system implemented as two magnetic quadrupoles and two magnetic dipoles disposed in the electron beam path of an X-ray tube. The two magnetic quadrupoles are configured to focus the electron beam path in both directions perpendicular to the beam path. The two magnetic dipoles are collocated on a common dipole core and configured to steer the beam in both directions perpendicular to the beam path, which can provide four quadrant steering. The steering is accomplished by the two dipoles which are created by coils wound on the dipole core pole protrusions. The focusing is accomplished by the quadrupole coils being wound on the quadrupole pole protrusions of the two quadrupole cores so as to maintain the focusing coil current. Steering of the beam occurs through appropriate dipole coil pair energizing and can be done in one axis or a combination of axes perpendicular to the electron beam path. In one embodiment, one quadrupole is used to focus in the first direction and the second quadrupole to focus in the second direction, and the dipole is used to steer the electron beam in both directions. However, only one coil of a dipole coil pair may receive the AC Offset and the other receives zero AC offset. The dipole coils may be considered to be steering coils and operate as described for the steering coils.

In one embodiment, the dipole core can include a magnetic material that has high dynamic response, which material can be used for the yoke. The material can have less magnetic flux than the material of the quadrupole cores. The material of the dipole core can be configured so that it does not saturate at low levels, and it responds several orders of magnitude faster than the iron material used for the quadrupole cores. The dipole core material can be iron based ferrite with lower saturation flux levels, which allows for high magnetic switching speeds. The material allows up to 7 kHz switching and as low as about 20 microseconds transitions. In one aspect the dipole core material can be a ferrite material. The ferrite can be an iron ceramic, such as iron oxide, which can have different magnetic characteristics compared to the quadrupole core material. The material of the quadrupole cores can be iron. However, one quadrupole core can include the ferrite material.

In one embodiment, the X-ray tube having the two quadrupole cores and one dipole core can be configured for high flux in the two quadrupole cores and fast response in the one dipole core. Thus, the dipole core material can be different from the quadrupole core material. The same material can be used for the yoke and the pole protrusions.

The dipole core can include pole protrusions that have dipole coils wrapped therearound for the electromagnets. On the other hand, the dipole core can include the dipole coils wrapped around the annular body of the dipole core at different and opposing locations, where dipole coils wrapped around the annular body can be between pole protrusions, if pole protrusions are included. In one aspect, the dipole core can be devoid of dipole coils on pole protrusions, and the dipole coils can be wrapped at four locations around the yoke. The dipole core can have the dipole coils and/or dipole pole projections staggered from the quadrupole coils of the quadrupole cores, such as at 45 degrees therefrom.

In one embodiment, the X-ray tube having the two quadrupole cores and one dipole core can be separated from each other such that focusing quadrupole cores are separate from the steering dipole core. The beam steering can be operated at higher rates, such as in the kHz range. The X-ray tube can provide the user with enhanced imaging and more capability to enrich the CT data sets with reduced radiation dose. This can allow the X-ray tube to be used in advanced imaging methods. This can also allow the X-ray tube to perform higher flux focusing with the focusing cores to create small focal spots without saturation in the core material.

In one embodiment, the X-ray tube can include the two quadrupoles having the pole protrusions and the electromagnets aligned, which can be referenced at 0, 90, 180, and 270 degrees. The dipole core can have the electromagnets staggered from those of the quadrupole cores, which staggering can result in the electromagnets being at about 45, 135, 225, and 315 degrees.

In one embodiment, the X-ray tube can include 0 degrees on an axis, and the two quadrupoles having the pole protrusions and the electromagnets aligned, which can be referenced at 45, 135, 225 and 315 degrees. The dipole core can have the electromagnets staggered from those of the quadrupole cores, which staggering can result in the electromagnets being at about 0, 90, 180, and 270 degrees. This can be seen in FIGS. 18C and 20A.

Figure 20A:
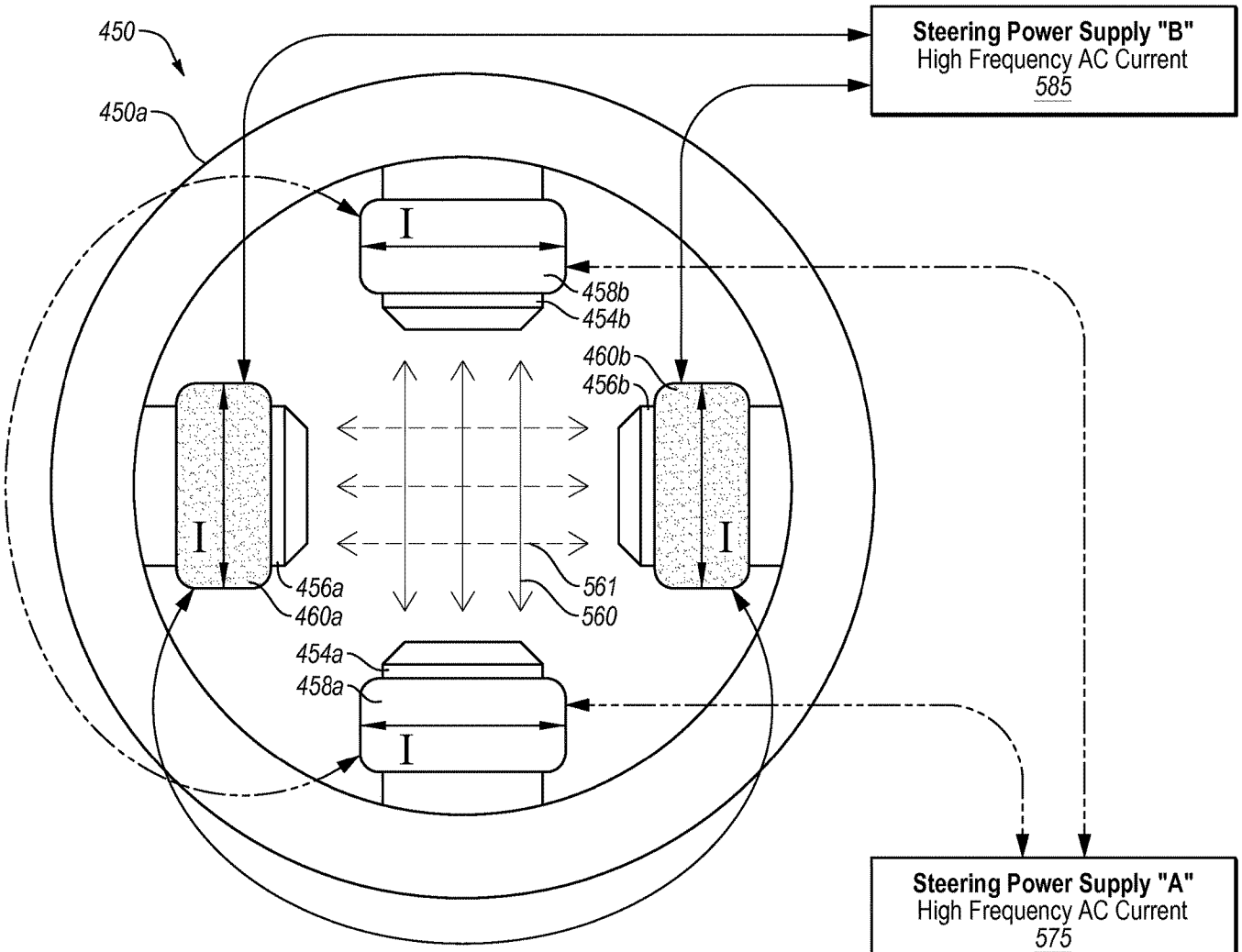
FIG. 20A is a top view of one embodiment of a dipole magnet system.
Figure 20B:
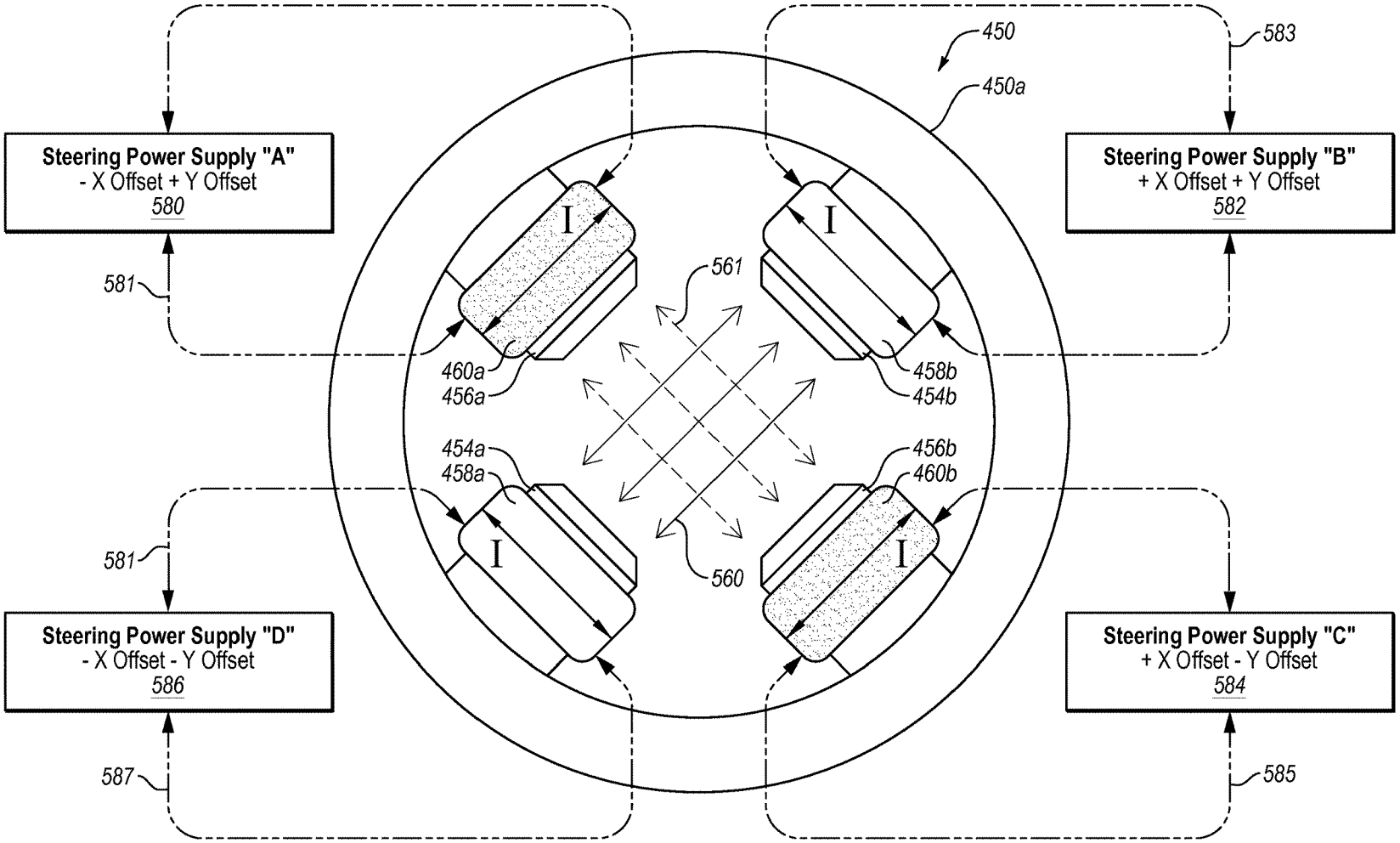
FIG. 20B is a top view of another embodiment of a dipole magnet system.

In one embodiment, the dipole core coils are being controlled independently by the method shown in FIG. 20B, thereby the dipole pole protrusions are in line with the quadrupole pole protrusions at 45, 135, 225 and 315 degrees.

In one embodiment, the dipole core can have dipole coils on the pole protrusions that each have their own supply line for power and operation, which can be independently controlled. The 45 degree offset allows for two separate supply systems, one for the two quadrupole cores and one for the dipole core. This allows for an easier implementation of the electronics for the dipole core.

In one embodiment, the X-ray tube can be configured with a steering coil pair in the x and z plane and a steering coil pair in the x and y plane, which can provide for a reference axis going in and out of the page. The steering coil pairs are configured to move the beam in the x direction, the control can energize at least one steering coil of a first steering coil pair. If there is a desire to move the beam in the z direction, the control can energize one steering coil of the second steering coil pair.

In one embodiment, operation of the X-ray tube can allow for steering at about 6 or 7 kHz and the gentry of the X-ray machine rotates at about 4 Hz, which allows for data collection at six spots for a selected position. This allows for six focal spot positions to be recorded in the time previously one focal spot position was available.

In one embodiment, the X-ray tube can be included in an X-ray system, such as a CT system, and can include electron beam control. The X-ray tube can have high power with focusing and 2-dimensional beam movement controllability with a short or a long throw between the cathode and anode. The X-ray tube can control the beam to a defined emission area for the beam or focal spot area or shape or location on the anode. The X-ray tube can focus the electron beam in two dimensions under active beam manipulation by a cathode quadrupole core and anode quadrupole core. The X-ray tube can steer the electron beam in two dimensions under active beam manipulation by a steering core having independent control of at least two of the steering coils, preferably all four steering coils. Alternatively, at least one coil of an opposing pair of quadrupole coils can be provided with AC offset so as to modulate the quadrupole field to cause beam steering. Such beam steering can be implemented in imaging methods to provide a richer CT data set, where the rich CT data set can be used to improve resolution of an image from the CT. The improved resolution can improve resolution in the slice and row directions of the CT, for example, as per being received (e.g., seen) by the detector. Beam steering can be useful to implement data oversampling of the X-ray by allowing for multiple focal spot locations for a given X-ray imaging time duration.

In one embodiment, a steering core configured for focusing and steering with a quadrupole field can include a magnetic material that has high dynamic response, which material can be used for the yoke and pole projections. The material can have less magnetic flux than the material of a quadrupole core that is configured for only focusing. The material of the steering core can be configured so that it does not saturate at low levels, and it responds to several orders of magnitude faster than the iron material used for the focusing-only quadrupole core. The steering core material can be iron based ferrite with lower saturation flux levels. However, the ferrite material allows for the quadrupole core to respond to flux changes much faster compared to iron, which is beneficial for switching magnetic fields, such as in steering. The material allows up to 7 kHz switching and as low as about 20 microseconds transitions. In one aspect, the steering core material can be a ferrite material. The ferrite can be an iron ceramic, such as iron oxide, which can have different magnetic characteristics compared to the focusing-only quadrupole core material.

In one embodiment, the pole faces of the pole projections can have a reduced profile, such as from ¼ to ⅜ inches across. This can include the pole faces of any of the pole projections, such as for the focusing or steering cores.

In one embodiment, a steering core can have two or four steering coils on the pole projections that each has its own supply line for power and operation, which can be independently controlled.

In one embodiment, the cores can each include fluidic pathways fluidly coupled to a coolant system, which allows coolant to flow through the yokes, and optionally through the pole projections. As such, each pole projection can have a fluid inlet pathway and a fluid outlet pathway coupled to a fluid pathway in the yoke.

In one embodiment, the X-ray tube can include the two quadrupole cores having yokes with the pole projections and the quadrupole coils aligned, which can be referenced at 0, 90, 180, and 270 degrees. The steering coils can be collocated on the pole projections with the quadrupole coils.

In one embodiment, the X-ray tube can include 0 degrees on an axis, and the two quadrupole cores having yokes with the pole projections and the quadrupole coils are aligned, which can be referenced at 45, 135, 225 and 315 degrees. The steering coils can be collocated on the pole projections with the quadrupole coils.

Figure 1B:
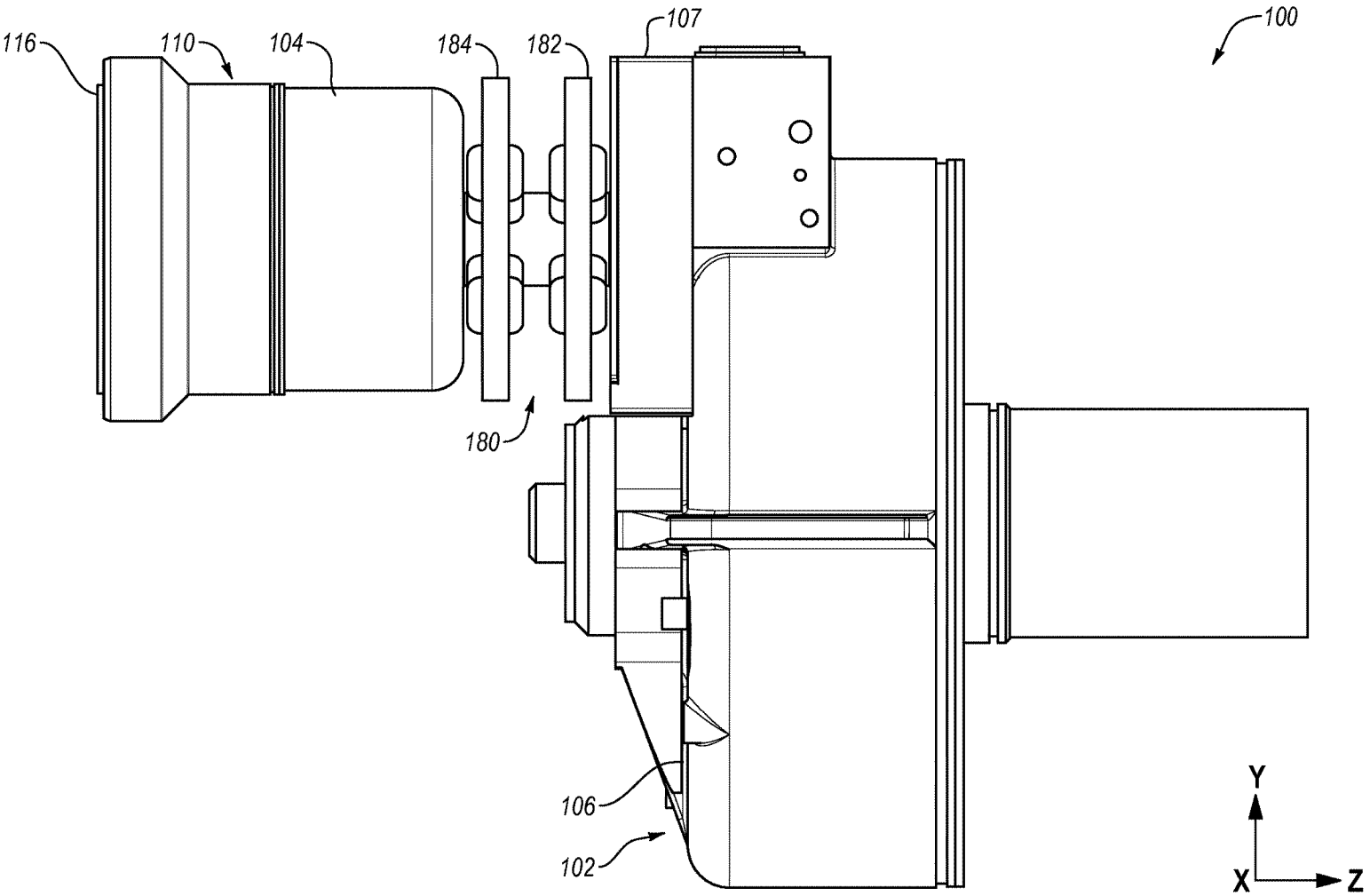
FIG. 1B is a side view of the X-ray tube of FIG. 1A.
Figure 1C:
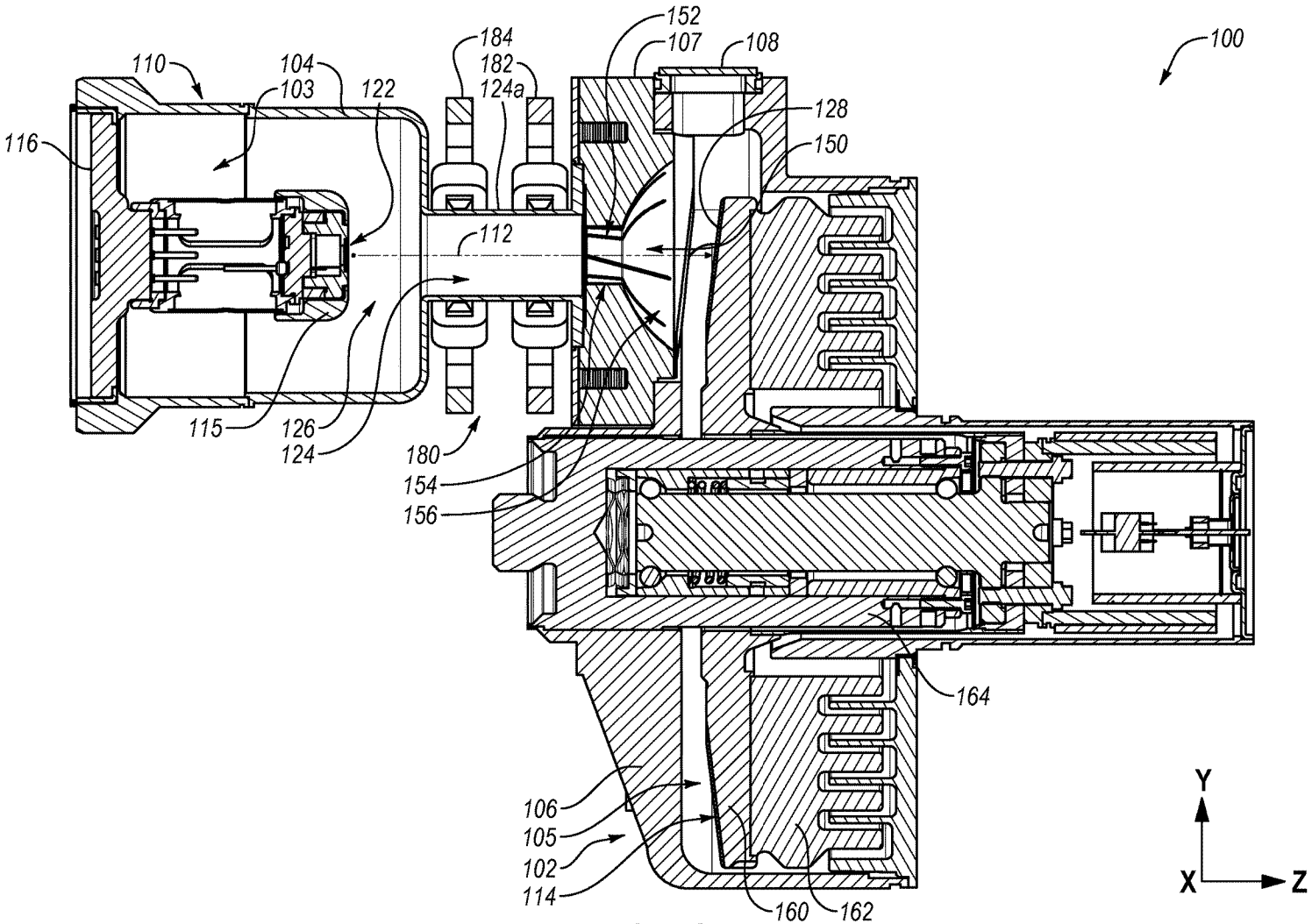
FIG. 1C is a cross-sectional view of the X-ray tube of FIG. 1A.

FIGS. 1A-1C are views of one example of an X-ray tube 100 in which one or more embodiments described herein may be implemented. Specifically, FIG. 1A depicts a perspective view of the X-ray tube 100 and FIG. 1B depicts a side view of the X-ray tube 100, while FIG. 1C depicts a cross-sectional view of the X-ray tube 100. The X-ray tube 100 illustrated in FIGS. 1A-1C represents an example operating environment and is not meant to limit the embodiments described herein.

Generally, X-rays are generated within the X-ray tube 100, some of which then exit the X-ray tube 100 to be utilized in one or more applications. The X-ray tube 100 may include a vacuum enclosure structure 102 which may act as the outer structure of the X-ray tube 100. The vacuum enclosure structure 102 may include a cathode housing 104 and an anode housing 106. The cathode housing 104 may be secured to the anode housing 106 such that an interior cathode volume 103 is defined by the cathode housing 104, and an interior anode volume 105 is defined by the anode housing 106, each of which are joined so as to define the vacuum enclosure 102.

In some embodiments, the vacuum enclosure structure 102 is disposed within an outer housing (not shown) within which a coolant, such as liquid or air, is circulated so as to dissipate heat from the external surfaces of the vacuum enclosure 102. An external heat exchanger (not shown) is operatively connected so as to remove heat from the coolant and recirculate it within the outer housing.

The X-ray tube 100 depicted in FIGS. 1A-1C includes a shield component 107 (e.g., sometimes referred to as an electron shield, aperture, or electron collector) that is positioned between the anode housing 106 and the cathode housing 104 so as to further define the vacuum enclosure 102. The cathode housing 104 and the anode housing 106 may each be welded, brazed, or otherwise mechanically coupled to the shield 107. While other configurations can be used, examples of suitable shield implementations are further described in U.S. patent application Ser. No. 13/328,861 filed Dec. 16, 2011 and entitled "X-ray Tube Aperture Having Expansion Joints," and U.S. Pat. No. 7,289,603 entitled "Shield Structure And Focal Spot Control Assembly For X-ray Device," the contents of each of which are incorporated herein by reference for all purposes.

The X-ray tube 100 may also include an X-ray transmissive window 108. Some of the X-rays that are generated in the X-ray tube 100 may exit through the window 108. The window 108 may be composed of beryllium or another suitable X-ray transmissive material.

With specific reference to FIG. 1C, the cathode housing 104 forms a portion of the X-ray tube referred to as a cathode assembly 110. The cathode assembly 110 generally includes components that relate to the generation of electrons that together form an electron beam, denoted at 112. The cathode assembly 110 may also include the components of the X-ray tube between an end 116 of the cathode housing 104 and an anode 114. For example, the cathode assembly 110 may include a cathode head 115 having an electron emitter, generally denoted at 122, disposed at an end of the cathode head 115. As will be further described, in disclosed embodiments the electron emitter 122 can be configured as a planar electron emitter. When an electrical current is applied to the electron emitter 122, the electron emitter 122 is configured to emit electrons via thermionic emission, that together form a laminar electron beam 112 that accelerates towards the anode target 128.

The cathode assembly 110 may additionally include an acceleration region 126 further defined by the cathode housing 104 and adjacent to the electron emitter 122. The electrons emitted by the electron emitter 122 form an electron beam 112 and traverse through the acceleration region 126 and accelerate towards the anode 114 due to a suitable voltage differential. More specifically, according to the arbitrarily-defined coordinate system included in FIGS. 1A-1C, the electron beam 112 may accelerate in a z-direction, away from the electron emitter 122 in a direction through the acceleration region 126.

The cathode assembly 110 may additionally include at least part of a drift region 124 defined by a neck portion **124*a* of the cathode housing 104. In this and other embodiments, the drift region 124 may also be in communication with an aperture 150 provided by the shield 107, thereby allowing the electron beam 112 emitted by the electron emitter 122 to propagate through the acceleration region 126, the drift region 124 and aperture 150 until striking the anode target surface 128. In the drift region 124, a rate of acceleration of the electron beam 112 may be reduced from the rate of acceleration in the acceleration region 126. As used herein, the term "drift" describes the propagation of the electrons in the form of the electron beam 112 through the drift region 124**.

Positioned within the anode interior volume 105 defined by the anode housing 106 is the anode 114. The anode 114 is spaced apart from and opposite to the cathode assembly 110 at a terminal end of the drift region 124. Generally, the anode 114 may be at least partially composed of a thermally conductive material or substrate, denoted at 160. For example, the conductive material may include tungsten or molybdenum alloy. The backside of the anode substrate 160 may include additional thermally conductive material, such as a graphite backing, denoted by way of example here at 162.

The anode 114 may be configured to rotate via a rotatably mounted shaft, denoted here as 164, which rotates via an inductively induced rotational force on a rotor assembly via ball bearings, liquid metal bearings or other suitable structure. As the electron beam 112 is emitted from the electron emitter 122, electrons impinge upon a target surface 128 of the anode 114. The target surface 128 is shaped as a ring around the rotating anode 114. The location in which the electron beam 112 impinges on the target surface 128 is known as a focal spot (not shown). Some additional details of the focal spot are discussed below. The target surface 128 may be composed of tungsten or a similar material having a high atomic ("high Z") number. A material with a high atomic number may be used for the target surface 128 so that the material will correspondingly include electrons in "high" electron shells that may interact with the impinging electrons to generate X-rays in a manner that is well known.

During operation of the X-ray tube 100, the anode 114 and the electron emitter 122 are connected in an electrical circuit. The electrical circuit allows the application of a high voltage potential between the anode 114 and the electron emitter 122. Additionally, the electron emitter 122 is connected to a power source such that an electrical current is passed through the electron emitter 122 to cause electrons to be generated by thermionic emission. The application of a high voltage differential between the anode 114 and the electron emitter 122 causes the emitted electrons to form an electron beam 112 that accelerates through the acceleration region 126 and the drift region 124 towards the target surface 128. Specifically, the high voltage differential causes the electron beam 112 to accelerate through the acceleration region 126 and then drift through the drift region 124. As the electrons within the electron beam 112 accelerate, the electron beam 112 gains kinetic energy. Upon striking the target surface 128, some of this kinetic energy is converted into electromagnetic radiation having a high frequency, i.e., X-rays. The target surface 128 is oriented with respect to the window 108 such that the X-rays are directed towards the window 108. At least some portion of the X-rays then exit the X-ray tube 100 via the window 108.

Additionally, FIG. 1C shows a cross-sectional view of an embodiment of a cathode assembly 110 that can be used in the X-ray tube 100 with the planar electron emitter 122 and magnetic system 200 described herein. As illustrated, a throw path between the electron emitter 122 and target surface 128 of the anode 114 can include the acceleration region 126, drift region 124, and aperture 150 formed in shield 107. In the illustrated embodiment, the aperture 150 is formed via aperture neck 154 and an expanded electron collection surface 156 that is oriented towards the anode 114.

Optionally, one or more electron beam manipulation components can be provided. Such devices can be implemented so as to "steer" and/or "deflect" the electron beam 112 as it traverses the drift region 124, thereby manipulating or "toggling" the position of the focal spot on the target surface 128. Additionally or alternatively, a manipulation component can be used to alter or "focus" the cross-sectional shape of the electron beam and thereby change the shape of the focal spot on the target surface 128. In the illustrated embodiments electron beam focusing and steering are provided by way of a magnetic system denoted generally at 180.

The magnetic system 180 can include various combinations of focusing quadrupoles, steering quadrupoles, steering coils, and steering dipoles implementations that are disposed so as to impose magnetic forces on the electron beam 112 so as to focus and/or steer the beam. One example of the magnetic system 180 is shown in FIGS. 1A-1D. In this embodiment, the magnetic system 180 is implemented as two magnetic cores 182, 184 disposed in the electron beam path 112 of the X-ray tube 100. The combination of the two cores 182, 184 are configured to (a) focus in both directions perpendicular to the beam path, and (b) to steer the beam in both directions perpendicular to the beam path. In this way, the two cores 182, 184 can have quadrupoles that act together to form a magnetic lens (sometimes referred to as a "doublet"), and the focusing and steering is accomplished as the electron beam passes through the quadrupole "lens." The "focusing" provides a desired focal spot shape and size. Additionally, the magnetic system 180 can be configured with at least one coil or a pair of coils that have an AC offset, and preferably two perpendicular pairs of coils that have an AC offset, used for steering. The steering can be implemented by configurations of the two cores 182 and 184 as described herein as well as an embodiment that utilizes three cores, which is described in more detail herein. Accordingly, the "steering" affects the positioning of the focal spot on the anode target surface 128. The magnetic system 180 may be substituted with any of the other magnetic systems described herein.

Figure 1D:
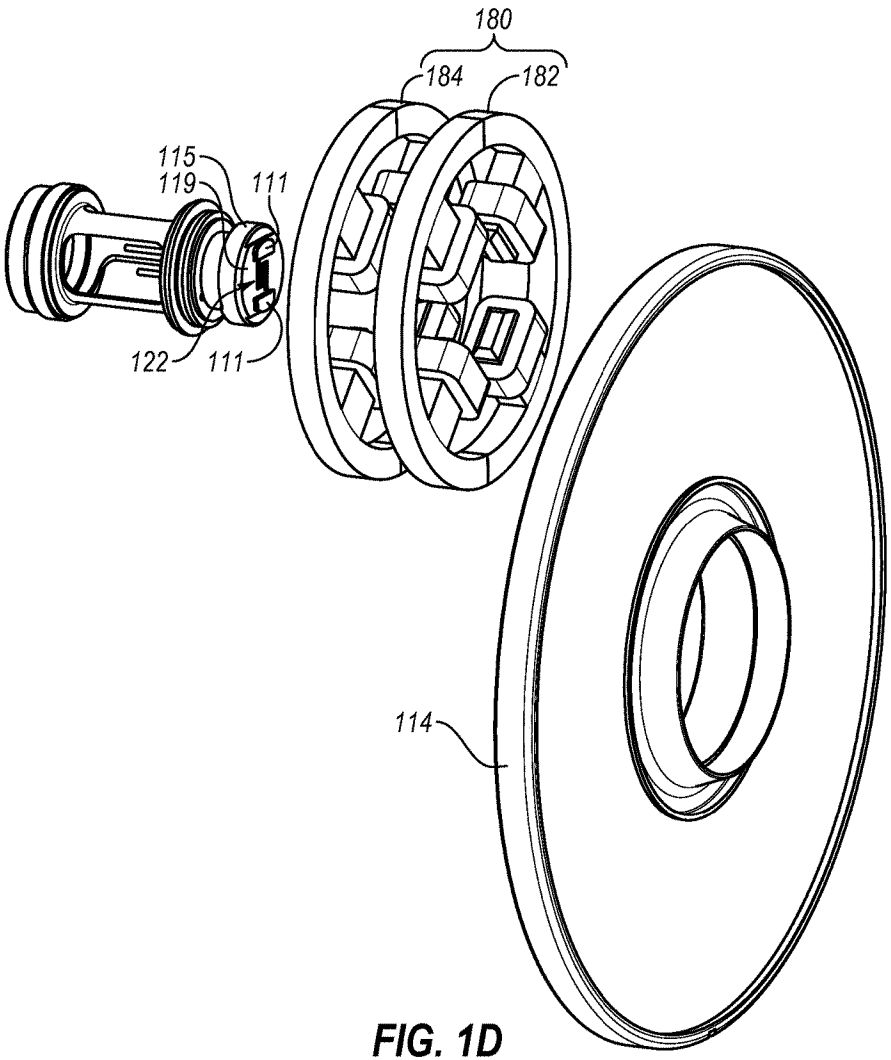
FIG. 1D is a perspective view of internal components of an embodiment of an example X-ray tube.

FIG. 1D shows the components of the X-ray device 100 that are arranged for electron emission, electron beam steering and/or focusing, and X-ray emission. In FIG. 1D, disposed within the beam path is the magnetic system 180 configured to focus and steer the electron beam before reaching the anode 114, as noted above. A portion of the cathode assembly 110 has the cathode head 115 with the electron emitter 122 on an end of the cathode head 115 so as to be oriented or pointed toward the anode 114 (see FIG. 1C for orientation). The cathode head 115 can include a head surface 119 that has an emitter region that is formed as a recess that is configured to receive the electron emitter 122 (e.g., planar electron emitter). The head surface 119 also includes electron beam focusing elements 111 located on opposite sides of the electron emitter 122. However, the magnetic system 180 may be substituted or modified to include any of the components of any of the magnetic systems described herein, such as the different two core embodiments or three core embodiments.

Figure 2A:
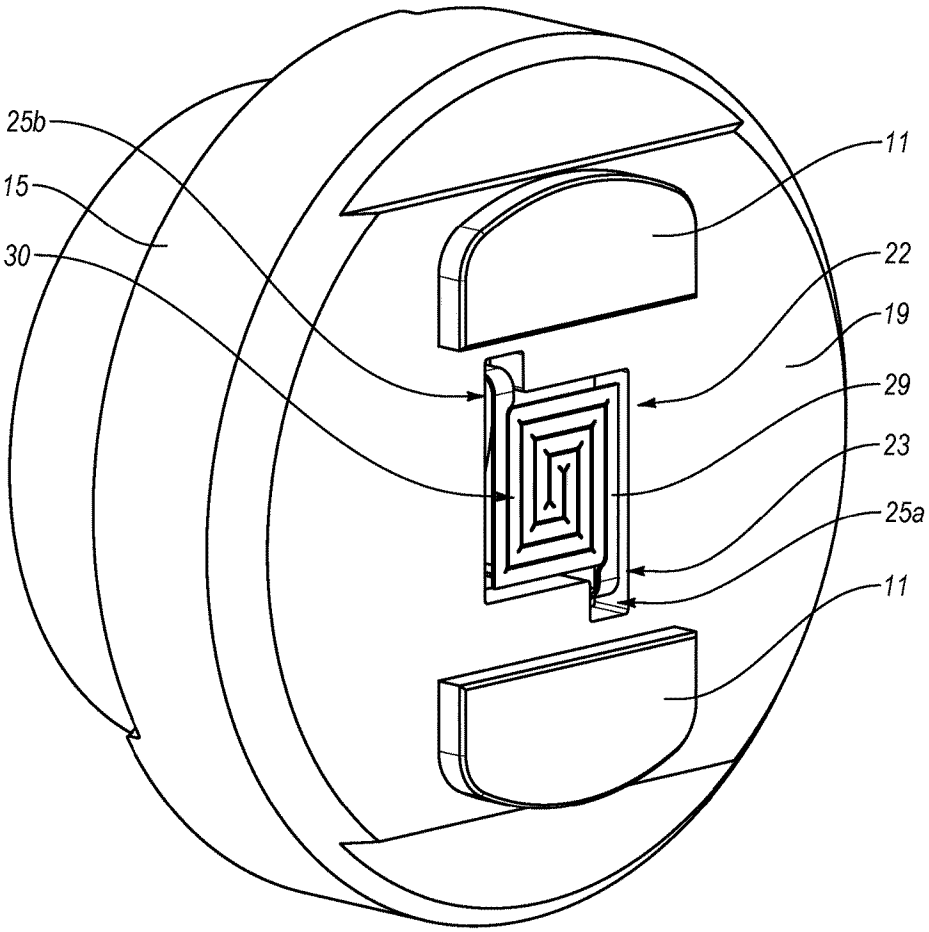
FIG. 2A is a perspective view of an embodiment of a cathode head and planar electron emitter.

II. Example Embodiments of a Planar Emitter with Tunable Emission Characteristics FIG. 2A illustrates a portion of the cathode assembly 110, such as from FIGS. 1A-1C, which has a cathode head 15 with a planar electron emitter 22 on an end of the cathode head 15 so as to be oriented or pointed toward the anode 14 (e.g., see FIG. 1C-1D for orientation). The cathode head 15 can include a head surface 19 that has an emitter region 23 that is formed as a recess in surface 19 that is configured to receive the planar electron emitter 22, which further includes a first lead receptacle 25*a* configured to house a first lead 27*a* of the electron emitter 22 and second lead receptacle 25*b* configured to house a second lead 27*b* of the electron emitter 22 (see FIG. 2B). The emitter region 23 can have various configurations, such as a flat surface or the illustrated recess shaped to receive the electron emitter 22, and the first and second lead receptacles 25*a*-*b* can be conduits extending into the body of the cathode head 15. The electron emitter 22 includes an emitter body 29 that is continuous from the first lead 27*a* to the second lead 27*b* and forms an emitter pattern 30. The head surface 19 also includes electron beam focusing elements 11 located on opposite sides of the electron emitter 22.

Figure 2B:
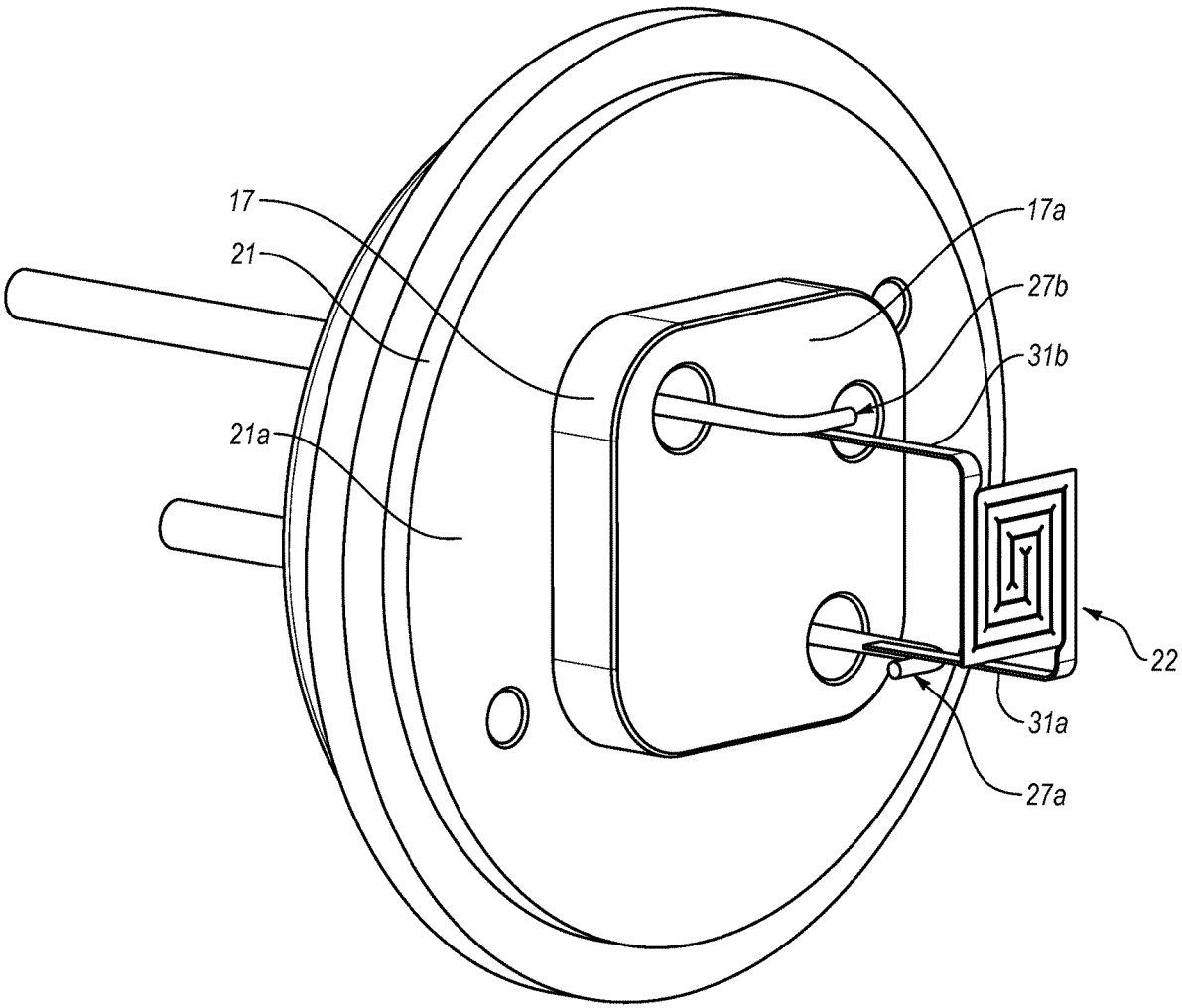
FIG. 2B is a perspective view of an embodiment of an internal region of the cathode head that shows electrical leads for the planar electron emitter of FIG. 2A.

FIG. 2B illustrates an embodiment of an internal region of the cathode head 15 that shows electrical leads 27*a*, 27*b* for the planar electron emitter 22. As shown, a base 21 can be dimensioned to receive the cathode head 15 thereover. The base 21 can include a lead housing 17 protruding from a base surface 21*a*. The lead housing 17 can include a lead housing surface 17*a* that has the first lead receptacle and second lead receptacle formed therein. The first lead receptacle houses the first lead 27*a*, and the second lead receptacle houses the second lead 27*b*. The first lead 27*a* is electrically coupled to a first leg 31*a*, and the second lead 27*b* is electrically coupled to a second leg 31*b*. The electrical coupling may be structurally reinforced with a mechanical coupling between the leads 27*a*, 27*b* with the legs 31*a*, 31*b*. The mechanical coupling can be by welding, brazing, adhesive, mechanical coupling or other coupling that keeps the first and second leads 27*a*, 27*b* physically and mechanically coupled with the corresponding first and second legs 31*a*, 31*b*. The first and second leads 27*a*, 27*b* can be electrically connected to the cathode assembly 110 as known in the art.

Figure 2C:
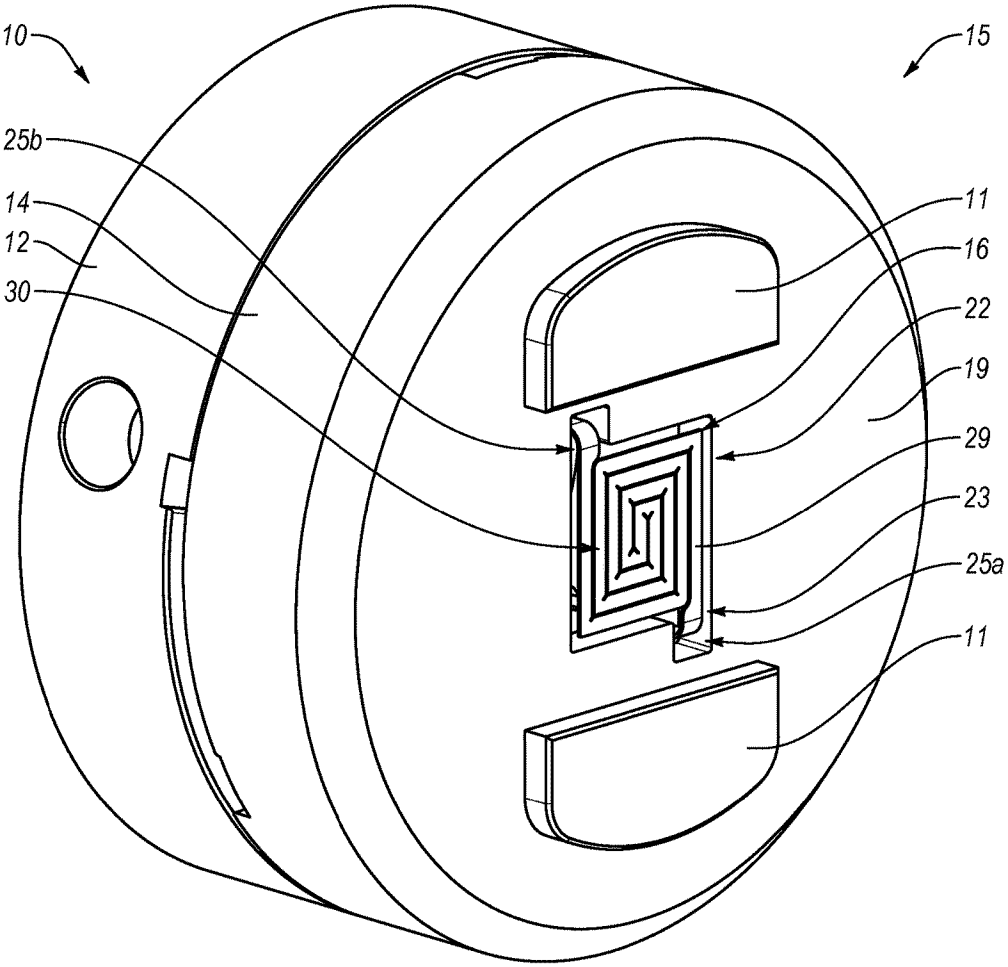
FIG. 2C is a perspective view of an embodiment of a cathode head and planar electron emitter with an adjustable height.

FIG. 2C shows the cathode head 15 to have an emitter height adjustment mechanism 10, which includes a rotating member 12 and an elevating member 14. Rotation of the rotating member 12 in one direction elevates the emitter 22, and rotation of the rotating member 12 in the other direction sinks the emitter 22 relative to the cathode head surface 19. The raising of the emitter 22 can be by the cathode head surface 19 lowering relative to the emitter 22, and the lowering of the emitter 22 can be by the cathode head surface 19 raising relative to the emitter 22. In one option, the emitter 22 raises or lowers and the surface 19 stays fixed by rotating member 12 relative to elevating member 14. In one option, the emitter 22 stays fixed and the surface 19 raises or lowers by rotating member 12 relative to elevating member 14. In one aspect, the emitter can be attached to the base, and the elevating member 14 raises so that the surface 19 raises relative to the emitter 22. The rising and sinking of the emitter 22 by the adjustment mechanism 10 can be relative to the head surface 19. As such, the emitter 22 can be elevated or sunk relative to a recess 16 in the head surface 19, where the recess 16 can be shaped and dimensioned to accommodate the emitter 22 therein. The elevating member 14 may rise or lower while the emitter 22 stays at a fixed height. However, a modification can be the rotation of the rotating member 12 and the elevating member 14 elevating the emitter 22 up or down and the surface 19 staying at a fixed height.

The cathode head 15 can include a head surface 19 that has an emitter region 23 that is formed as a recess 16 in head surface 19 that is configured to receive the electron emitter 22, which further includes a first lead receptacle 25*a* configured to house a first lead of the electron emitter 22 and second lead receptacle 25*b* configured to house a second lead of the electron emitter 22. The emitter region 23 can have various configurations, such as a flat surface or the illustrated recess 16 shaped to receive the electron emitter 22, and the first and second lead receptacles 25*a*-*b* can be conduits extending into the body of the cathode head 15.

Figure 3A:
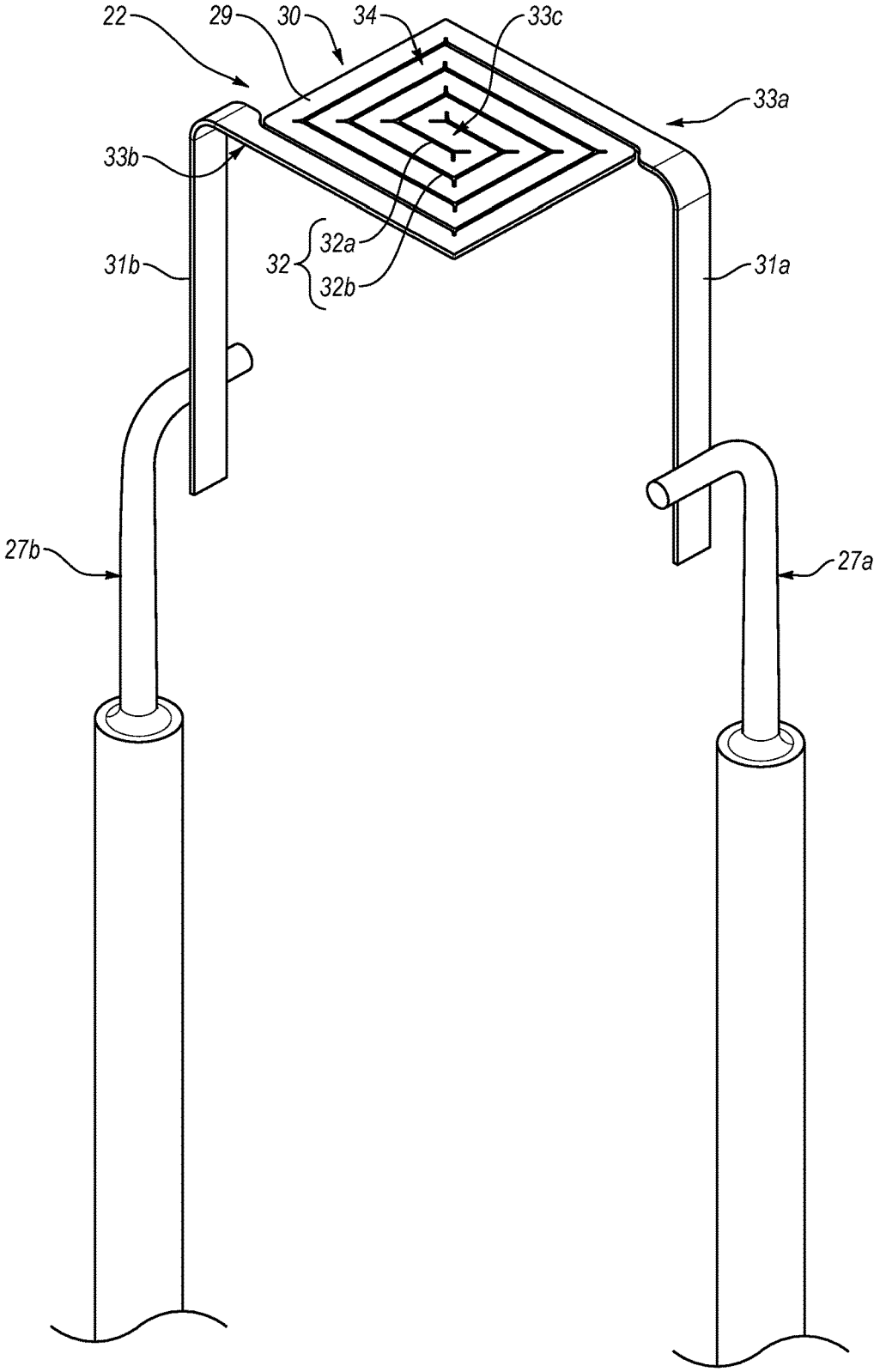
FIG. 3A is a perspective view of an embodiment of a planar electron emitter coupled to electrical leads.

FIG. 3A illustrates an embodiment of the electron emitter 22 coupled with the first and second leads 27*a*, 27*b*. The emitter pattern 30 can be two-dimensional so as to form a planar emitter surface 34, where different regions of the emitter body 29 cooperate to form the planar emitter surface 34. There are gaps 32 (e.g., illustrated by lines between members) between different regions of the emitter body 29, where the gaps 32 may form a first continuous gap 32*a* from a first end 33*a* to a middle region 33*c* and the gaps 32 may form a second continuous gap 32*b* from the middle region 33*c* to a second end 33*b* of the planar emitter surface 34. As illustrated, the middle region 33*c* of the planar emitter surface 34 is also the middle region of the electron emitter 22 and middle region of the emitter body 29 and the emitter pattern 30. However, other arrangements, configurations, or patterns may be implemented to an electron emitter 22 so as to have a planar emitter surface 34.

The emitter body 29 can have various configurations; however, one configuration includes at least one flat surface 41 (e.g., flat side, see FIG. 3C) that when patterned in a planer emitter pattern 30 forms the planar electron emitter 22. That is, the emitter body 29 is continuous and patterned so that electrical current flows from the first lead 27*a* through the emitter body 29 in the emitter pattern 30 to the second lead 27*b*, or vice versa.

In one aspect, no portions or regions of the emitter body 29 touch each other from the first end 33*a* to the second end 33*b*. The emitter pattern 30 may be tortuous with one or more bends, straight sections, curved sections, elbows or other features; however, the emitter body 29 does not include any region that touches another region of itself. In one aspect, all of the sections between corners or elbows are straight, which can avoid open windows or open apertures of substantial dimension within the emitter pattern 30, where openings of substantial dimensions can cause unwanted side electron emission lateral of the throw path of the X-ray tube 100. Thus, the electrical current only has one path from the first lead 27*a* to the second lead 27*b*, which is through the emitter body 29 in the emitter pattern 30 from the first end 33*a* to the second end 33*b*. However, additional leads can be coupled to the emitter body 29 at various locations of the emitter pattern 30 so as to tune the temperature and electron emission profiles. Examples of locations and configurations of additional leads is described in more detail below.

Figure 3B:
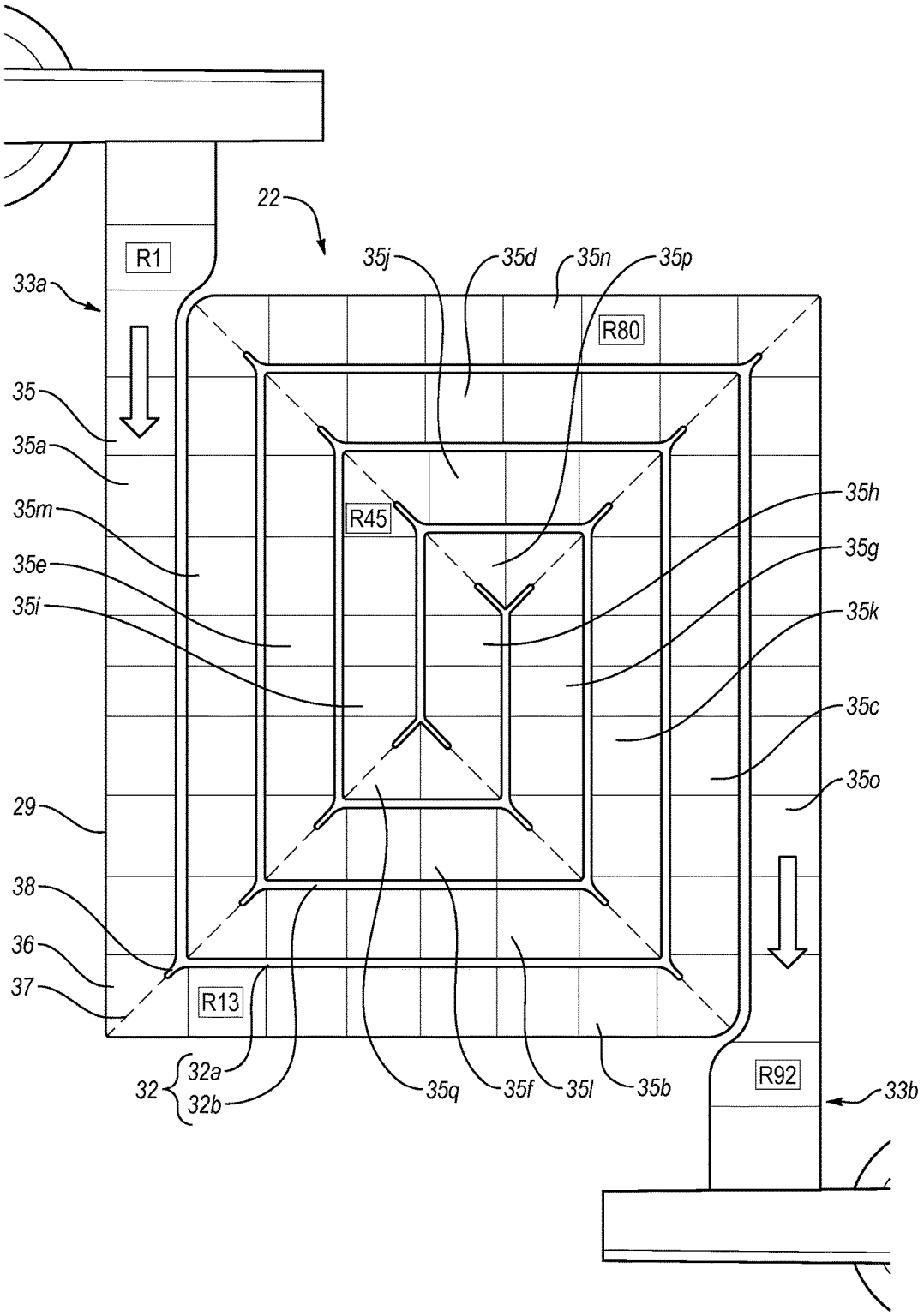
FIG. 3B is a top view of an embodiment of a pattern for a planar electron emitter.

The planar layout (e.g., planar emitter pattern 30) of the current path of the electron emitter 22 is created to produce a tailored heating profile. The tailoring can be performed during the design phase in view of various parameters of one or more end point applications. Here, since the emission of electrons is thermionic, emission can be controlled and matched to the desired emitting region (e.g., one or more rungs 35, see FIG. 3B) of the electron planar emitter surface 34 by designing the heating profile of the emitting region. Further, tailoring the temperature and emission profiles during design protocols allows the profile of the emitted electron beam to be controlled and can be used to create the desired one or more focal spots. This configuration of a planar electron emitter 22 is in direct contrast to traditional helically wound wire emitters, which do not create electron paths that are perpendicular to the emitter surface, and therefore are not useful in, for example, so-called "long throw" applications. Additionally, the shape and size of a circular flat emitter limits total emission and the shape does not easily facilitate tailoring the spot size and shape to a particular application. On the other hand, embodiments of the proposed planar electron emitter such as shown in FIGS. 3A-3B can be scalable and the emitter form and pattern can be designed to be tailored to various shapes and can be used in any type of X-ray tube, including but not limited to long throw tubes, short throw tubes, and medium throw tubes, as well as others. The magnetic systems can also be used in any type of X-ray tube, including but not limited to long throw tubes short throw tubes and medium throw tubes, as well as others FIG. 3A also shows that the first lead 27*a* can be coupled to a first leg 31*a* at the first end 33*a* of the emitter body 29 and the second lead 27*b* can be coupled a second leg 31*b* at the second end 33*b* of the emitter body 29. As shown, the first leg 31*a* is opposite of the second leg 31*b*; however, in some configurations the first leg 31*a* may be adjacent or proximal of the second leg 31*b* or at any point on the emitter pattern 30.

In one embodiment, the electron emitter 22 can be comprised of a tungsten foil, although other materials can be used. Alloys of tungsten and other tungsten variants can be used. Also, the emitting surface can be coated with a composition that reduces the emission temperature. For example, the coating can be tungsten, tungsten alloys, thoriated tungsten, doped tungsten (e.g., potassium doped), zirconium carbide mixtures, barium mixtures or other coatings can be used to decrease the emission temperature. Any known emitter material or emitter coating, such as those that reduce emission temperature, can be used for the emitter material or coating. Examples of suitable materials are described in U.S. Pat. No. 7,795,792 entitled "Cathode Structures for X-ray Tubes," which is incorporated herein in its entirety by specific reference.

FIG. 3B shows a top view of the electron emitter 22 described in connection to FIG. 3A. The top view allows for a clear view of various features of the electron emitter 22 that are now described in detail. The emitter body 29 includes rungs 35 connected together at corners 36 so as to form the emitter pattern 30, where the rungs 35 are the elongate members between the corners 36 and connected end to end (e.g., 35*a*-35*o*) at the corners 36 from the first end 33*a* to the second end 33*b*. As shown in FIG. 3B, there are four left side rungs 35*a*, 35*e*, 35*i*, 35*m*, four right side rungs 35*c*, 35*g*, 35*k*, 35*o*, three top rungs 35*d*, 35*j*, 35*n*, three bottom rungs 35*b*, 35*f*, 351, and a central rung 35*h*, which is based on portrait page orientation. However, any number of rungs 35 from a central rung 35*h* or central point to the outer rungs, to the right, left, top or bottom, can be used as is reasonable. Also, the emitter regions 35*p*, 35*q* between the central rung 35*h* and connected rungs 35*g*, 35*i* may be considered rungs 35 or mini rungs, where these emitter regions 35*p*, 35*q* are between the webs 37, which results in four left, right, top, and bottom rungs. However, the electron emitter 22 can include any number of rungs and in any orientation or shape. Each corner 36 is shown to have a slot 38 protruding from the gap 32 into the corner 36. The body of the corner 36 between the slot 38 and the apex of the corner is referred to as a web 37, which is shown be a dashed line in the corners 36. The web 37 can extend from the nadir (e.g., inside or concave part) to the apex (e.g., outside or convex part). The slots 38 are all shown to extend from the gap 32 through the nadir toward the apex; however, the slots 38 may extend from the apex toward the nadir. When there is a slot 38 at the nadir, the nadir is considered to be the intersection that would have occurred from the connected rungs 35 had the slot 38 been absent, which results in the nadir being in the slot. As such, the nadir is not at the termination of a slot 38 within a corner 36. The apex and nadir are the true apex and nadir without any slots or cutouts at the corner. As shown, the gaps 32 separate all of the rungs 35 from each other and all of the corners 36 from each other. This provides for a single electrical path shown by the arrows from the first end 33*a* to the second end 33*b*.

The rungs 35 can all be the same dimension (e.g., height and/or width), all be different dimensions, or any combination of same and different dimensions from the first end 33*a* to the second end 33*b*. The gaps 32 can all be the same dimension (e.g., gap width dimension between adjacent rungs 35), all be different dimensions, or any combination of same and different dimensions from the first end 33*a* to the middle region 33*c* and from the middle region 33*c* to the second end 33*b*. The corners 36 can all be the same configuration, all be different configurations, or any combination of same and different configurations from the first end 33*a* to the second end 33*b*. The webs 37 can all be the same dimension, all be different dimensions, or any combination of same and different dimensions from the first end 33*a* to the second end 33*b*. Changing the dimension of any of these features, alone or in combination, can change the electron emission profile, which allows for selective combinations to tune the electron emission profile. Additionally, the longitudinal length of each rung may be changed or optimized in order to obtain a desired temperature profile.

In one example, the width of all of the outer rungs 35*a*, 35*b*, 35*n*, 35*o* can be the same dimension, while the rest of the rungs can all be another different dimension. In one example, the gaps 32 adjacent to all of the outer rungs 35*a*, 35*b*, 35*n*, 35*o* can be the same dimension, while the rest of the gaps 32 can all be another different dimension. In one example, the corners 36 can have an apex that is smooth and rounded or sharp and pointed. In one example, the webs 37 at an outer corner 36 can be a different dimension from the webs 37 at an inner corner 36.

For example, the outer rungs 35 can be fabricated so as to be wider than middle rungs 35 and/or inner rungs 35, thereby assuring less electrical resistance so as to remain cooler resulting in lower (or no) emission of electrons. Moreover, the widths of the gap 32 between adjacent rungs 35 can be adjusted to compensate for rung width thermal expansion and rung length thermal expansion, as well as for width and length contraction.

In one embodiment, the web 37 widths can be used to tune the resistance in the rungs 35, and thereby the heating and temperature of each rung 35 due to current passing therethrough can be tuned. For example, in certain applications the midpoints of the rungs 35 can be heated readily, with the ends at the corners 36 or at the webs 37 tending to be cooler. Adjusting the dimension of the webs 37 provides a level of control to "tune" the thermionic emission characteristics of the electron emitter 22. The webs 37 can be dimensioned such that the temperature of the rung 35 matches a desired value and is more uniform between corners 36 along the lengths of each rung 35. This affects the rungs 35 on either side of the corner 36, so a web 37 can be matched to the two rung lengths of the rungs 35 that the particular web 37 is between. This also provides some control over individual rung 35 temperatures so it is possible to create a temperature profile across the width and length of the entire electron emitter 22 which can be tailored or tuned to meet various needs or specific applications. Tuning the web 37 dimensions can be accomplished by varying the dimension of the slots 38 that extend from the gaps 32 and terminate in the corners 36. Tuning web dimensions can be considered a primary design tool for tuning temperature and electron emission profiles of the electron emitter 22. Often, the web 37 can be about the same dimension as the width of the rugs 35, or within 1%, 2%, 4%, 5%, or 10% thereof.

In one embodiment, the width of one or more of the rungs 35 can be adjusted to tune the temperature profile, which in turn tunes the electron emission profile; however, this approach can be considered to be a secondary design tool in terms of achieving specific temperature and electron emission profiles. In certain applications, modification of the width of the rungs 35 may not have as strong of an effect on the temperature profile, and might tend to heat or cool the entire length of the rung 35. However, this approach can be used to suppress the emission on the outer rungs 35*a*, 35*b*, 35*n*, 35*o* of the electron emitter 22. Dimensioning the outer rungs 35*a*, 35*b*, 35*n*, 35*o* to be larger or have a larger dimension can avoid emission from the outer rungs 35*a*, 35*b*, 35*n*, 35*o*, where emission from these outer rungs 35*a*, 35*b*, 35*n*, 35*o* can create undesirable X-rays that manifest as wings and/or double peaking in the focal spot. On the other hand, dimensioning the middle rungs or inner rungs as well as the central rung to be relatively smaller in dimension can enhance emission from these rungs 35. As such, dimensioning one or more rungs 35 to be smaller than one or more other rungs 35 can result in the smaller rungs having enhanced electron emission compared to the larger rungs. Thus, any one or more rungs 35, connected or separated, can be dimensioned to be smaller to increase electron emission or dimensioned to be larger to inhibit electron emission.

In certain embodiments, the electron emitter 22 can be configured with different dimensions of rungs 35, gaps 32, and/or webs 37 to limit or suppress electron emission from certain rungs 35 of the emitter such that electrons are emitted from different areas of the emitter at different rates. For example, due to proximity to other structures at the perimeter of the electron emitter 22, which may cause the emitted electrons to have an unwanted trajectory, the outer rungs 35 can have a larger dimension (e.g., wider) compared to the inner rungs 35 or central rung 35*h*, which causes lower temperatures in the outer rungs 35 and thereby comparatively less electron emission from the outer rungs 35. Different dimension parameters of the rungs 35, gaps 32, and/or webs 37 can be used to obtain a smaller electron emission area from a physically larger electron emitter 22. For example, only the central rung 35*h* and adjacent inner rungs 35 may significantly emit electrons from the electron emitter 22 by tuning the different dimension parameters. Alternatively, the central rung 35*h* and/or inner-most rungs 35 can be dimensioned to be thicker than rungs 35 between these rungs 35 and the outer rungs 35 to create a hollow beam of electrons. Any one of a different number of emission profiles can be provided, including non-uniform or non-homogenous profiles by tuning the dimensional parameters of the rungs, webs, and gaps of the planar electron emitter 22.

Figure 3C:
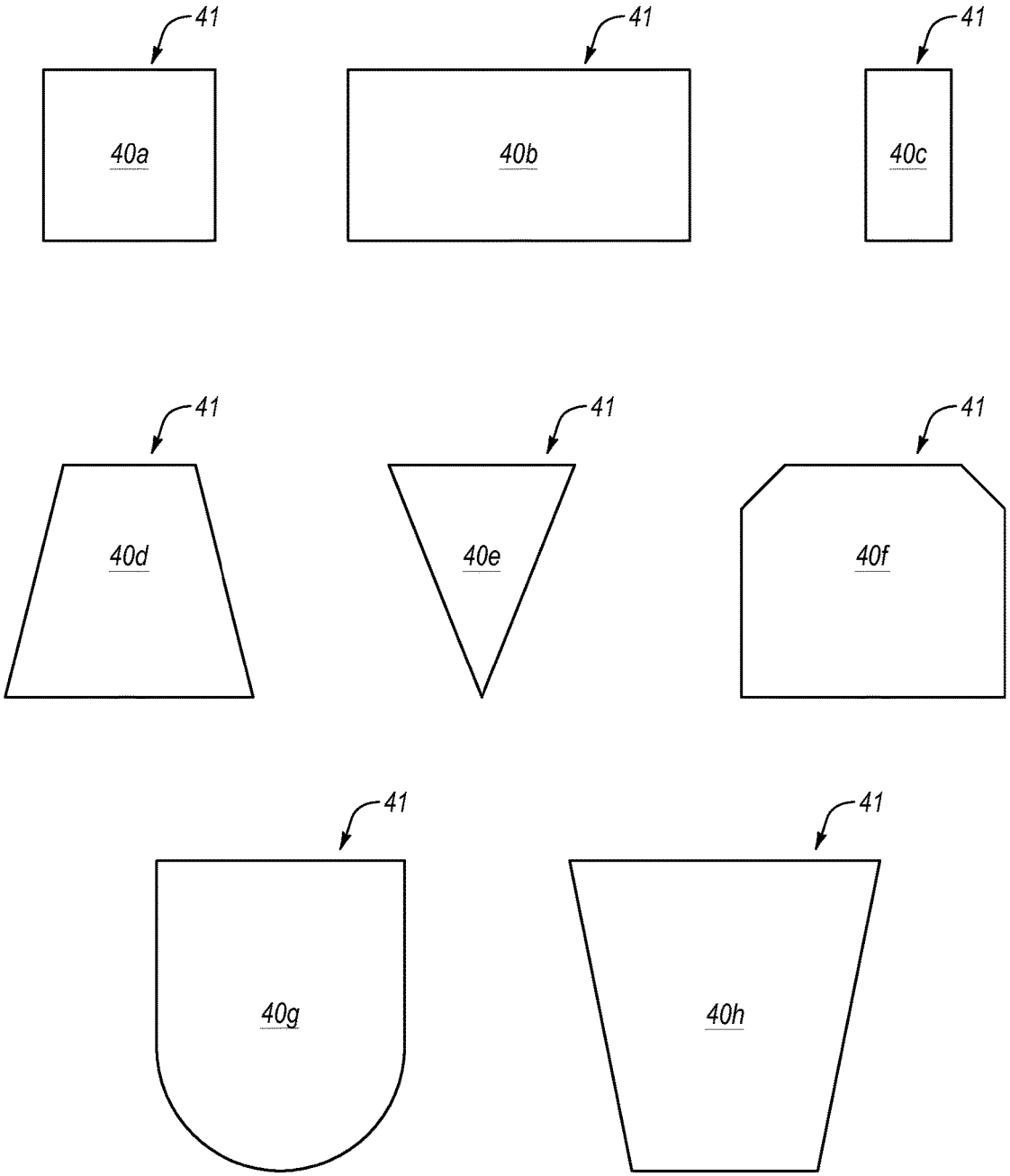
FIG. 3C is a cross-sectional view of embodiments of cross-sectional profiles of rungs of a planar electron emitter.

While the dimensions of the rungs 35, gaps 32, and/or webs 37 is usually considered in the planar dimension that is shown in FIG. 3B, the orthogonal dimension (e.g., height that is into or out from the page of FIG. 3B, as shown in FIG. 3C) may also be tuned. Also, the dimension of the rungs 35, gaps 32, and/or webs 37 being tuned can be width or height so that the cross-sectional area is tuned. On the other hand, the height can be set where the width is tuned so that the planar emitter surface 34 is tuned for electron emission.

In one embodiment, relative cooling of rungs 35 in other positions can be done by making these rungs 35 relatively cross-dimensionally larger as needed to modify the emission profile and/or to create other focal spots or multiple focal spots. For example, as noted, relative cooling (e.g., comparatively reduced temperature) of the central rung 35*h* or inner-most rungs (e.g., 35*f*, 35*g*, 35*i*, 35*j*, optionally 35*p*, 35*q*) of the electron emitter 22 can be done by making these rungs have a larger dimension (e.g., wider) compared to the middle rungs (e.g., 35*c*, 35*d*, 35*e*, 35*k*, 35*l*, 35*m*) to create a hollow beam for certain applications. The outer rungs (e.g., 35*a*, 35*b*, 35*n*, 35*o*) can be larger than the middle rungs 35 so that the outer rungs 35 do not substantially emit electrons. Also, if central rung 35*h* and the middle rungs 35 are smaller than the inner-most rungs 35, then a spot in halo electron emission profile can be generated. If the central rung 35*h* and optionally inner-most rungs are smaller than the middle and outer rungs, then the electron emission can be condensed into the center of the electron emitter 22. Thus, the dimensions of different rugs 35 can be tailored alone, or with the dimension of the webs 37, for tuning temperature and electro emission profiles.

In another embodiment, a variable width down the length of one or more rungs 35 can provide a tuned temperature and emission profile. However, such rung 35 dimensioning should be tailored in view of adjacent rungs 35 across the gaps 32 to avoid larger gaps 32 between rungs 35, which larger gaps 32 can in turn create more edge emission electrons with non-parallel paths, which is unfavorable.

In one embodiment, it can be desirable to dimension the gaps 32 in accordance with the thermal expansion coefficient of the emitter body material so that a gap 32 always exists between adjacent rungs 35 while cool and while fully heated. This maintains the single electrical current path from the first end 33*a* to the second end 33*b*.

In view of design optimization of the emitter pattern 30 and dimensions thereof, the following dimensions can be considered to be example dimensions that can be designed by the design protocols described herein. The height (e.g., material thickness) of each rung 35 can be about 0.004", or about 0.004" to 0.006", or about 0.002" to 0.010". The rung 35 width can be about 0.0200", or about 0.0200" to 0.0250", or about 0.0100" to 0.0350". The rung 35 width can be determined along with the rung length and rung thickness so that each rung is designed to match the emitter supply's available current. The rung 35 length can be about 0.045" to 0.260", or about 0.030" to 0.350", or about 0.030" to 0.500", where the rung 35 length can be dimensioned depending on the emission area and the resulting emission footprint. The gap 32 width can be about 0.0024" to 0.0031", or about 0.002" to 0.004", or about 0.001" to 0.006", where the gap 32 width can depend on thermal expansion compensation needed to maintain the gaps so that the adjacent rungs 35 do not touch. The web 37 dimension can be about 0.0200" to 0.0215", or about 0.0200" to 0.0250", or about 0.0100" to 0.0350", which dimension can be tied to rung 35 width and the desired heating profile. The result of the dimensioned emitter 22 is that for a given heating current, desired emission current (mA), focal spot size, and allowed foot print, the dimensions of the rung 35, web 37, and gap 32 can be modified to design an emitter 22 that creates a laminar electron beam needed for a particular application.

Additionally, FIG. 3B shows five different number blocks: R1, R13, R45, R80, and R92, which correspond with the ninety-two discrete regions of the emitter body 29 from the first end 33*a* (e.g., region R1) to the second end 33*b* (e.g., region R92) shown by the squares on the rungs 35. Each of these regions were analyzed for temperature upon being energized by electrical current, which data is shown and described in FIGS. 5A and 5B and Tables 1 and 2 below.

FIG. 3C illustrates various cross-sectional profiles 40*a*-40*h* of the rungs 35, where each has a flat emitting surface 41. As such, the electrons are preferentially emitted from the flat emitting surface 41, such that all of the flat emitting surfaces 41 of the rungs 35 cooperate to form the planar emitter surface 34. However, round emitting surfaces (not shown) may be used in some instances for forming the planar emitting surface 34.

In yet other embodiments, other general shapes and/or other cut patterns can be designed to achieve a desired emission profile for an electron emitter. Various other configurations, shapes, and patterns can be determined in accordance with the electron emitter embodiments described herein.

Also, additional attachments can be made for shortening the current path or creating adjacent emitters from the same field, for example. In one example, the attachments can be additional legs that may or may not be coupled to additional electrical leads. The attachments can be at any region from region R1 to region R92 (see FIG. 3B). When coupled to electrical leads, the attachments can define new electron paths to cause some regions to have current and others to have no current, which can result in inhomogeneous temperature and emission profiles. The locations of the attachments can then provide for custom electron paths and thereby custom emission patterns. While not shown, additional legs, e.g., conductive or non-conductive, could be provided for support to the electron emitter 22 if needed for a given application. The legs can be attached at the ends, edges, center, or other locations of the rungs along the emitter 22 or at any other locations. When non-conductive, the legs can be attached to any region and provide support to keep the emitter 22 to have the planar emitter surface 34. When conductive, the legs can be attached to any region to provide support to keep the emitter 22 to have the planar emitter surface 34 and to define electron flow paths to customize the temperature and emission profiles.

In one embodiment, the gaps 32 between some of the rungs 35 can be dimensioned to be true gaps 32 while cool, but then once thermal expansion occurs, the gaps 32 shrink so that the adjacent rungs 35 contact each other to create a new electrical current path. This can be done to cause the effective dimension to be small at low temperatures, but then increase at higher temperatures so that the rungs 35 that touch upon thermal expansion can provide an effectively larger rung 35 that reduces the local temperature. Such variable gap 32 dimensions that close upon heating can be designed so that the electron emitter 22 has a certain temperature and electron emission profile upon full operation. For example, the gap 32 between outer rungs 35 can close upon heating so that the outer rungs 35 emit significantly less electrons than the central rungs 35.

In one embodiment, the design of the electron emitter 22 can be conducted so that the heating profile of the emitter 22 can be tailored to meet any desired temperature and emission profile. Also, each direction across any rung 35, web 37, or gap 32 can be designed so that the temperature profile of the entire planar emitting surface can be tailored to produce the overall desired electron emission profile. Electron emission can be suppressed in desired regions on the emitter 22 to meet the needs of a given application. Hollow beams, square, or rectangular beams as well as specific electron intensity emission distributions can be created to meet a given imaging need. Modulation Transfer Function (MTF) responses can also be matched for a desired application, which may be determined with the beam focusing devices.

In one embodiment, designs for the layout of the electron emitter 22 can be scaled to increase emission area to facilitate higher power imaging applications or to match power levels for specific applications. That is, select rungs 35 can be relatively smaller compared to other rungs 35 to determine which rungs 35 will preferentially emit electrons. In some instances, a large number of rungs 35 can be dimensionally smaller to increase the emission from these rungs 35 and thereby increase the size of the emission stream.

In one embodiment, the design of the electron emitter 22 to maintain the planar emitter surface 34 throughout heating and electron emission can be obtained with the illustrated emitter pattern 30. The planar nature of the emitter 22 produces electron paths substantially perpendicular to the emitting surface. Maintaining relatively small gaps 32 with no windows or apertures in the emitter pattern 30 can reduce edge or perpendicular electron emission.

In one embodiment, the emitter pattern 30 can be as illustrated in order to have a structural design such that the emitter 22 is self-supporting in the emitting region (e.g., central region) thereby eliminating the need for additional support structures. The emitter pattern of FIG. 3B has been established to be self-supporting without significant curling, bending or warping at high temperatures and electron emission.

In one embodiment, the emitter pattern 30 can be designed such that the outer portions of the emitter 22 do not emit electrons (e.g., or not a significant number), thereby decreasing the effect that any focusing structure has on electrical fields at the edge of the emitter. Often the focusing structure (e.g., beam focusing element 11) includes the field shaping component(s) (e.g., magnetics) around the outer perimeter of the emission pathway or throw path. This configuration and reduction of emission from outer rungs 35 improves the behavior of the electron beam, making it more laminar as a whole.

In one aspect, the dimensions of the rungs 35, gaps 32, and webs 37 can be modulated, designed, or optimized so that the electrons are not emitted homogenously (i.e., different areas of the emitter may emit a higher number of electrons than others). The emitter pattern 30 is shaped and dimensioned to have a particular resistivity at one or more select locations, which causes different portions of the emitter 22 to be heated at different temperatures, and thereby have different emission profiles.

In one embodiment, the planar emitter described herein can be utilized in an X-ray tube to emit an electron beam from the cathode to the anode. The configuration of the planar emitter results in an inhomogeneous temperature profile from the first end to the second end and across the entirety of the planar emitter surface when a current is passed through. The inhomogeneous temperature profile is a result of the planar emitter pattern with the rungs, webs, and gap dimensions. Additionally, the description of the planar emitter provided herein describes the ability to tune the emitter to obtain different temperature profiles. The inhomogeneous temperature profile of the planar emitter for a current results in different regions of the emitter having different temperatures, which results in the planar emitter emitting an inhomogeneous electron beam profile. The inhomogeneous electron beam profile is a result of the inhomogeneous temperature profile, where regions of different temperature have different electron emissions. The ability to tailor the temperature profile allows for tailoring the inhomogeneous electron beam profile, such as by selectively dimensioning the different features so that some regions become hotter than others when in operation. Since the emission is thermionic, different regions of different temperatures result in different election emissions, and thereby result in the inhomogeneous electron beam. This principle also allows for one, two, or more focal spots by having a number of regions with a high emission temperature and other regions with a low emission temperature or the other regions may not emit electrons by thermionic emission. In certain regions, there can be no electrons emitted or relatively few electrons emitted compared to other regions. Thus, during operation of a single electron emitter, certain regions can have enhanced electron emission and others can have suppressed electron emission to contribute to the inhomogeneous electron beam profile.

The planar emitter can inhomogeneously emit electrons in an electron beam from the substantially planar surface of the emitter with a reduced lateral energy component.

The emitter pattern can be designed in such a way by varying the dimensions of the different rungs, webs, and gaps so that some regions of the emitter (e.g., outside region or outer rungs in one example) do not emit electrons or emit a significantly fewer amount of electrons compared to other regions. This decreases the effect the focusing elements (see FIG. 2B) have on electrical fields at the edge of the emitter. The focusing elements are field shaping components placed about the outer perimeter of the emitter, but which have reduced focusing effect when the outside rungs of the emitter do not emit electrons or emit substantially fewer electrons compared to other regions, such as the middle region. In any event, tailoring the inhomogeneous temperature profile to tune the inhomogeneous electron emission profile can improve the behavior of the inhomogeneous electron beam to become more laminar as a whole.

In one embodiment, a method of inhomogeneously emitting electrons from an electron emitter can include: providing the electron emitter of claim 1 having a planar emitter surface formed by the plurality of elongate rungs; and emitting an inhomogeneous electron beam from the planar emitter surface in a perpendicular direction.

Figure 4:
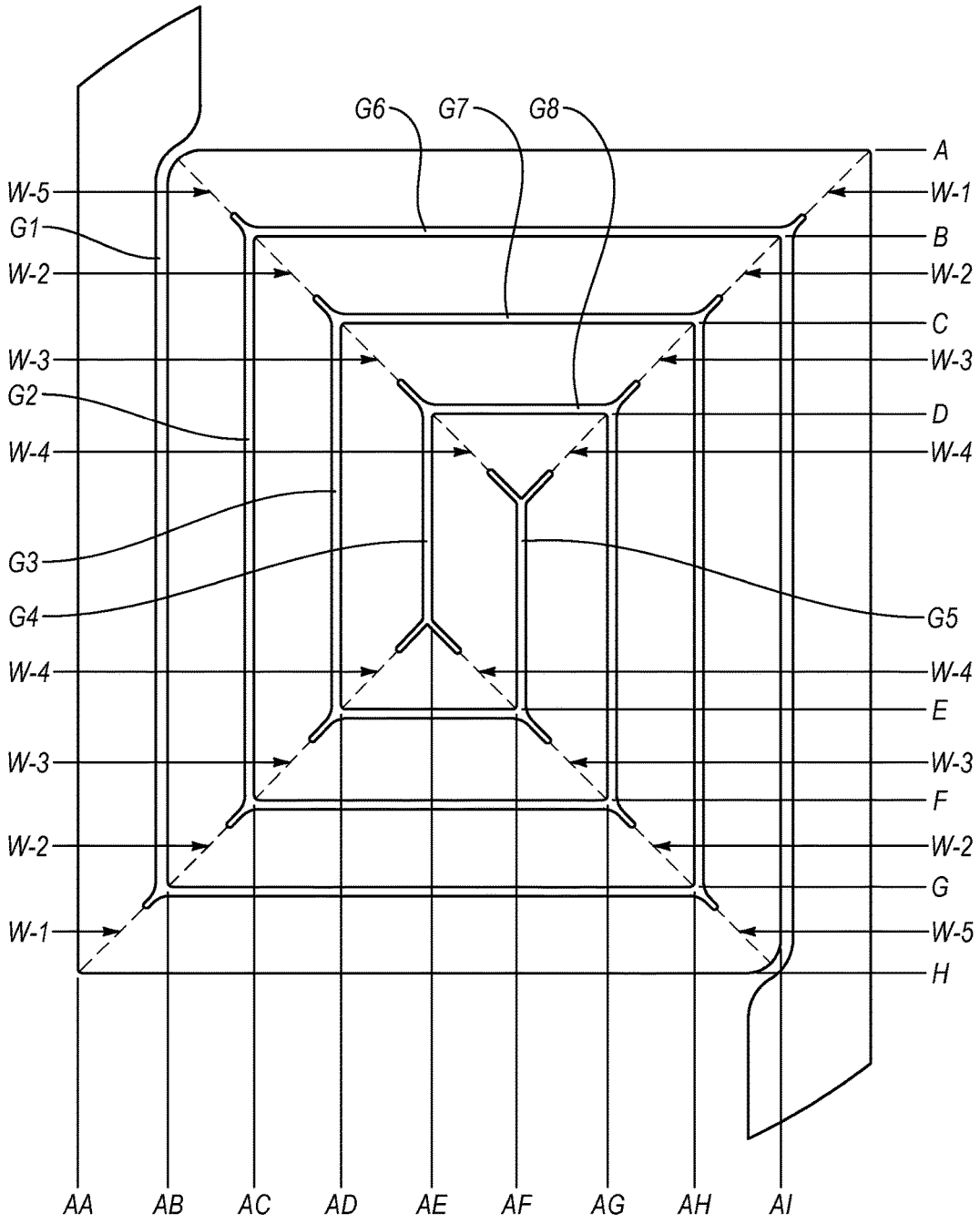
FIG. 4 is a top view of an embodiment of a pattern for a planar electron emitter that identifies certain locations of the pattern for design optimization.

FIG. 4 shows an electron emitter 22 that has the emitter pattern 30 of FIGS. 3A-3B. Select regions of the emitter 22 are selected for dimension optimization. It should be noted that the dimensions of one region relative to one end are duplicated in the corresponding region from the other end, which is shown by the designations W-1, W-2, W-3, W-4, and W-5 being at multiple locations, where the dimensions for different designations is different and the same for some designations.

As shown in the example emitter 22 of FIG. 4, the distances of the features are as follows: from A to B is 0.0224 inches; from A to C is 0.0447 inches; from A to D is 0.0681 inches; from A to E is 0.1445 inches; from A to F is 0.1679 inches; from A to G is 0.1902 inches; and from A to H is 0.2126 inches; from AA to AB is 0.0231 inches; from AA to AC is 0.0455 inches; from AA to AD is 0.0679 inches; from AA to AE is 0.0912 inches; from AA to AF is 0.1132 inches; from AA to AG is 0.1366 inches; from AA to AH is 0.159 inches; and AA to AI is 0.1813 inches. Gap G1 is 0.0031 inches; gap G2 is 0.0024 inches; and Gaps G3, G4, G5, G6, G7, and G8 are all 0.0024 inches. The dimensions of the rungs can be calculated based on the above dimensions. Also, web W-1 is 0.0236 inches and its corresponding slot 38 is 0.0016 inches; web W-2 is 0.0215 inches and its corresponding slot 38 is 0.0016 inches; web W-3 is 0.0205 inches and its corresponding slot 38 is 0.0016 inches; web W-4 is 0.0204 inches and its corresponding slots 38 are each 0.0016 inches; and web W-5 is 0.02 inches with its corresponding slot 38 is 0.0016 inches. Also, the legs 31*a*, 31*b* can be 0.346 inches. From the forgoing dimensions, the emitter pattern 30 can be determined. Also, any of the dimensions described herein, together or alone, can be modulated by 1%, 2%, 5%, or 10% or more.

Figure 5A:
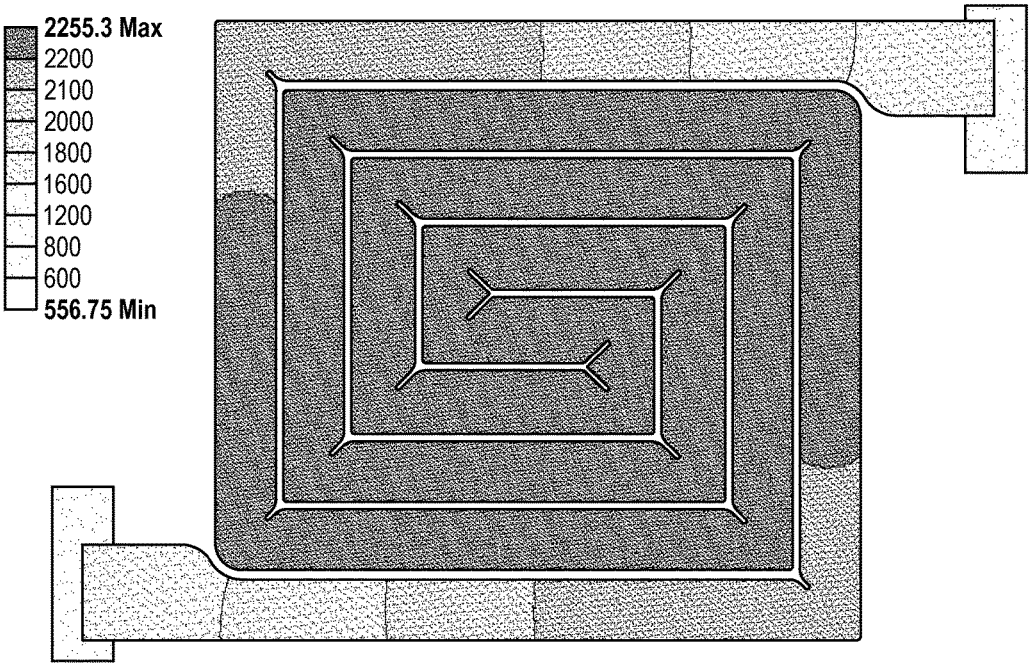
FIGS. 5A-5B are top views of temperature profiles of an embodiment of a planar electron emitter for different maximum temperatures.

FIG. 5A illustrates an emitter temperature profile of the emitter of FIG. 4 for a maximum temperature (Tmax) being 2250 degrees C. with current being 7.75 A, voltage being 8.74 V, and input power being 67.7 W. Specific region temperatures in Celsius from region R1 to region R92 (see FIG. 3B for region designations) are shown in Table 1.

TABLE 1

| Emitter Region # | Max Temp-2250 (with adjusted resistivity) |
|---|---|
| 1 | 1788.6 |
| 2 | 1892.8 |
| 3 | 1970.7 |
| 4 | 2033.8 |
| 5 | 2080.2 |

TABLE 1-continued

| Emitter Region # | Max Temp-2250 (with adjusted resistivity) |
|---|---|
| 6 | 2103.7 |
| 7 | 2123.2 |
| 8 | 2146.8 |
| 9 | 2164 |
| 10 | 2176.4 |
| 11 | 2187.5 |
| 12 | 2197.1 |
| 13 | 2204.7 |
| 14 | 2210.2 |
| 15 | 2214.1 |
| 16 | 2217.1 |
| 17 | 2220.2 |
| 18 | 2224.5 |
| 19 | 2224.1 |
| 20 | 2226.4 |
| 21 | 2228.5 |
| 22 | 2229.9 |
| 23 | 2231.4 |
| 24 | 2234.1 |
| 25 | 2238.1 |
| 26 | 2243.4 |
| 27 | 2239.6 |
| 28 | 2238.1 |
| 29 | 2239.1 |
| 30 | 2241.9 |
| 31 | 2246.6 |
| 32 | 2242.3 |
| 33 | 2240.2 |
| 34 | 2240.4 |
| 35 | 2241.4 |
| 36 | 2244.4 |
| 37 | 2248 |
| 38 | 2238.9 |
| 39 | 2236.5 |
| 40 | 2243.2 |
| 41 | 2236.9 |
| 42 | 2237.7 |
| 43 | 2244.4 |
| 44 | 2254.1 |
| 45 | 2254.8 |
| 46 | 2245.8 |
| 47 | 2245.9 |
| 48 | 2254.9 |
| 49 | 2254.3 |
| 50 | 2244.5 |
| 51 | 2237.8 |
| 52 | 2237 |
| 53 | 2243.3 |
| 54 | 2236.6 |
| 55 | 2239 |
| 56 | 2248.1 |
| 57 | 2244.5 |
| 58 | 2241.5 |
| 59 | 2240.5 |
| 60 | 2240.2 |
| 61 | 2242.4 |
| 62 | 2246.7 |
| 63 | 2242 |
| 64 | 2239.1 |
| 65 | 2238.2 |
| 66 | 2239.7 |
| 67 | 2243.5 |
| 68 | 2238.2 |
| 69 | 2234.1 |
| 70 | 2231.4 |
| 71 | 2229.9 |
| 72 | 2228.5 |
| 73 | 2226.4 |
| 74 | 2224 |
| 75 | 2224.4 |
| 76 | 2220.1 |
| 77 | 2217.1 |
| 78 | 2214 |
| 79 | 2210.2 |
| 80 | 2204.6 |

TABLE 1-continued

| Emitter Region # | Max Temp-2250 (with adjusted resistivity) |
|---|---|
| 81 | 2197 |
| 82 | 2187.5 |
| 83 | 2176.3 |
| 84 | 2164 |
| 85 | 2146.7 |
| 86 | 2123.1 |
| 87 | 2103.6 |
| 88 | 2080.1 |
| 89 | 2033.7 |
| 90 | 1970.5 |
| 91 | 1892.6 |
| 92 | 1788.3 |

Figure 5B:
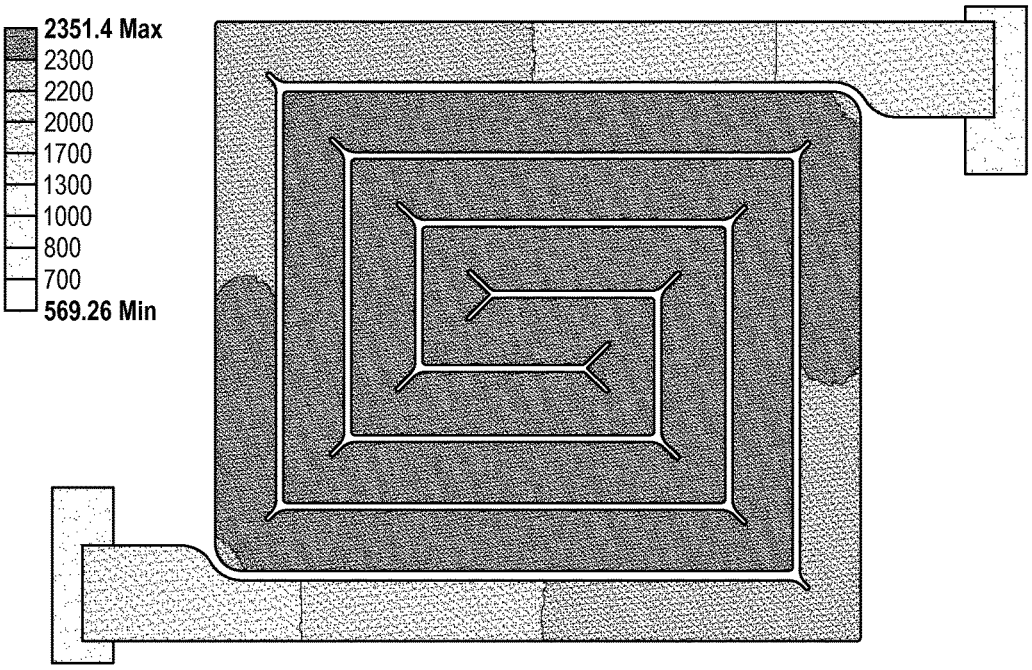

FIG. 5B illustrates an emitter temperature profile of the emitter of FIG. 4 for a maximum temperature (Tmax) being 2350 degrees C. with current being 8.25 A, voltage being 9.7 V, and input power being 80 W. Specific region temperatures in Celsius from region R1 to region R92 (see FIG. 3B for region designations) are shown in Table 2.

TABLE 2

| Emitter Region # | Max Temp-2350 (with adjusted resistivity) |
|---|---|
| 1 | 1871.1 |
| 2 | 1981.7 |
| 3 | 2063.1 |
| 4 | 2128.1 |
| 5 | 2175.1 |
| 6 | 2198.7 |
| 7 | 2218 |
| 8 | 2241.1 |
| 9 | 2257.6 |
| 10 | 2269.4 |
| 11 | 2280.1 |
| 12 | 2289.5 |
| 13 | 2297.1 |
| 14 | 2302.6 |
| 15 | 2306.4 |
| 16 | 2309.4 |
| 17 | 2312.5 |
| 18 | 2317.4 |
| 19 | 2316.4 |
| 20 | 2318.8 |
| 21 | 2321 |
| 22 | 2322.5 |
| 23 | 2324.1 |
| 24 | 2327.1 |
| 25 | 2331.7 |
| 26 | 2337.8 |
| 27 | 2333.3 |
| 28 | 2331.5 |
| 29 | 2332.6 |
| 30 | 2335.9 |
| 31 | 2341.4 |
| 32 | 2336.3 |
| 33 | 2333.8 |
| 34 | 2334.2 |
| 35 | 2335.3 |
| 36 | 2338.9 |
| 37 | 2343.2 |
| 38 | 2332.6 |
| 39 | 2329.9 |
| 40 | 2337.7 |
| 41 | 2330.3 |
| 42 | 2331.1 |
| 43 | 2338.8 |

TABLE 2-continued

| Emitter Region # | Max Temp-2350 (with adjusted resistivity) |
|---|---|
| 44 | 2350.1 |
| 45 | 2350.8 |
| 46 | 2340.3 |
| 47 | 2340.3 |
| 48 | 2350.9 |
| 49 | 2350.3 |
| 50 | 2339 |
| 51 | 2331.2 |
| 52 | 2330.4 |
| 53 | 2337.9 |
| 54 | 2330 |
| 55 | 2332.7 |
| 56 | 2343.3 |
| 57 | 2339 |
| 58 | 2335.4 |
| 59 | 2334.2 |
| 60 | 2333.9 |
| 61 | 2336.4 |
| 62 | 2341.4 |
| 63 | 2335.9 |
| 64 | 2332.6 |
| 65 | 2331.5 |
| 66 | 2333.4 |
| 67 | 2337.9 |
| 68 | 2331.8 |
| 69 | 2327.2 |
| 70 | 2324.2 |
| 71 | 2322.5 |
| 72 | 2321 |
| 73 | 2318.7 |
| 74 | 2316.3 |
| 75 | 2317.3 |
| 76 | 2312.5 |
| 77 | 2309.3 |
| 78 | 2306.3 |
| 79 | 2302.5 |
| 80 | 2297 |
| 81 | 2289.4 |
| 82 | 2280 |
| 83 | 2269.3 |
| 84 | 2257.5 |
| 85 | 2241 |
| 86 | 2217.9 |
| 87 | 2198.6 |
| 88 | 2175 |
| 89 | 2127.9 |
| 90 | 2063 |
| 91 | 1981.5 |
| 92 | 1870.8 |

Figure 6A:
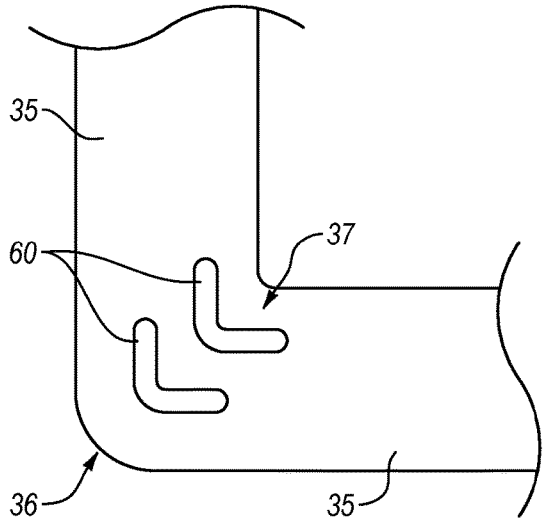
FIGS. 6A-6B are top views of embodiments of cutout portions in a planar electron emitter.

FIG. 6A shows a corner 36 having cutouts 60 at the location of the web 37. The cutouts 60 change the relative dimension of the web 37, which can be tuned in accordance with the rungs 35 adjacent to the corner. The dimension of these cutouts 60 can be used for resistance matching and modulation, where the size of the cutouts 60, or placement thereof, or number thereof (e.g., one, two, or three or more cutouts at a web 37) can be used to tune the resistivity of a rung 35.

Figure 6B:
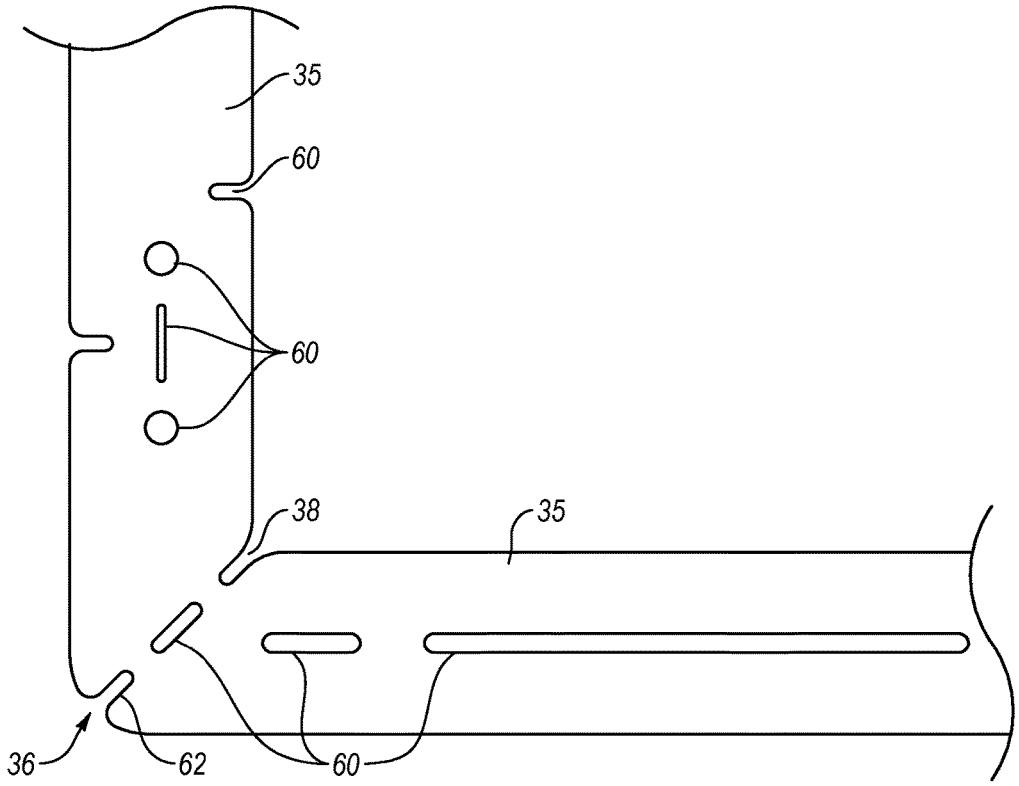

FIG. 6B shows the corner 36 having an apex slot 62 and a cutout 60, and shows the rungs 35 having various cutouts 60 in various shapes and dimensions. The cutouts of the rungs and at corners can vary. The cutouts can be uniform in dimension; however, they may also be non-uniform. The cutouts at a gap can also have non-uniform openings to the gap. A rung can also include a long, tapering cut running the length of the rung. Thus, the cutouts illustrated can be of any dimension relative to the rungs.

In one embodiment, an electron emitter can include: a plurality of elongate rungs connected together end to end from a first emitter end to a second emitter end in a plane so as to form a planar pattern, each elongate rung having a rung width dimension; a plurality of corners, wherein each elongate rung is connected to another elongate rung through a corner of the plurality of corners, each corner having a corner apex and an opposite corner nadir between the connected elongate rungs of the plurality of elongate rungs; a first gap between adjacent non-connected elongate rungs of the plurality of elongate rungs, wherein the first gap extends from the first emitter end to a middle rung; a second gap between adjacent non-connected elongate rungs of the plurality of elongate rungs, wherein the second gap extends from the second emitter end to the middle rung, wherein the first gap does not intersect the second gap; and one or more cutouts at one or more of the corners of the plurality of corners between the corner apex and corner nadir or at the corner nadir.

In one embodiment, one or more body portions of each corner between the corner apex and corner nadir, excluding the one or more cutouts, together define a web dimension between the corner apex and corner nadir, wherein the web dimension is within 10% of the rung width dimensions of the connected elongate rungs at the corner.

In one embodiment, from the first end to middle rung, the first gap has a plurality of first gap segments each having a gap segment width, each gap segment width having a dimension that maintains the first gap when the emitter is at a non-emitting temperature and at an electron emitting temperature, and wherein from the second end to middle rung, the second gap has a plurality of second gap segments each having a gap segment width, each gap segment width having a dimension that maintains the second gap when the emitter is at the non-emitting temperature and at the electron emitting temperature.

In one embodiment, the first gap is either clockwise or counter clockwise from the first rung to the middle rung, and the second gap is the other of clockwise or counter clockwise from the middle rung to the second end so as to be the opposite orientation of the first gap.

In one embodiment, a first portion of the plurality of elongate rungs has a first rung width dimension and a second portion of the plurality of elongate rungs has at least a different second rung dimension.

In one embodiment, two or more of the first gap segments have different gap segment width dimensions, and two or more of the second gap segments have different gap segment width dimensions.

In one embodiment, first and second rungs from the first emitter end have a first rung width dimension, and other rungs from the second rung to the middle rung have at least one rung width dimension different from the first rung width dimension. Also, ultimate and penultimate rungs from the second emitter end have the first rung width dimension, and other rungs from the penultimate rung to the middle rung have at least one rung width dimension different from the first rung width dimension.

In one embodiment, each elongate rung of the plurality of elongate rungs has a flat surface that together the flat surfaces form a planar emitting surface in the form of the planar pattern.

In one embodiment, a first elongate leg can be coupled to a first elongate rung at the first end, and a second elongate leg can be coupled to an ultimate elongate rung at the second end. Also, the first elongate leg and second elongate leg can be at an angle relative to the planar emitting surface.

In one embodiment, the present technology can include a design protocol to design a planar emitter pattern, which design includes particular dimensions for the emitter pattern. The design can include the particular emitter pattern 30 shown in FIG. 3B. The design protocol can include determining a desired temperature profile or desired emission profile, and determining dimensions for particular rungs, webs, and/or gaps to achieve the desired profile. These determinations can be performed by a user inputting data input into a computing system and simulating a temperature profile on the computer based on the input. The designing of the dimensions can be performed on a computer, such as a CAD program, based on data input by a user into the computer. The design can then be simulated on a computer to determine whether or not the simulation produces the desired temperature profile. The simulation can be conducted based on instructions input into the computer by the user. The simulated temperature profile obtained by the computer can be indicative of the electron emission profile, which allows for computer CAD design and temperature simulation. Once a desired temperature profile can be designed and simulated on the computer by the user, a real electron emitter can be manufactured and tested for the real temperature profile and/or electron emission profile. Once tested, the data for the real emitter can then be input by the user into the computer and used to modulate dimensions of the rungs, webs, and/or gaps in another computer CAD model, and then the new emitter design can be simulated on the computer, and then manufactured and tested. The CAD design operated by the user based on user input into the computer can include: determining a rung dimension for each rung; determining a web dimension for each web; and determining a gap dimension for each gap. Here, one or more of these different features can have the same dimension, and one or more of the same features can have different dimensions. That is, some rungs can have the same dimension and some can have different dimensions, some gaps can have the same dimension and some can have different dimensions, and some webs can have the same dimension and some can have different dimensions.

An example of a design method can include the following steps of a design protocol to design a planar emitter. Any of these steps can be implemented by a user inputting data input into the computer and inputting instructions into the computer to cause the computer to perform computational calculations and simulations. In a first step, a particular application for an X-ray is determined. The particular application that is determined can result in a particular X-ray emission pattern or focal spot shape or number of focal spots to be identified. As such, the desired emission profile is determined based on the particular application. In a second step, an initial pattern shape for the emitter pattern can be determined. Here, the pattern shape can be the emitter pattern that is illustrated herein, which includes a number of rungs connected together at 90 degree corners to start from a first end and end at a second end, where each corner can have a web. In a third step, the desired emission profile can be matched or overlaid on the emitter pattern so that the rungs to be configured for electron emission match the emission profile and so that the rungs to be configured to have a reduced emission or no emission can match the areas of no emission in the emission profile. In the fourth step, the rungs to emit electrons for the emission profile can be identified, and rungs to not emit substantial electrons can be identified. This results in a general primer for the dimensions of the emitter pattern. In a fifth step, the length and width dimensions of each of the rungs can be determined to match the emitter pattern to the emission profile. In a sixth step, the gap dimensions can be determined for each gap between rungs, which dimensions can be determined in view of the thermal expansion coefficient so that the gaps exist while cool and while fully heated and emitting electrons. In a seventh step, the emitter pattern having the rung and gap dimensions can be overlaid or otherwise compared with the desired emission profile, and any adjustments can be made so that the emitter pattern is capable of emitting the emission profile. In an eighth step, the web dimensions can be determined to correspond with the rung widths in order to obtain a rung temperature potential. The web dimensions are often adjusted to be about the dimension of the rung width, such as within 1%, 2%, or up to 5% or up to 10%. Based on the outcome from these steps, the planar emitter profile can be designed with the appropriate dimensions on a computer-assisted design program on a computer. The planar emitter pattern with dimensions can be saved as data in a database on a data storage medium of the computer. However, any of these steps may be optional.

Once designed, the planar emitter pattern with dimensions can be processed through a simulation protocol on a computer. Such processing can be implemented by a user inputting parameters and input into the computer. The simulation protocol can be part of the design method. The simulation can simulate the temperature for each of the rungs based on the planar emitter pattern with one or more electrical current profiles, which can be input into the computer. That is, the electrical current that is passed through the planar emitter can be simulated with various parameters that can be varied. Accordingly, the planar emitter pattern can be simulated with one or more electrical current profiles to determine the temperature profile for the entire emitter, each rung, and regions (e.g., see FIG. 3B and Tables 1 and 2). The temperature profile for the entire emitter, each rung, and/or regions can be saved as data in a database on the computer.

Once one or more temperature profiles for the emitter are determined from the simulation, an iteration protocol can be performed on the computer based on input from the user so that any of the dimensions of any of the webs, rung widths, and/or gap dimensions can be modulated in a manner so that the iterative emitter pattern is likely to provide a temperature profile that matches the desired temperature profile. The iteration protocol can include the design protocol and simulation protocol, which iteration protocol can be repeated by the user with the computer until the emitter pattern provides a suitable temperature profile.

Once the emitter pattern is simulated to provide a suitable temperature profile, a physical planar electron emitter can be fabricated to include the emitter pattern and appropriate dimensions for the webs, rung widths, and/or gaps. The fabrication can be part of a method of manufacture. Generally, a piece of flat material having an appropriate thickness (e.g., height) can be laser-cut into the emitter pattern having the appropriate dimensions for the webs, rung widths, and gaps.

Once the physical emitter has been manufactured, it can be tested with one or more electrical currents in order to determine the temperature profile for each of the temperatures. The real temperature profile that is measured can identify the temperature for the entire emitter, each rung, and/or regions. The real temperature profile for the entire emitter, each rung, and/or regions for one or more current profiles can be input into the computer based on instructions obtained by the user and saved as data in a database on the computer. This temperature data can be linked with the emitter pattern and dimension data so that the emitter pattern and dimensions can be recalled when the corresponding temperature profile is desired. That is, a user can input instructions into the computer in order to obtain the emitter pattern and dimension data from the database. Thus, the database can include a plurality of emitter pattern and dimension designs linked to the temperature profiles for one or more current profiles. This allows a temperature profile to be selected by the user based on input from the user into the computer, and then the emitter pattern and dimensions for that temperature profile to be obtained from the database and provided to the user.

The database can serve as a repository of temperature profiles and corresponding emitter patterns and dimensions. This allows for the design of a certain emitter pattern for a temperature profile to start with an emitter pattern design with a known temperature profile, and then the parameters can be varied in a manner to iterate toward the desired temperature profile. If a desired temperature profile has already been determined, then the corresponding emitter pattern and dimensions can be selected from the database by the user.

In one embodiment, a method of manufacturing a planar electron emitter can include: obtaining a designed pattern, which can be computer designed and simulated; obtaining a sheet of material; and laser cutting the emitter pattern into the sheet. The legs can then be bent from the planar emitter pattern. In one example, once the shape of the pattern has been made, it can be recrystallized and set.

In one embodiment, a method of designing an electron emitter can include: determining a desired cross-sectional profile of an electron emission from an electron emitter, where the parameters of the electron emitter can be input into a computer; determining a desired temperature profile for the electron emitter that emits the desired cross-sectional profile; and determining desired emitter dimensions for a defined electrical current through the electron emitter that produces the desired temperature profile, which can be determined through simulations run on the computer under instructions input by the user. The emitter dimensions can include: each rung width dimension; each first gap segment dimension; each second gap segment dimension; and each web dimension. The electron emitter can include: a plurality of elongate rungs connected together end to end at corners, each corner having a corner apex and an opposite corner nadir, each elongate rung having a rung width dimension; a first gap between adjacent non-connected elongate rungs from the first emitter end to a middle rung, the first gap including a plurality of first gap segments each having a first gap segment width; a second gap between adjacent non-connected elongate rungs from the second emitter end to the middle rung, the second gap including a plurality of second gap segments each having a second gap segment width; and one or more body portions of each corner between the corner apex and corner nadir together define a web dimension for each corner.

In one embodiment, the method can include: inputting an emitter pattern of the electron emitter into a computer by the user, the emitter pattern including the emitter dimensions; simulating the temperature profile of the emitter pattern on the computer for the defined current based on input from the user; and determining whether the emitter pattern has the desired temperature profile for the defined electrical current.

In one embodiment, the method can include: (a) changing one or more of the emitter dimensions in the computer by the user to obtain an iterative emitter pattern having iterative emitter dimensions; and (b) simulating the temperature profile of the iterative emitter pattern on the computer for the defined current based on input from the user; and (c) determining whether the iterative emitter pattern has the desired temperature profile for the defined electrical current, if not, then repeating (a) through (c).

In one embodiment, the method can include: setting the web rung dimensions to correspond with an emitter pattern; and varying the web dimensions to obtain the desired temperature profile. These actions can be performed with the computer based on input into the computer by the user.

In one embodiment, the method can include: setting the web rung dimensions to correspond with an emitter pattern; varying the web dimensions to obtain a first temperature profile that is different from the desired temperature profile; and varying the rung width dimensions after varying the web dimensions to obtain the desired temperature profile. These actions can be performed with the computer based on input into the computer by the user.

In one embodiment, the method can include: setting emitter dimensions for each rung width dimension, each first gap segment dimension, and each second gap segment dimension; and varying each web dimension to obtain the desired temperature profile. These actions can be performed with the computer based on input into the computer by the user.

In one embodiment, the method can include: obtaining a simulated temperature profile that corresponds to the desired temperature profile; manufacturing a physical electron emitter having the emitter pattern that produced the simulated temperature profile; testing the physical electron emitter with a defined electrical current; and measuring the temperature profile of the physical electron emitter.

In one embodiment, when the temperature profile of the physical electron emitter matches the desired temperature profile, the physical electron emitter is implemented in an X-ray tube. Alternatively, when the temperature profile of the physical electron emitter does not match the desired temperature profile, the method further comprises: (a) changing one or more of the emitter dimensions to obtain an iterative emitter pattern having iterative emitter dimensions; and (b) simulating the temperature profile of the iterative emitter pattern on the computer for the defined current; and (c) determining whether the iterative emitter pattern has the desired temperature profile for the defined electrical current, if not, then repeating (a) through (c). The changes and simulation can be based on input into the computer by the user.

In one embodiment, the method can include: obtaining a plurality of temperature points of the desired temperature profile, and entering the data thereof into the computer system by the user; simulating the temperature profile of the emitter pattern on the computer for the defined current to obtain a plurality of simulated temperature points of the simulated temperature profile, which can be performed based on input into the computer by the user; comparing the plurality of temperature points with the plurality of simulated temperature points; and selecting the emitter pattern when the plurality of temperature points substantially match the plurality of simulated temperature points.

In one embodiment, a method of manufacturing an electron emitter can include: obtaining a sheet of electron emitter material; obtaining an electron emitter pattern; and laser cutting the electron emitter pattern into the electron emitter material. The electron emitter pattern can include: a plurality of elongate rungs connected together end to end from a first emitter end to a second emitter end in a plane so as to form a planar pattern, each elongate rung having a rung width dimension; a plurality of corners, wherein each elongate rung is connected to another elongate rung through a corner of the plurality of corners, each corner having a corner apex and an opposite corner nadir between the connected elongate rungs of the plurality of elongate rungs; a first gap between adjacent non-connected elongate rungs of the plurality of elongate rungs, wherein the first gap extends from the first emitter end to a middle rung; a second gap between adjacent non-connected elongate rungs of the plurality of elongate rungs, wherein the second gap extends from the second emitter end to the middle rung, wherein the first gap does not intersect the second gap; and one or more cutouts at one or more of the corners of the plurality of corners between the corner apex and corner nadir or at the corner nadir. In one aspect, the method can further include determining that the electron emitter pattern produces a desired temperature profile for a defined electrical current.

One skilled in the art will appreciate that, for this and other processes and methods disclosed herein, the functions performed in the processes and methods may be implemented in differing order. Furthermore, the outlined steps and operations are only provided as examples, and some of the steps and operations may be optional, combined into fewer steps and operations, or expanded into additional steps and operations without detracting from the essence of the disclosed embodiments.

III. Example Embodiments of a Magnetic System Providing Electron Beam Focusing and Two-Axis Beam Steering Via Two Quadrupoles As noted above, certain embodiments include an electron beam manipulation component that allows for steering and/or focusing of the electron beam so as to control the position and/or size and shape of the focal spot on the anode target. In one embodiment, this manipulation is provided by way of a magnetic system implemented as two magnetic quadrupoles disposed in the electron beam path. For example, in one embodiment, two quadrupoles are used to provide both steering and focusing of the electron beam. In this approach, focusing magnetic fields can be provided by both quadrupoles (e.g., the anode side quadrupole and the cathode side quadrupole with constant current in the coils) and the electron beam steering magnetic fields can be provided by one of the quadrupoles (e.g., the anode side quadrupole or cathode side quadrupole) that is operated with AC offset for one coil, one pair, three coils, or two pairs of opposing coils. Alternatively, magnetic fields for steering can be done for one direction with one quadrupole having d a single coil or an opposing pair of coils with AC offset and for the other direction with the other quadrupole having a single coil or an opposing pair of coils with AC offset, where the two pairs with AC offset are orthogonal or perpendicular. The steering can be performed by providing the offset to one coil, a pair of coils, three coils, or all four coils. When a single coil has the offset, then the movement of the beam can be diagonal. In this way, combined beam focusing and steering can be provided using only quadrupoles. This particular approach can use two quadrupoles that are each configured for focusing and one of the quadrupoles is configured for steering.

The magnetic system 180 of FIG. 1D can include a focusing quadrupole core 184 and steering quadrupole core 182 (e.g., configured to have at least one coil or pair of opposing coils having AC offset) so as to impose magnetic forces on the electron beam 112 so as to focus and/or steer the beam. The combination of the two quadrupole cores 182, 184 are configured to (a) focus in both directions perpendicular to the beam path, and (b) to steer the beam in both directions perpendicular to the beam path. In this way, the two quadrupole cores 182, 184 act together to form a magnetic lens (sometimes referred to as a "doublet"), and the focusing and steering is accomplished as the electron beam passes through the quadrupole "lens." The "focusing" provides a desired focal spot shape and size, and the "steering" affects the positioning of the focal spot on the anode target surface 128.

Figure 7A:
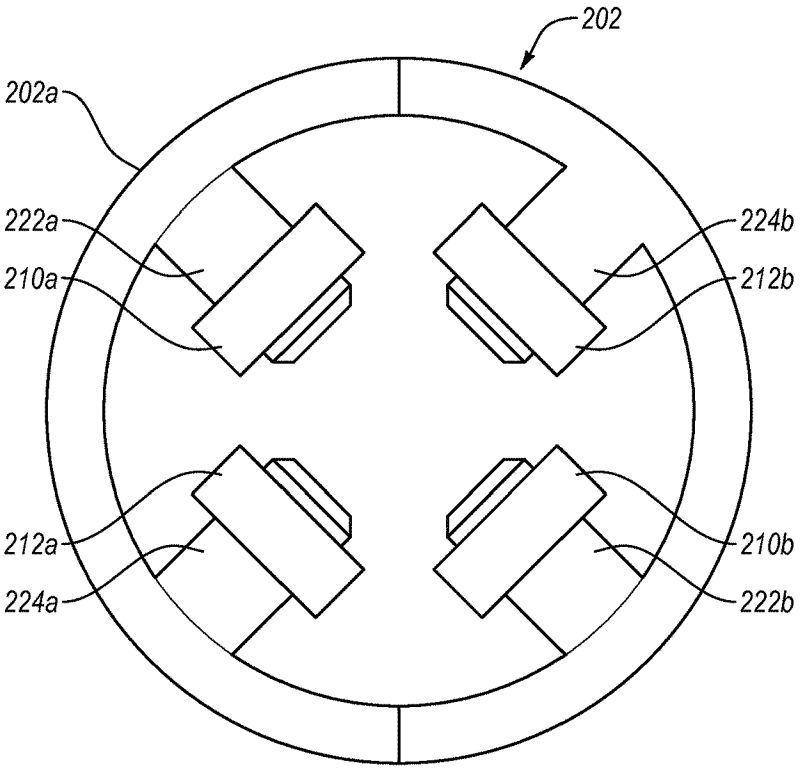
FIG. 7A shows an embodiment of an anode quadrupole core.
Figure 7B:
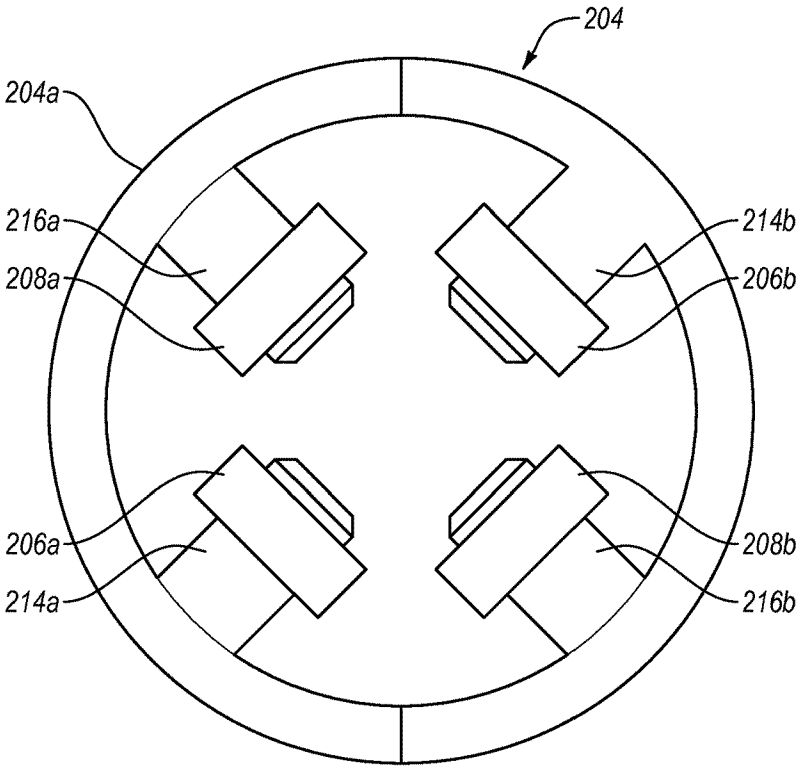
FIG. 7B shows an embodiment of a cathode quadrupole core.

FIGS. 7A-7B show an example of a combination of an anode quadrupole core 202 (e.g., also 182) and a cathode quadrupole core 204 (e.g., also 184). Each quadrupole is implemented with a core section, or a yoke, denoted as a cathode quadrupole yoke at 204*a* for the cathode core 204, and an anode quadrupole yoke at 202*a* for the anode core 202.

FIG. 7A shows an embodiment of an anode quadrupole core 202 (e.g., closer to anode) having an anode quadrupole yoke 202*a*, and FIG. 7B shows an embodiment of a cathode quadrupole core 204 (e.g., closer to cathode) having a cathode quadrupole yoke 204*a*. Each quadrupole yoke 202*a*, 204*a* includes four pole projections arranged in an opposing relationship, cathode pole projections 214*a,b* (e.g., first cathode pole projections) and 216*a,b* (e.g., second cathode pole projections) on the cathode yoke 204*a*, and anode pole projections 222*a,b* (e.g., first anode pole projections) and 224*a,b* (e.g., second anode pole projections) on the anode yoke 202*a*. Each quadrupole pole projection includes corresponding quadrupole electromagnetic coils, denoted as cathode quadrupole coils 206*a,b* (e.g., first cathode quadrupole coils) and 208*a,b* (e.g., second cathode quadrupole coils) on the cathode yoke 204*a* and anode quadrupole coils 210*a,b* (e.g., first anode quadrupole coils) and 212*a,b* (e.g., second anode quadrupole coils) on the anode yoke 202*a*. Current is supplied to the quadrupole coils so as to provide the desired magnetic focusing (e.g., constant current) and/or steering (AC offset) effect, as will be described in further detail below.

Figure 8A:
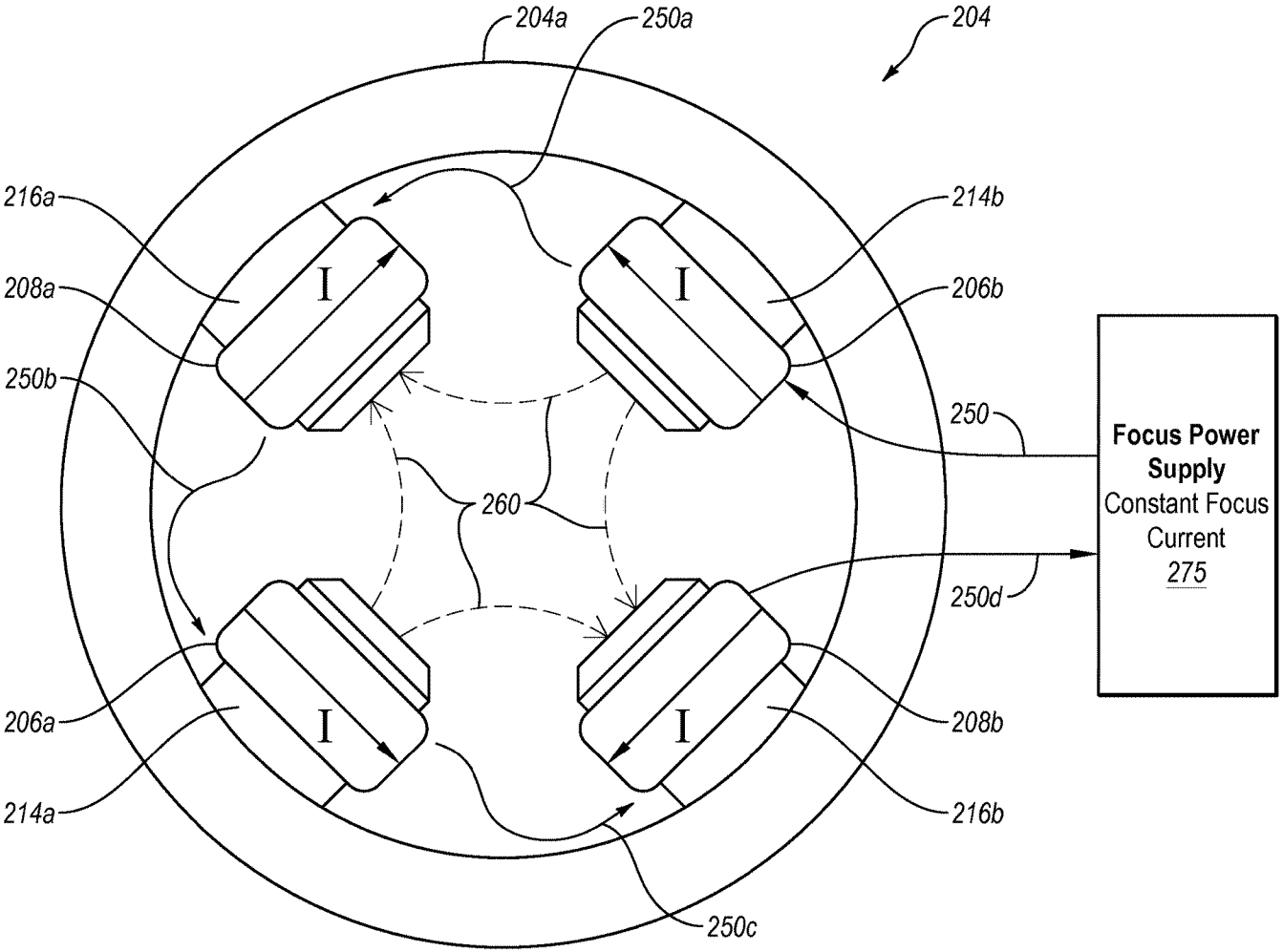
FIGS. 8A-8B are top views of components of one embodiment of a quadrupole magnetic system.
Figure 8B:
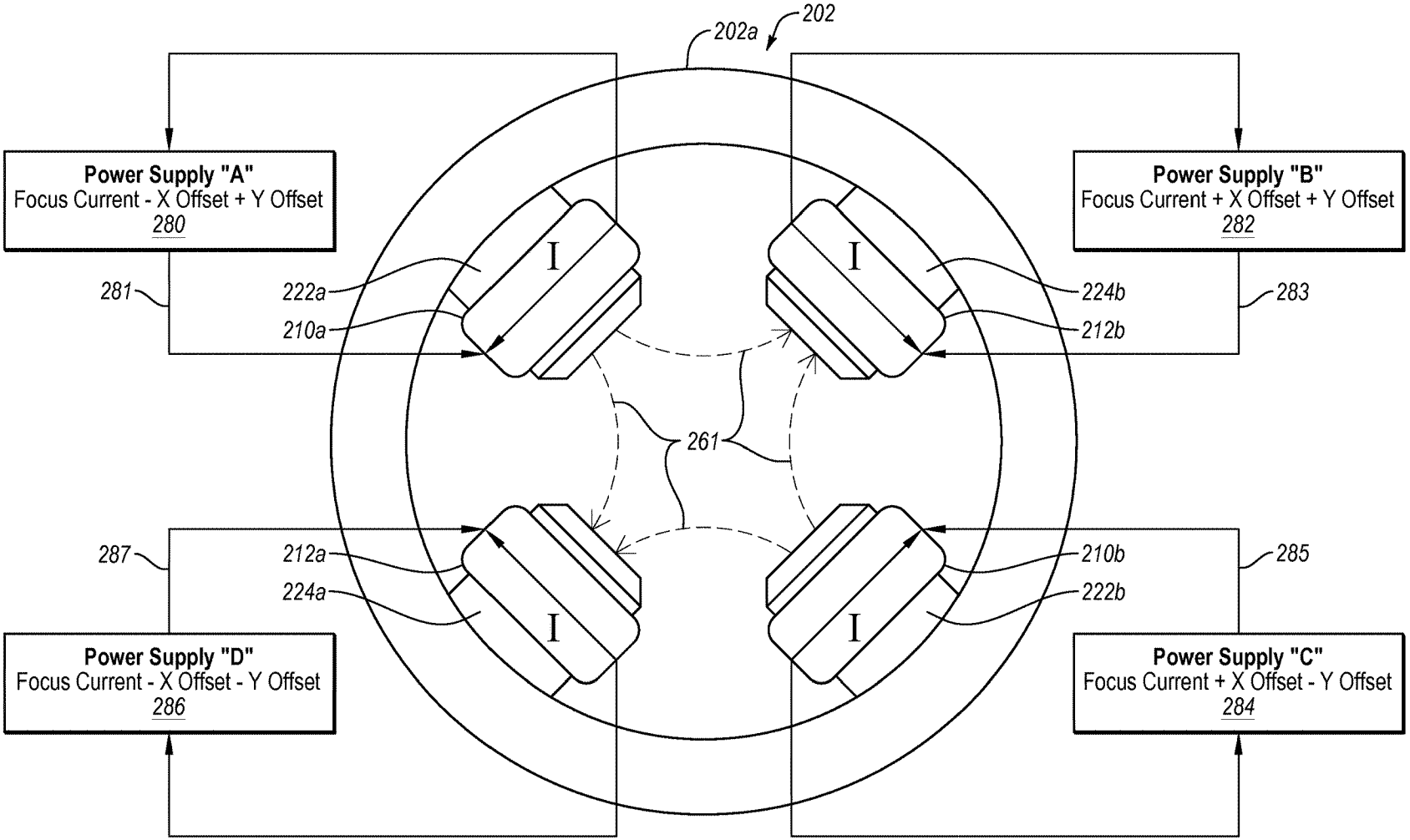

In this context, in conjunction with the embodiments shown in FIGS. 1A-1D and 7A-7B, reference is further made to FIGS. 8A and 8B. FIG. 8A shows an embodiment of a cathode core 204 having a cathode yoke 204*a* and is configured as a quadrupole (e.g., cathode-side magnetic quadrupole 204), and FIG. 8B illustrates an embodiment of an anode core 202 having an anode yoke 202*a*, also configured as a quadrupole (e.g., anode-side magnetic quadrupole 202). As previously described in connection to FIGS. 7A-7B, in this example each core section includes a yoke having four pole projections arranged in an evenly distributed and opposing relationship, pole projections 214*a,b* and 216*a,b* on the cathode yoke 204*a*, and pole projections 222*a,b* and 224*a,b* on the anode yoke 202*a*. Each pole projection includes corresponding quadrupole coils, denoted at 206*a,b* and 208*a,b* on the cathode core 204 and 212*a,b* and 210*a,b* on the anode core 202. While illustrated as having a substantially circular shape, it will be appreciated that each of the core (or yoke) portions 202*a*, 204*a* can also be configured with different shapes, such as a square orientation, semi-circular, oval, or other.

The two magnetic quadrupole cores 202, 204 act as lenses, and may be arranged so that the corresponding electromagnets thereof are in parallel with respect to each other, and perpendicular to the optical axis defined by the electron beam 112. The quadrupole cores together deflect the accelerated electrons such that the electron beam 112 is focused in a manner that provides a focal spot with a desired shape and size. Each quadrupole lens creates a magnetic field having a gradient, where the magnetic field intensity differs within the magnetic field. The gradient is such that the magnetic quadrupole field focuses the electron beam in a first direction and defocuses in a second direction that is perpendicular to the first direction. The two quadrupoles can be arranged such that their respective magnetic field gradients are rotated about 90° with respect to each other. As the electron beam traverses the quadrupoles, it is focused to an elongated spot having a length to width ratio of a desired proportion. As such, the magnetic fields of the two quadrupole lenses can have symmetry with respect to the optical axis or with respect to a plane through the optical axis.

With continued reference to the figures, the double magnetic quadrupole includes an anode quadrupole core, generally designated at 202 and a cathode quadrupole core, generally designated at 204, that are together positioned approximately between the cathode and the target anode and disposed around the neck portion 124*a* as previously described. The anode quadrupole core 202 in one option can be further configured to provide AC offset to one coil, a pair of coils, three coils, or two pairs of opposing coils that enables a shifting of the focal spot in a plane perpendicular to an optical axis correspondent to electron beam 112 of the X-ray tube 100 In an example embodiment, the cathode quadrupole core 204 focuses in a length direction, and defocuses in width direction of the focal spot. The electron beam is then focused in width direction and defocused in length direction by the following anode quadrupole core 202. In combination the two sequentially arranged magnetic quadrupoles ensure a net focusing effect in both directions of the focal spot. However, the focusing and defocusing axes of the two different cores can be switched between the anode quadrupole core 202 and cathode quadrupole core 204.

With continued reference to FIG. 8A, a top view of a cathode quadrupole core 204 is shown. A circular core or yoke portion, denoted at 204*a* is provided, which includes four pole projections 214*a*, 214*b*, 216*a*, 216*b* that are directed toward the center of the circular yoke 204*a*. In an example implementation, the yoke 204*a* and the pole projections 214*a*, 214*b*, 216*a*, 216*b* are constructed of core iron. Moreover, each coil can be comprised of 22 gauge magnet wire at 60 turns; obviously other configurations can be suitable depending on the needs of a particular application.

Figure 11A:
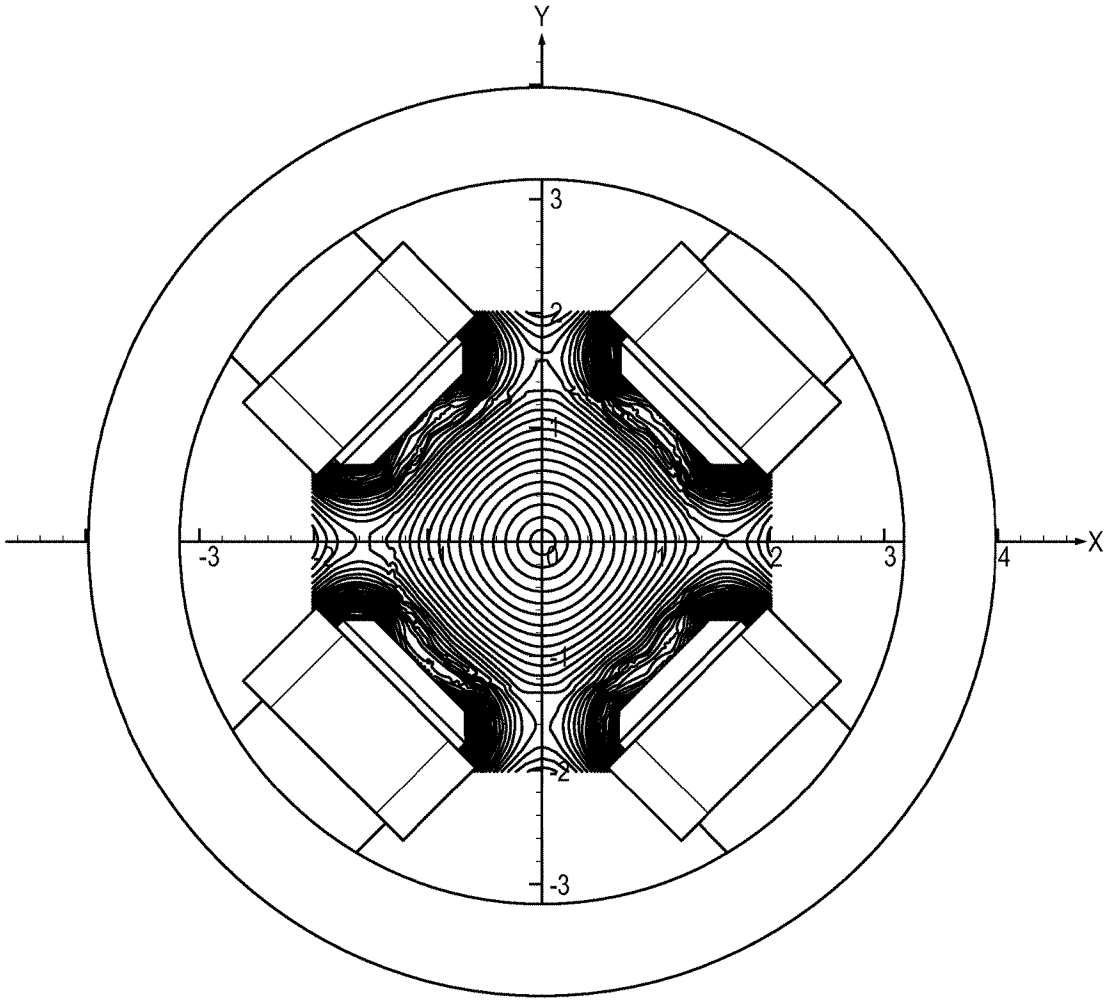
FIGS. 11A-11C are each a schematic diagram showing an example of magnetic fields resulting from quadrupole fields, with FIG. 11A showing a focused quadrupole field that is not shifted.

As is further shown in FIG. 8A, the illustrated example includes a Focus Power Supply 275 for providing a predetermined constant current to the four coils, which are connected in electrical series, as denoted schematically at 250, 250*a*, 250*b* 250*c*, and 250*d*. In this embodiment, the current supplied is configured so that the coil has substantially constant current, and results in a current flow within each coil as denoted by the letter T and corresponding arrow, in turn resulting in a magnetic field schematically denoted at 260. The magnitude of the current is selected so as to provide a desired magnetic field that results in a desired focusing effect. See FIG. 11A, which shows focusing of the focal spot.

Reference is next made to FIG. 8B, which illustrates an example of a top view of an anode quadrupole core 202 having a circular core or yoke 202*a*, which includes four pole projections 222*a*, 222*b*, 224*a*, 224*b* also directed toward the center of the circular yoke 202*a*. The anode quadrupole core 202 and four pole projections 222*a*, 222*b*, 224*a*, 224*b* can be comprised of a low loss ferrite material so as to better respond to steering frequencies (described herein). The coils can utilize similar gauge magnet wire and similar turn ratio, with variations depending on the needs of a given application. In one option, if steering frequency is sufficiently low, then iron can be used in the steering core instead of ferrite.

As is further shown in the example embodiment of FIG. 8B, and in contrast with the cathode quadrupole core 204, each of the coils of the anode quadrupole core 202 includes a separate and independent power source for providing current to induce a magnetic field in a respective coil, each power supply being denoted at 280 (Power Supply A), 282 (Power Supply B), 284 (Power Supply C) and 286 (Power Supply D). For purposes of providing a quadrupole magnetic field, a constant current (e.g., DC) 'Focus Current' is provided in each of the coils, as denoted by the schematic electrical circuit associated with each supply (e.g., 281, 283, 285, 287). Accordingly, any current can be provided that results in substantially constant current in the coils. Moreover, as denoted by current flow directional arrows at T and corresponding arrow, in turn resulting in a magnetic field schematically denoted at 261. The focus current in the anode quadrupole core 202 is opposite to the cathode quadrupole core 204 focus current so as to provide for complimentary magnetic fields, and thereby the focusing effect.

Figure 11B:
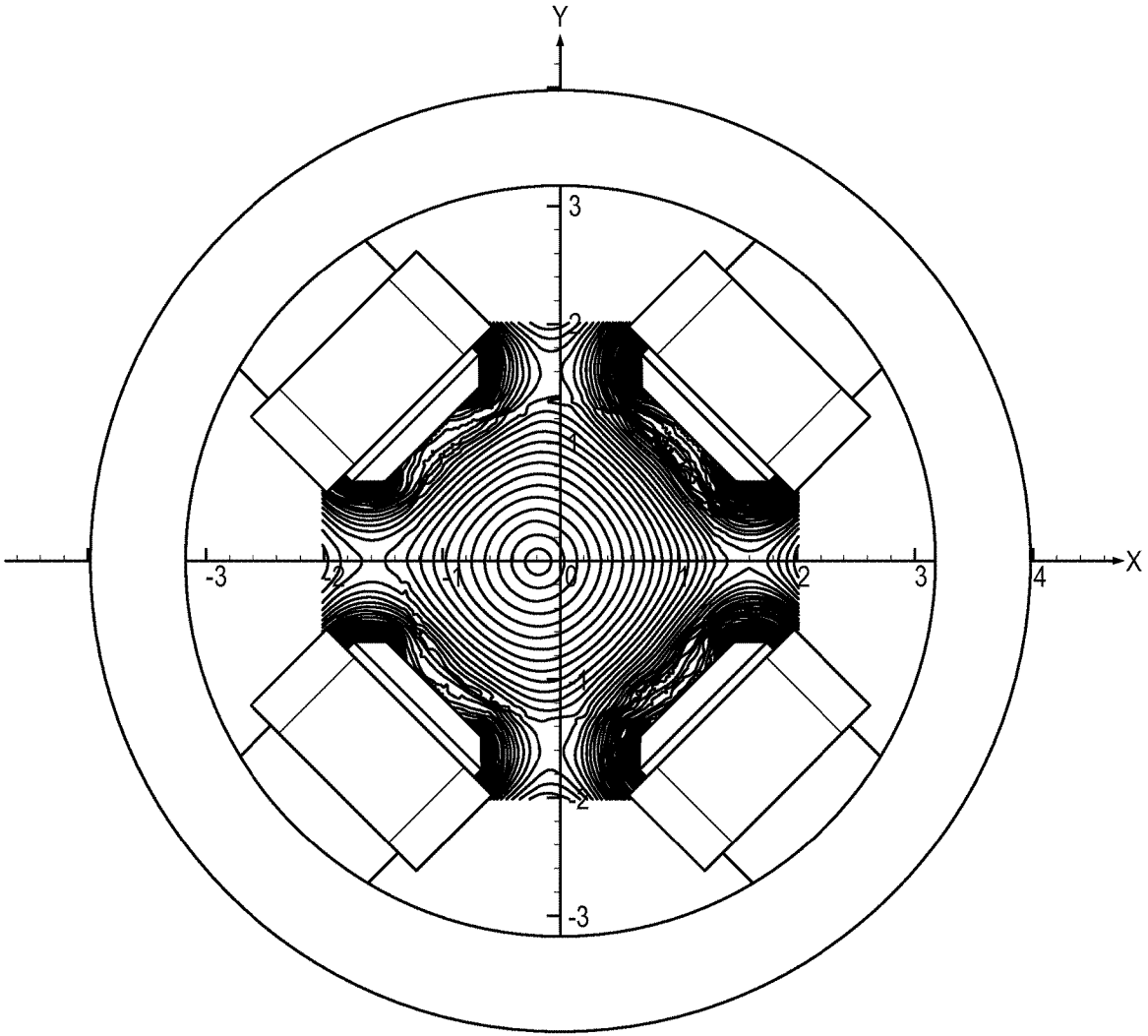
Figure 11C:
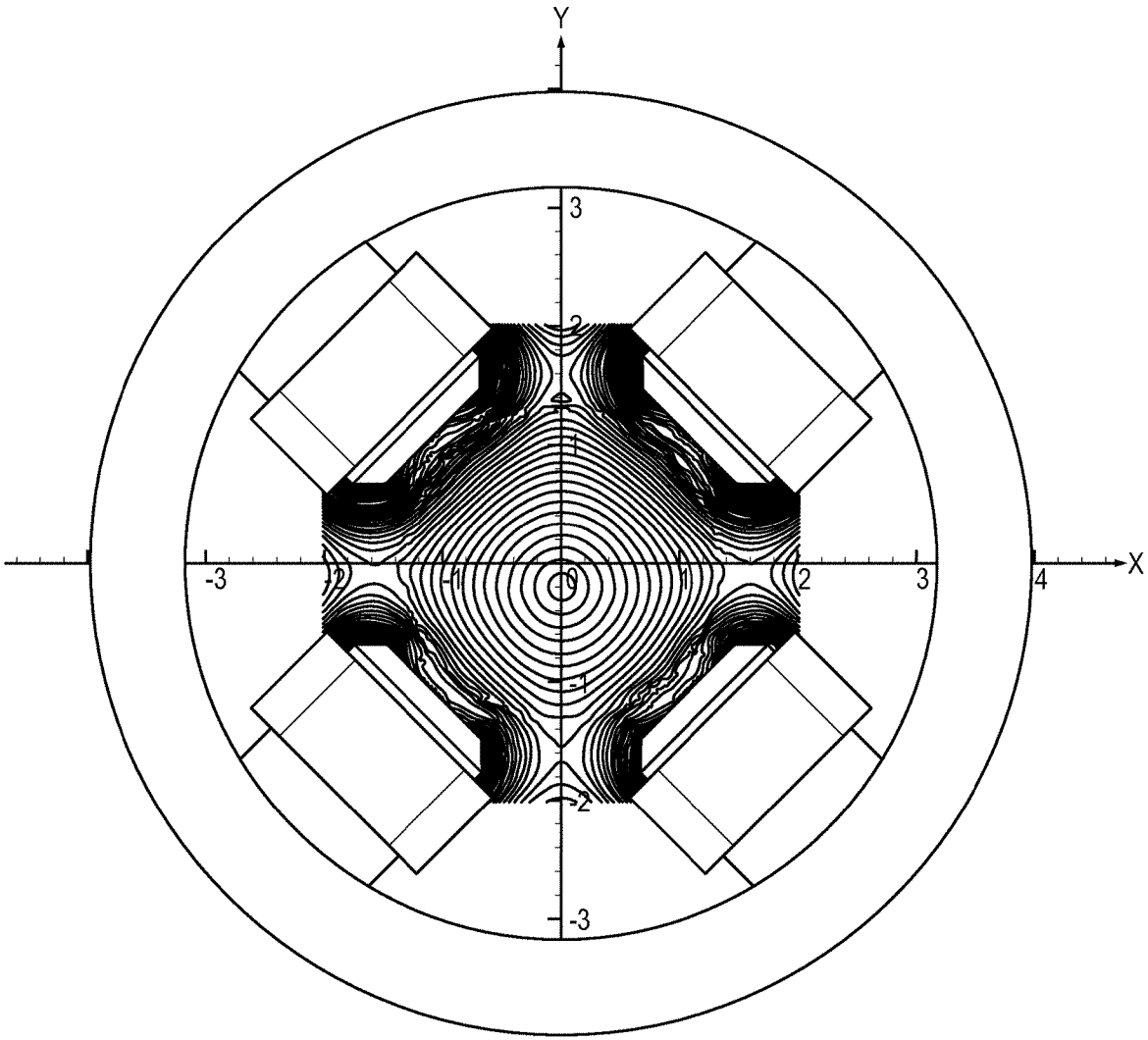

As previously discussed, the anode quadruple core 202 is further configured to receive AC offset in addition to the constant current in each of the coils. To do so, each of the coils is provided with—in addition to the constant focus current described above—an X AC offset current and a Y AC offset current. However, the AC offset can be zero for one or more coils so long as at least one coil has an AC offset that imparts steering. The duration of the AC offset currents are at a predetermined frequency and the respective offset current magnitudes are designed to achieve an offset or shifting of the center of the quadrupole field from the central axis, in turn, a resultant shift in the electron beam (and focal spot) from a central axis of the cores. Thus, each coil is driven independently, with a constant focus current, and perturbations are created in the magnetic field at the desired focal spot steering frequency by application of desired X offset and Y offset AC currents in corresponding coils or coil pairs (e.g., opposing coils) of the anode quadrupole core 202. This effectively moves the center of the quadrupole magnetic field in the 'x' and/or 'y' direction (see, for example, FIGS. 11B and 11C, which show a representative steering effect), which in turn results in a shifting of the electron beam (and resultant position of the focal spot on the anode target) in a prescribed 'x' and/or 'y' direction.

Figure 9:
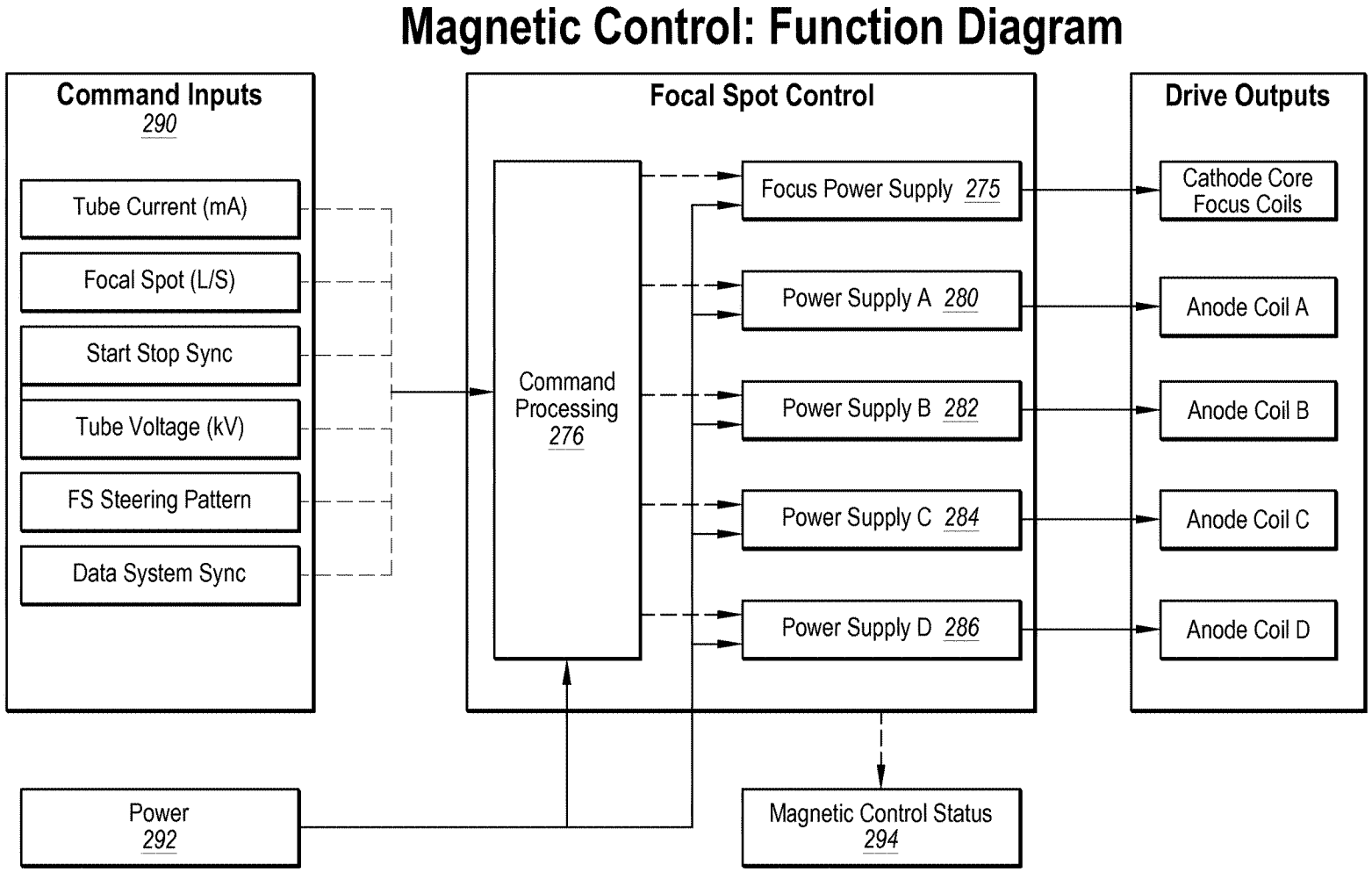
FIG. 9 is a functional block diagram showing one embodiment of a magnetic control for the quadrupole magnetic system of FIGS. 8A-8B.

Reference is next made to FIG. 9, which illustrates a functional diagram illustrating an embodiment of a magnetic control system for controlling the operation of the quadrupole system of FIGS. 8A-8B. At a high level, the magnetic control system of FIG. 9 provides the requisite control of coil currents supplied to the quadrupole cores 202 and 204 so as to (1) provide a requisite quadrupole field so as to achieve a desired focus of the focal spot; and (2) provide a requisite shift in the quadrupole field(s) so as to achieve a desired position of the focal spot. As noted, control of the coil currents is accomplished in a manner so as to achieve a desired steering frequency.

The embodiment of FIG. 9 includes a Command Processing device 276, which may be implemented with any appropriate programmable device, such as a microprocessor or microcontroller, or equivalent electronics. The Command Processing device 276 controls, for example, the operation of each of the independent power supplies (i.e., which provide corresponding coils operating current to create a magnetic field), preferably in accordance with parameters stored in non-volatile memory, such as that denoted at Command Inputs 290. For example, in an example operational scheme, parameters stored/defined in Command Inputs 290 might include one or more of the following parameters relevant to the focusing and steering of the focal spot: Tube Current (a numeric value identifying the operational magnitude of the tube current, in milliamps); Focal Spot L/S (such as 'large' or 'small' focal spot size); Start/Stop Sync (identifying when to power on and power off focusing); Tube Voltage (specifying tube operating voltage, in kilovolts); Focal Spot Steering Pattern (for example, a numeric value indicating a predefined steering pattern for the focal spot); and Data System Sync (to sync an X-ray beam pattern with a corresponding imaging system).

In an exemplary implementation, Command Inputs 290 can correspond to requisite values in a look-up table arrangement. Focus Power Supply 275 supplies constant focus current to the coils of the cathode quadrupole core 204 described above. Similarly, Power Supply A (280), Power Supply B (282), Power Supply C (284) and Power Supply D (286) supply constant focus current to the corresponding coils of the anode quadrupole core 202 the focusing component of each coil, and a AC offset current for purposes of shifting the focal spot.

Thus, by way of one example, a Focal Spot size specified as 'small' can cause the Command Processing unit 276 to control the Focus Power Supply 275 to provide a constant focus current having the prescribed magnitude (corresponding to a 'small' focal spot) to each of the coils (206*a*, 208*a*, 206*b*, 208*b*) of the cathode magnetic quadrupole core 204, as described above. Similarly, each of the Power Supplies 280 (coil 210*a*), 282 (coil 212*b*), 284 (coil 210*b*), and 286 (coil 212*a*) can also be controlled to provide a constant focus current, having the same magnitude as supplied by Focus Power Supply 275, to each of the coils of the anode quadrupole core 202. Again, this can result in a quadrupole magnetic field that imposes focusing forces on the electron beam so as to result in a 'small' focal spot on the anode target.

Similarly, a FS Steering Pattern might prescribe a specific focal spot steering frequency and requisite displacement in an 'x' and/or 'y' direction. This can result in Command Processing unit 276 to control each of the Power Supplies 280, 282, 284, and 286 to supply a requisite X-offset and Y-offset AC current magnitudes to the corresponding coils (e.g., one coil, a pair of opposing coils, three coils, or two pairs of opposing coils) of the anode quadrupole core 202, thereby creating a desired steering effect, in addition to the beam (focal spot) focus, as described above.

In an example embodiment, each of the Power Supplies 275, 280, 282, 284 and 286 are high-speed switching supplies, and which receive electrical power from a main power supply denoted at 292. Magnetic Control Status 294 receives status information pertaining to the operation of the power supplies and the coils, and may be monitored by command processing unit 276 and/or an external monitor control apparatus (not shown).

Thus, in the embodiment of FIGS. 8A-8B and FIG. 9, a magnetic system providing electron beam focusing and two-axis beam steering via two quadrupoles is provided. While an example embodiment is shown, it will be appreciated that alternate approaches are contemplated. For example, while steering of the electron beam is provided by way of AC offset to one coil or a coil pair or three coils or two pairs of opposing coils on the anode quadrupole core 202, it will be appreciated that both the anode core 202 and the cathode core 204 might be constructed of a ferrite material, and the steering could be "split" between the cores, each providing a steering effect, one 'x' and one 'y' direction for example. Other variations can also be contemplated, such as both the cathode core and anode core implementing focusing and steering.

Figure 10:
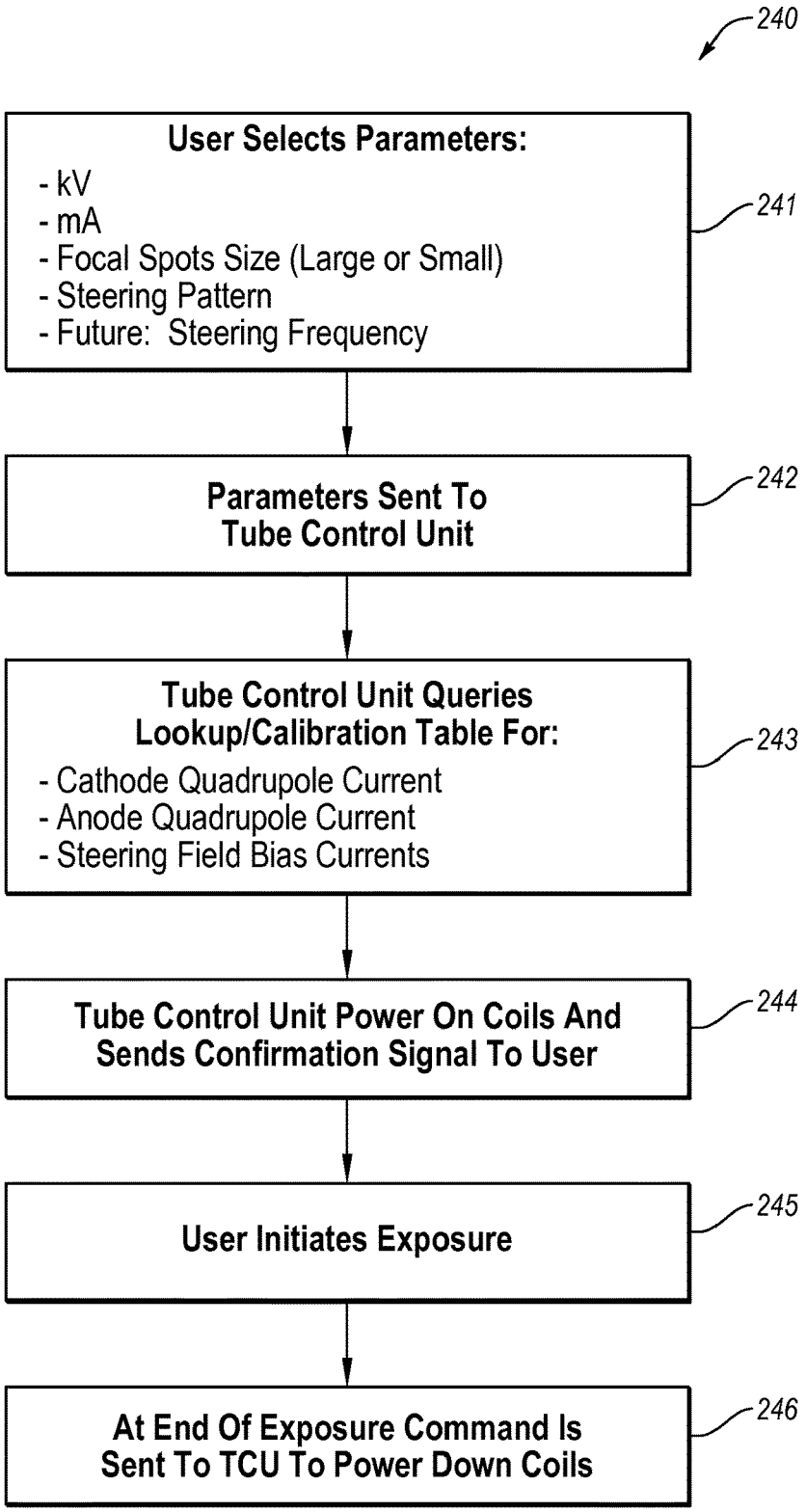
FIG. 10 is a flow chart showing one embodiment of a process control for magnetic control.

Reference is next made to FIG. 10, which illustrates one example of a methodology 240 for operating the magnetic control functionality denoted in FIG. 9. Beginning at step 241, a user may select or identify appropriate operating parameters, which are stored as command inputs in memory of Command Inputs 290. At step 242, the operating parameters are forwarded to the tube control unit, which includes command processing unit 276. For each operating parameter, at step 243 the command processing unit 276 queries a lookup/calibration table for corresponding values, e.g., cathode quadrupole constant focus current, anode quadrupole constant focus current and AC offsets. At step 244, coils are powered on with respective current values, and confirmation is provided to the user. At step 245, the user initiates the exposure and X-ray imaging commences. At completion, step 246, a command is forwarded which causes power to the coils to be ceased.

Accordingly, the offset can be applied to one coil or two opposing coils. In one example, AC offset is only applied to one coil to get steering in a diagonal direction. In another example, AC offset can be applied to both coils of an opposing coil pair. In one example, one coil of an opposing pair receives AC offset, and the other coil of the opposing pair can be set at zero AC offset. As such one coil can have AC offset in one coil set to zero and the other opposing coil of the pair has an AC offset that is not zero. In one embodiment, the coils of an opposing coil pair can have different offsets. In one embodiment, the AC offset in a pair of opposing coils can be created by having one coil with zero offset while the other has some offset. Application of AC offset to only one coil or having the coils of a coil pair with different AC offset can be applied to all embodiments.

Figure 12A:
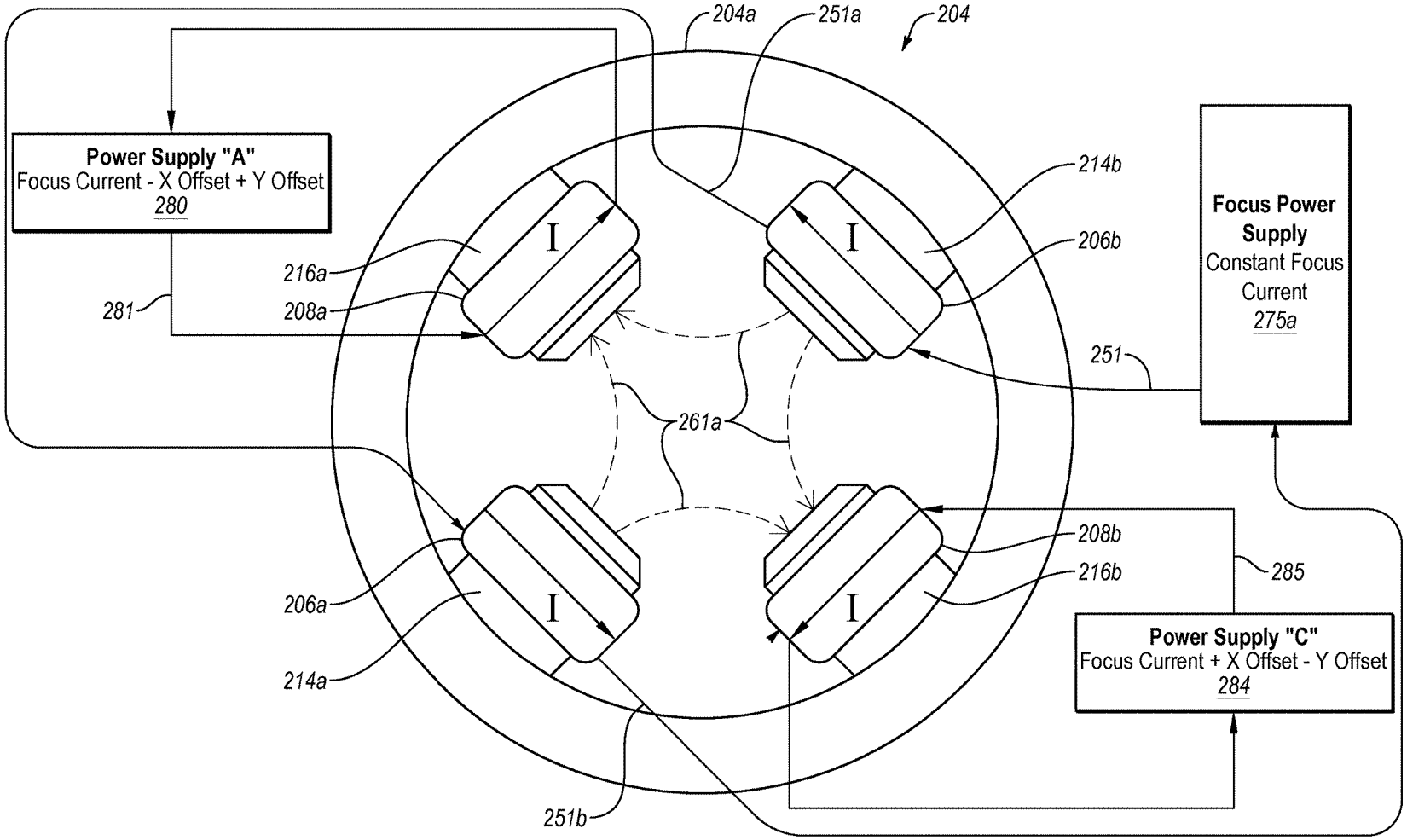
FIGS. 12A-12B are top views of components of one embodiment of a quadrupole magnetic system.
Figure 12B:
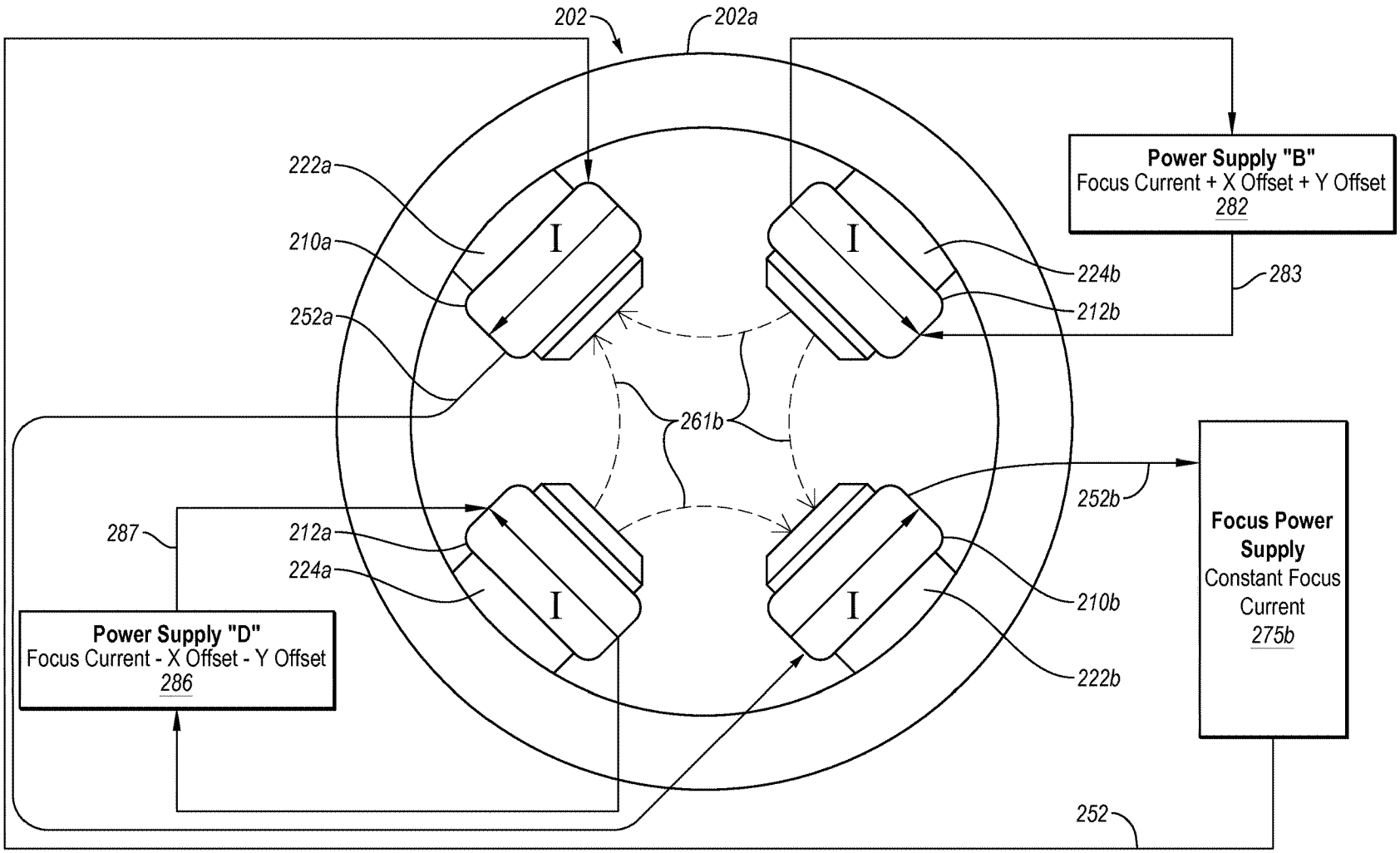

FIG. 12A shows an embodiment of a cathode core 204 having a cathode yoke 204*a* and is configured as a quadrupole (e.g., cathode-side magnetic quadrupole 204) for focusing with a pair of coils having AC offset to implement steering, and FIG. 12B illustrates an embodiment of an anode core 202 having an anode yoke 202*a*, also configured as a quadrupole (e.g., anode-side magnetic quadrupole 202) for focusing with a pair of coils having AC offset to implement steering. The steering of cathode core 204 is orthogonal to steering of anode core 202. The subject matter of FIG. 12A can include aspects of FIG. 8A, and the subject matter of FIG. 12B can include aspects of FIG. 8B as described herein.

As is further shown in FIG. 12A, the illustrated example includes a Focus Power Supply 275*a* for providing a predetermined constant focusing current to two of the four coils (e.g., 206*a* and 206*b*), which are connected in electrical series, as denoted schematically at 251, 251*a*, and 25 lb. Additionally, two of the coils (e.g., 208*a* and 208*b*) include separate and independent power sources for providing current to induce a magnetic field in a respective coil, each power supply being denoted at 280 (Power Supply A) and 284 (Power Supply C). For purposes of providing a quadrupole magnetic field, a constant DC 'Focus Current' is provided to each of the coils, as denoted by the schematic electrical circuit associated with each supply (e.g., 281 and 285), which is matched by the Focus Power Supply 275*a*. In this embodiment, the current supplied in the coil is substantially constant, and results in a current flow within each coil as denoted by the letter 'I' and corresponding arrow, in turn resulting in a magnetic field schematically denoted at 261*a*. The magnitude of the current is selected so as to provide a desired magnetic field that results in a desired focusing effect.

Also, the cathode quadrupole core 204 is further configured to provide a steering effect in a manner that does not require additional coils. To do so, one or both coils 208*a* and 208*b* are provided with—in addition to the constant focus current described above—an X AC offset current and a Y AC offset current. The duration of the AC offset currents are at a predetermined frequency and the respective offset current magnitudes are designed to achieve a desired an offset or shifting of the center of the quadrupole field and, in turn, a resultant shift in the electron beam (and focal spot) from the center axis of the cores. Thus, coils 208*a* and 208*b* are driven independently, with a constant focus current, and steering perturbations are created in the magnetic field at the desired focal spot steering frequency by application of desired X AC offset and Y AC offset currents in at least one coil of corresponding coil pairs (e.g., opposing coils) of the cathode quadrupole core 204. This effectively moves the center of the magnetic field in the 'x' and/or 'y' direction, which in turn results in a shifting of the electron beam (and resultant position of the focal spot on the anode target) in a prescribed 'x' and/or 'y' direction.

As is further shown in FIG. 12B, the illustrated example includes a Focus Power Supply 275*b* for providing a predetermined constant current in two of the four coils (e.g., 210*a* and 210*b*), which are connected in electrical series, as denoted schematically at 252, 252*a*, and 252*b*. Additionally, two of the coils (e.g., 212*a* and 212*b*) include separate and independent power sources for providing current to induce a magnetic field in a respective coil, each power supply being denoted at 282 (Power Supply B) and 286 (Power Supply D). For purposes of providing a quadrupole magnetic field, a constant 'Focus Current' is provided to each of the coils, as denoted by the schematic electrical circuit associated with each supply (e.g., 283 and 287), which is matched by the Focus Power Supply 275*b*. In this embodiment, the current supplied results in the current in the coil being substantially constant, and results in a current flow within each coil as denoted by the letter T and corresponding arrow, in turn resulting in a magnetic field schematically denoted at 261*b*. The magnitude of the current is selected so as to provide a desired magnetic field that results in a desired focusing effect. The focus current in the anode quadrupole core 202 is opposite to the cathode quadrupole core 204 focus current so as to provide for complimentary magnetic fields, and required focusing effect.

Also, the anode quadrupole core 202 is further configured to provide a steering effect in a manner that does not require additional coils. To do so, one or both of the coils 212*a* and 212*b* are provided with—in addition to the constant focus current described above—an X AC offset current and a Y AC offset current. The duration of the AC offset currents are at a predetermined frequency and the respective AC offset current magnitudes are designed to achieve a desired shifted quadrupole field (e.g., center of quadrupole shifted in X and/or Y) and, in turn, a resultant shift in the electron beam (and focal spot). Thus, coils 212*a* and 212*b* are driven independently, with a constant focus current, and steering perturbations are created in the magnetic field at the desired focal spot steering frequency by application of desired X AC offset and Y AC offset currents to one coil or both coils of the steering coil pairs of the anode quadrupole core 202. This effectively moves the center of the magnetic field in the 'x' and/or 'y' direction, which in turn results in a shifting of the electron beam (and resultant position of the focal spot on the anode target) in a prescribed 'x' and/or 'y' direction. Thus, the combination of coil pairs 208*a,b* and coil pairs 212*a,b* provide steering in both the "x" and "y;" directions.

Figure 12C:
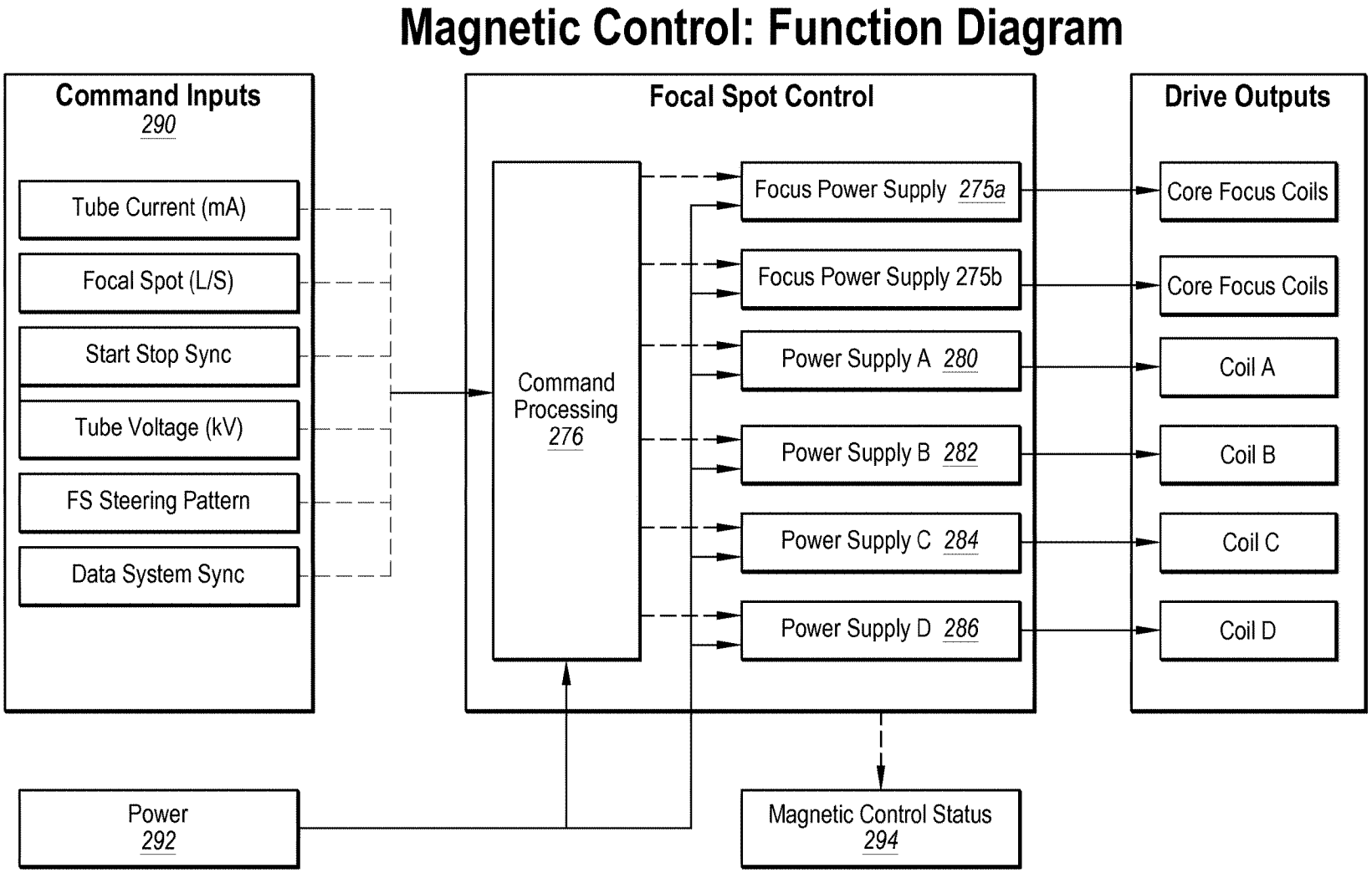
FIG. 12C is a functional block diagram showing one embodiment of a magnetic control for the quadrupole magnetic system of FIGS. 12A-12B.

Reference is next made to FIG. 12C, which illustrates a functional diagram illustrating an embodiment of a magnetic control system for controlling the operation of the quadrupole system of FIGS. 12A-12B. At a high level, the magnetic control system of FIG. 12C provides the requisite control of coil currents supplied to the quadrupole cores 202 and 204 so as to (1) provide a requisite quadrupole field so as to achieve a desired focus of the focal spot; and (2) provide a requisite shifted quadrupole field so as to achieve a desired position of the focal spot. As noted, control of the coil currents is accomplished in a manner so as to achieve a desired steering frequency.

The embodiment of FIG. 12C includes a command processing device 276, which may be implemented with any appropriate programmable device, such as a microprocessor or microcontroller, or equivalent electronics. The command processing device 276 controls, for example, the operation of each of the independent power supplies (i.e., which provide corresponding coils operating current to create a magnetic field), preferably in accordance with parameters stored in non-volatile memory, such as that denoted at Command Inputs 290. For example, in an example operational scheme, parameters stored/defined in Command Inputs 290 might include one or more of the following parameters relevant to the focusing and steering of the focal spot: Tube Current (a numeric value identifying the operational magnitude of the tube current, in milliamps); Focal Spot L/S (such as 'large' or 'small' focal spot size); Start/Stop Sync (identifying when to power on and power off focusing); Tube Voltage (specifying tube operating voltage, in kilovolts); Focal Spot Steering Pattern (for example, a numeric value indicating a predefined steering pattern for the focal spot; and Data System Sync (to sync an X-ray beam pattern with a corresponding imaging system).

In an exemplary implementation, Command Inputs 290 can correspond to requisite values in a look-up table arrangement. Focus Power Supply 275*a* and Focus Power Supply 275*b* supply constant focus current to the coils of the cores 202 and 204 of FIGS. 12A-12B. Similarly, Power Supply A (280), Power Supply B (282), Power Supply C (284) and Power Supply D (286) supply constant focus current to the corresponding coils of the cores 202 and 204 for the focusing component of each coil, and an AC offset current for purposes of shifting the quadrupole from the central axis.

Thus, by way of one example, a Focal Spot size specified as 'small' can cause the Command Processing unit 276 to control the Focus Power Supply 275*a* and Focus Power Supply 275*b* to provide a constant focus current having the prescribed magnitude (corresponding to a 'small' focal spot) to each of the coils (206*a*, 210*a*, 206*b*, 210*b*) of the cores 202 and 204, as described above. Similarly, each of the Power Supplies 280 (coil 208*a*), 282 (coil 212*b*), 284 (coil 208*b*), and 286 (coil 212*a*) can also be controlled to provide a constant focus current, having the same magnitude as supplied by Focus Power Supply 275*a* and Focus Power Supply 275*b*. Again, this can result in a quadrupole magnetic field that imposes focusing forces on the electron beam so as to result in a 'small' focal spot on the anode target.

Similarly, a FS Steering Pattern might prescribe a specific focal spot steering frequency and requisite displacement in an 'x' and/or 'y' direction. This can result in Command Processing unit 276 to control each of the Power Supplies 280, 282, 284, and 286 to supply a requisite X AC offset and Y AC offset current magnitudes to one coil, a pair of coils, three coils, or the pairs of coils of the corresponding coils of the cores 202 and 204, thereby creating a desired shifted quadrupole field for the steering effect, in addition to the beam (focal spot) focus, as described above.

In one embodiment, the steering quadrupole core can be operated under high speed switching. Such high speed switching can be at 6.5 to 7 kHz, and may include 20 microsecond transition times. Also, the focusing can have a magnetic flux that is about 400 gauss, whereas the steering can have a magnetic flux of 30-40. However, these values may vary, such as by 1, 2, 5, 10, or 20%.

An X-ray tube comprising: a cathode including an emitter, wherein the emitter has a substantially planar surface configured to emit electrons in an electron beam in a non-homogenous manner; an anode configured to receive the emitted electrons; a first magnetic quadrupole formed on a first yoke and having a magnetic quadrupole gradient for focusing the electron beam in a first direction and defocusing the electron beam in a second direction perpendicular to the first direction; a second magnetic quadrupole formed on a second yoke and having a magnetic quadrupole gradient for focusing the electron beam in the second direction and defocusing the electron beam in the first direction; wherein a combination of the first and second magnetic quadrupoles provides a net focusing effect in both first and second directions of a focal spot of the electron beam; and at least one coil of a pair of quadrupole coils having AC offset configured to deflect the electron beam in order to shift the focal spot of the electron beam on a target, at least one coil of a pair of quadrupole coils having AC offset being on the first yoke, the second yoke or on both the first and the second yoke.

It will be appreciated that various implementations of the electron beam steering, as described herein, can be used advantageously in connection with the tunable emitter, and that features of each are complementary to one another. However, it will also be appreciated that various features—of either electron beam steering or of the planar emitter—do not need to be used together, and have applicability and functionality in separate implementations.

In one embodiment, an X-ray tube can include: a cathode including an electron emitter that emits an electron beam; an anode configured to receive the emitted electrons of the electron beam; a first magnetic quadrupole between the cathode and the anode and having a first quadrupole yoke with four evenly distributed first quadrupole pole projections extending from the first quadrupole yoke and oriented toward a central axis of the first quadrupole yoke and each of the four first quadrupole pole projections having a first quadrupole electromagnetic coil operably coupled to a power supply system that provides a constant current to each first quadrupole electromagnetic coil to produce a first focusing magnetic quadrupole field; a second magnetic quadrupole between the first magnetic quadrupole and the anode and having a second quadrupole yoke with four evenly distributed second quadrupole pole projections extending from the second quadrupole yoke and oriented toward a central axis of the second quadrupole yoke and each of the four second quadrupole pole projections having a second quadrupole electromagnetic coil operably coupled to the power supply system that provides a constant current to each second quadrupole electromagnetic coil to produce a second focusing quadrupole field; and at least one coil of a pair of opposing quadrupole electromagnetic coils of the first or second quadrupole electromagnetic coils operably coupled to the power supply system that provides an alternating current offset to at least one coil of the pair of opposing quadrupole electromagnetic coils to shift the first and/or second focusing quadrupole field from the central axis of the first and/or second quadrupole yokes. In one aspect, the X-ray tube can include two pairs of opposing quadrupole electromagnetic coils of the first and/or second quadrupole electromagnetic coils, which are operably coupled to the power supply system that provides an alternating current offset to at least one coil of each pair of the two pairs of opposing quadrupole electromagnetic coils to shift the first and/or second focusing quadrupole field from the central axis of the first and/or second quadrupole yokes.

In one aspect, a first pair of coils having AC offset is in a first plane and a second pair of coils having AC offset is in a different second plane. In one aspect, the first quadrupole electromagnetic coils form the two pairs of coils with AC offset. In one aspect, the second quadrupole electromagnetic coils form the two pairs of coils with AC offset. In one aspect, the second quadrupole electromagnetic coils form the two pairs of coils with at least one coil of each coil pair having AC offset. In one aspect, the two pairs of coils with at least one coil of each pair having AC offset are orthogonal.

In one embodiment, the X-ray tube has four power supplies. Each of these power supplies is operably coupled with only one of the first or second quadrupole electromagnetic coils so as to form the two pairs of coils, each pair of coils having at least one coil with AC offset.

In one embodiment, a first focus power supply is operably coupled with at least two opposing first quadrupole electromagnetic coils. Often, the first focus power supply is operably coupled with four quadrupole electromagnetic coils. In one aspect, a second focus power supply is operably coupled with at least two opposing second quadrupole electromagnetic coils. When a power supply is operably coupled with two quadrupole electromagnetic coils, the other two electromagnetic coils of the particular quadrupole have independent power supplies or opposing pairs of coils have independent power supplies. If one quadrupole has all four electromagnetic coils operably coupled with a common power supply, then the other quadrupole has all four electromagnetic coils operably coupled to four different power supplies. However, it should be recognized that a single power supply can be coupled to any number of coils to provide the same power to those coils, such as 2, 3, or 4 coils. Also, it may be possible for a single power supply to provide different currents to different coils.

In one embodiment, the X-ray tube can include: the first magnetic quadrupole being configured for providing a first magnetic quadrupole gradient for focusing the electron beam in a first direction and defocusing the electron beam in a second direction orthogonal to the first direction; the second magnetic quadrupole being configured for providing a second magnetic quadrupole gradient for focusing the electron beam in the second direction and defocusing the electron beam in the first direction. In one aspect, a combination of the first and second magnetic quadrupoles provides a net focusing effect in both first and second directions of a focal spot of the electron beam.

In one embodiment, the X-ray tube can include two pairs of opposing coils with one coil of each coil pair having AC offset, where the two pairs of coils are configured to deflect the electron beam in two different directions in order to shift a focal spot of the electron beam on a target surface of the anode. The two pairs of opposing coils with AC offset are formed from two pairs of opposing coils of the quadrupole coils.

In one embodiment, the X-ray tube includes: the four first quadrupole pole projections having the first quadrupole electromagnetic coils being at 45, 135, 225, and 315 degrees; and the four second quadrupole pole projections having the second quadrupole electromagnetic coils being at 45, 135, 225, and 315 degrees.

In one embodiment, the X-ray tube can include the electron emitter having a substantially planar surface configured to emit electrons in an electron beam in a non-homogenous manner. In one aspect, the cathode can have a cathode head surface with one or more focusing elements located adjacent to the electron emitter. The emitter can be any electron emitter having a configuration to emit electrons in the electron beam to be substantially laminar beam. Any emitter that emits a substantially laminar beam (e.g., significantly laminar beam) can be used with the focusing and steering systems described herein.

In one embodiment, the X-ray tube can include: the first magnetic quadrupole being operably coupled with a first focus power supply; and each quadrupole electromagnetic coil with AC offset being operably coupled with a different steering power supply.

In one embodiment, an X-ray tube can include: a cathode including an emitter; an anode configured to receive the emitted electrons; a first magnetic quadrupole formed on a first yoke and having a magnetic quadrupole gradient for focusing the electron beam in a first direction and defocusing the electron beam in a second direction perpendicular to the first direction; and a second magnetic quadrupole formed on a second yoke and having a magnetic quadrupole gradient for focusing the electron beam in the second direction and defocusing the electron beam in the first direction. In one aspect, a combination of the first and second magnetic quadrupoles provides a net focusing effect in both first and second directions of a focal spot of the electron beam. In one aspect, electromagnet pairs of the first magnetic quadrupole or second magnetic quadrupole have AC offset to produce a shifted quadrupole field configured to deflect the electron beam in order to shift the focal spot of the electron beam on a target of the anode. In one aspect, the X-ray tube includes two electromagnet pairs of the first magnetic quadrupole and/or second magnetic quadrupole having AC offset to produce a shifted quadrupole field configured to deflect the electron beam in two orthogonal directions in order to shift the focal spot of the electron beam on a target of the anode. In one aspect, both pairs of opposing coils having AC offset are configured on the first yoke or the second yoke, or one pair of opposing coils having AC offset on each of the first yoke and the second yoke.

In one embodiment, a method of focusing and steering an electron beam in an X-ray tube can include: providing an X-ray tube of one of the embodiments (e.g., having at least one pair of opposing coils with one coil of each pair having AC offset); operating the electron emitter so as to emit the electron beam from the cathode to the anode along an electron beam axis; operating the first magnetic quadrupole to focus the electron beam in a first direction; operating the second magnetic quadrupole to focus the electron beam in a second direction orthogonal with the first direction; and operating the pair of opposing coils with AC offset to steer the electron beam away from the electron beam axis. In one aspect, the method can include operating opposing quadrupole electromagnetic coils with AC offset to have different powers to form an asymmetric quadrupole moment that is shifted from a central axis. In one aspect, the method can include forming a plurality of different focal spots at different locations on the anode for a given time interval, which time interval can be about 0.1, 0.2, 0.25, 0.3, 0.4, 0.5, 0.75, 1, 2, 3, 4, or 5 seconds, and generally less than 30 seconds. In one aspect, the method can include forming a plurality of different focal spots having different focal spot areas for a given time interval, which time interval can be the same or different from above.

In one embodiment, a method of focusing and steering an electron beam in an X-ray tube can include: providing the X-ray tube of one of the embodiments (e.g., having at least two pair of opposing coils with one coil of each pair having AC offset); operating the electron emitter so as to emit the electron beam from the cathode to the anode along an electron beam axis; operating the first magnetic quadrupole to focus the electron beam in a first direction; operating the second magnetic quadrupole to focus the electron beam in a second direction orthogonal with the first direction; operating a first pair of opposing coils with at least one coil of the first pair having AC offset to steer the electron beam away from the electron beam axis in a first direction; and operating a second pair of opposing coils with at least one coil of the second pair AC offset to steer the electron beam away from the electron beam axis in a second direction that is orthogonal to the first direction. In one aspect, the method can include operating opposing quadrupole electromagnetic coils independently with AC offset to have different currents to form a first asymmetric quadrupole moment. In one aspect, the method can include operating opposing quadrupole electromagnetic coils independently with AC offset to have different currents to form a second asymmetric quadrupole moment.

In one embodiment, one or both of the quadrupole cores can be devoid of electromagnetic coils wrapped around the core. The coils are on the pole projections, and the core is devoid of having coils wrapped around the core between the pole projections.

IV. Example Embodiments of a Magnetic System Providing Electron Beam Focusing and Two-Axis Beam Steering Via Two Quadrupoles and Two Steering Coils Collocated on Pole Protrusions with Quadrupole Coils As noted above, certain embodiments include an electron beam manipulation component that allows for steering and/or focusing of the electron beam so as to control the position and/or size and shape of the focal spot on the anode target. In one embodiment, this manipulation is provided by way of a magnetic system implemented as two magnetic quadrupoles and at least one pair of steering coils disposed in the electron beam path. For example, in one embodiment, two quadrupoles are used to provide focusing of the electron beam, and at least one pair of steering coils is used to provide steering of the electron beam. In this approach, focusing magnetic fields can be provided by both quadrupoles (e.g., the anode side quadrupole and the cathode side quadrupole) and the electron beam steering magnetic fields can be provided by one or two pair of steering coils. Alternatively, magnetic fields for steering can be done for one direction with one pair of steering coils and for the other direction with the other pair of shifting coils, where the pairs are orthogonal with each other. Also, only one steering coil of a steering coil pair needs to receive AC offset in order to implement the steering function. As such, embodiments may only include one steering coil for each steering coil that is shown, thereby one steering coil of each steering coil pair can be omitted.

In one embodiment, the steering is accomplished by the two pairs of steering coils which are created by steering coils wound on one of the core's poles projections adjacent with quadrupole coils, where the quadrupole coils (e.g., wound on the same pole projections as the steering coils) maintain the constant focusing coil current. Steering of the electron beam (and resulting shifting of the focal spot) occurs through appropriate steering coil pair energizing and can be done in one axis or a combination of axes.

Figure 13:
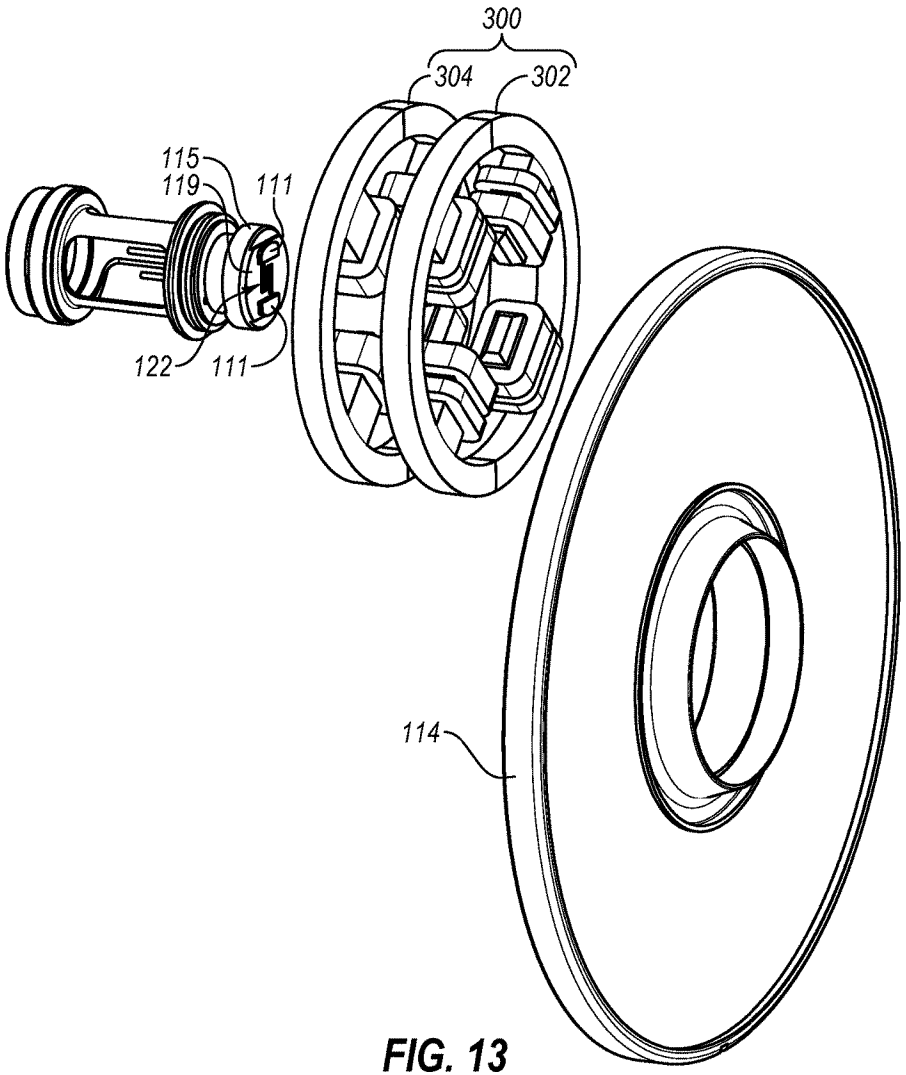
FIG. 13 is a perspective view of internal components of an embodiment of an X-ray tube.

FIG. 13 shows the components of the X-ray tube 100 (see FIGS. 1A-1C) that are arranged for electron emission, electron beam steering and/or focusing, and X-ray emission. In FIG. 13, disposed within the beam path is a magnetic system 300 configured to focus and steer the electron beam before reaching the anode 114, as noted above. A portion of the cathode assembly 110 has the cathode head 115 with the electron emitter 122 on an end of the cathode head 115 so as to be oriented or pointed toward the anode 114 (see FIG. 1C for orientation). The cathode head 115 can include a head surface 119 that has an emitter region that is formed as a recess that is configured to receive the electron emitter 122 (e.g., planar electron emitter). The head surface 119 also includes electron beam focusing elements 111 located on opposite sides of the electron emitter 122. The magnetic system 300 of FIG. 13 can replace the magnetic system 180 of FIGS. 1A-1C, and thereby is useful in the X-ray tube 100.

In this embodiment, the magnetic system 300 is implemented as two magnetic cores 302, 304 that have quadrupoles disposed in the electron beam path 112 of the X-ray tube 100. The combination of the two magnetic cores 302, 304 are configured to (a) focus in both directions perpendicular to the beam path, and (b) to steer the beam in both directions perpendicular to the beam path. The "focusing" provides a desired focal spot shape and size, and the "steering" effects the positioning of the focal spot on the anode target surface 128.

Figure 14A:
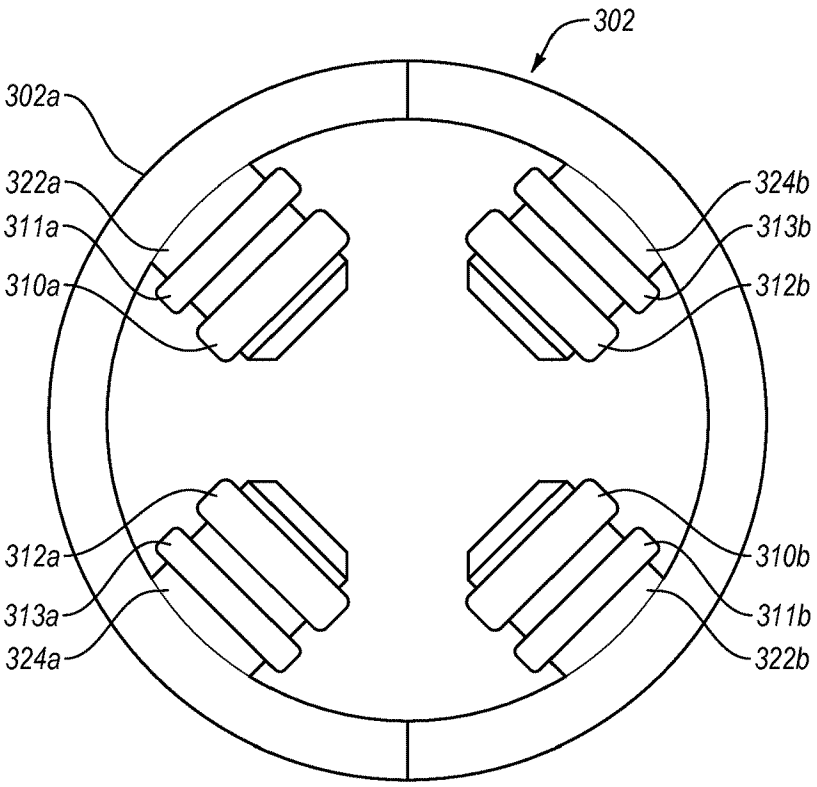
FIG. 14A shows an embodiment of an anode core.
Figure 14B:
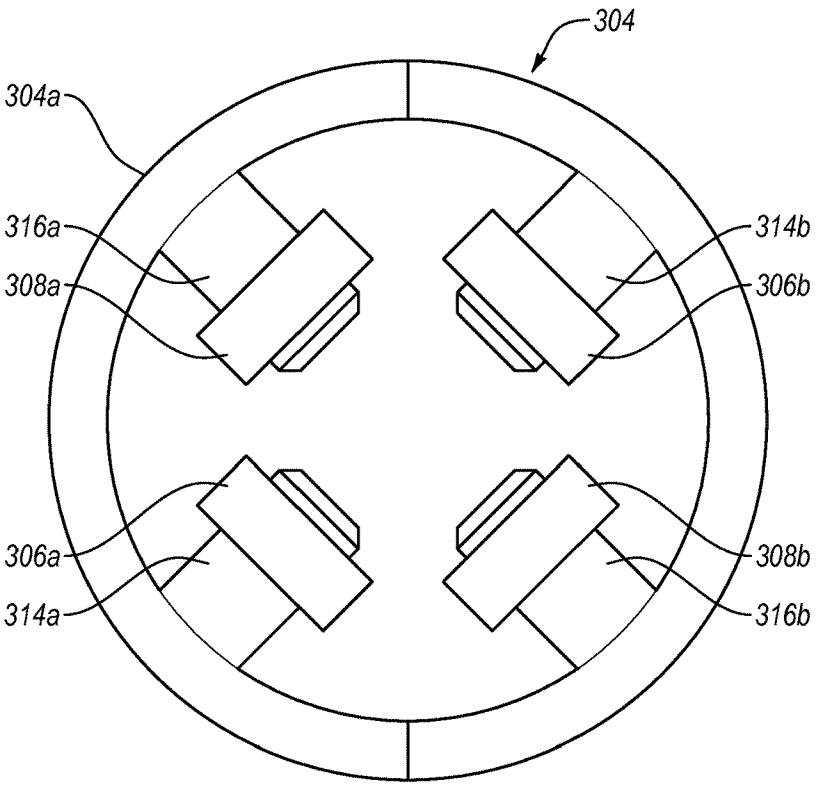
FIG. 14B shows an embodiment of a cathode core.

FIG. 14A shows an embodiment of an anode core 302 (e.g., closer to anode) having an anode yoke 302*a*, and FIG. 14B shows an embodiment of a cathode core 304 (e.g., closer to cathode) having a cathode yoke 304*a*. Each yoke 302*a*, 304*a* includes four pole projections arranged in an evenly distributed and opposing relationship, cathode pole projections 314*a,b* (e.g., first cathode pole projections) and 316*a,b* (e.g., second cathode pole projections) on the cathode yoke 304*a*, and anode pole projections 322*a,b* (e.g., first anode pole projections) and 324*a,b* (e.g., second anode pole projections) on the anode yoke 302*a*. Each pole projection includes corresponding quadrupole electromagnetic coils, denoted as cathode quadrupole coils 306*a,b* (e.g., first cathode coils) and 308*a,b* (e.g., second cathode coils) on the cathode yoke 304*a* and anode quadrupole coils 310*a,b* (e.g., first anode coils) and 312*a,b* (e.g., second anode coils) on the anode yoke 302*a*. Additionally, the pole projections 322*a,b* and 324*a,b* of the anode yoke 302*a* includes dipole coils 311*a,b* and 313*a,b*. Current is supplied to the quadrupole coils so as to provide the desired magnetic focusing effect, and current is supplied to the dipole coils so as to provide the desired steering effect, as described herein.

Figure 15A:
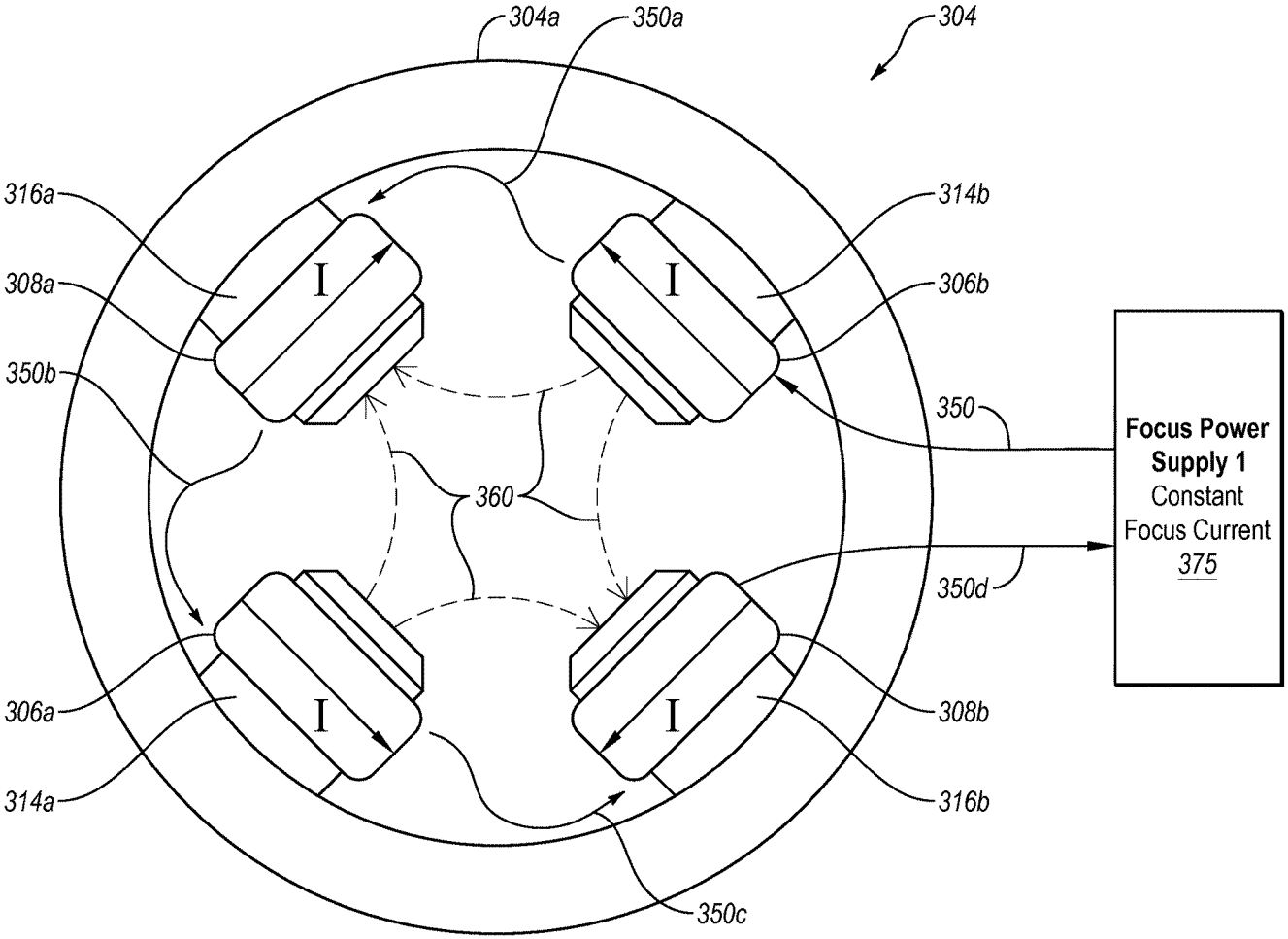
FIGS. 15A-15B are top views of components of one embodiment of a magnet system.
Figure 15B:
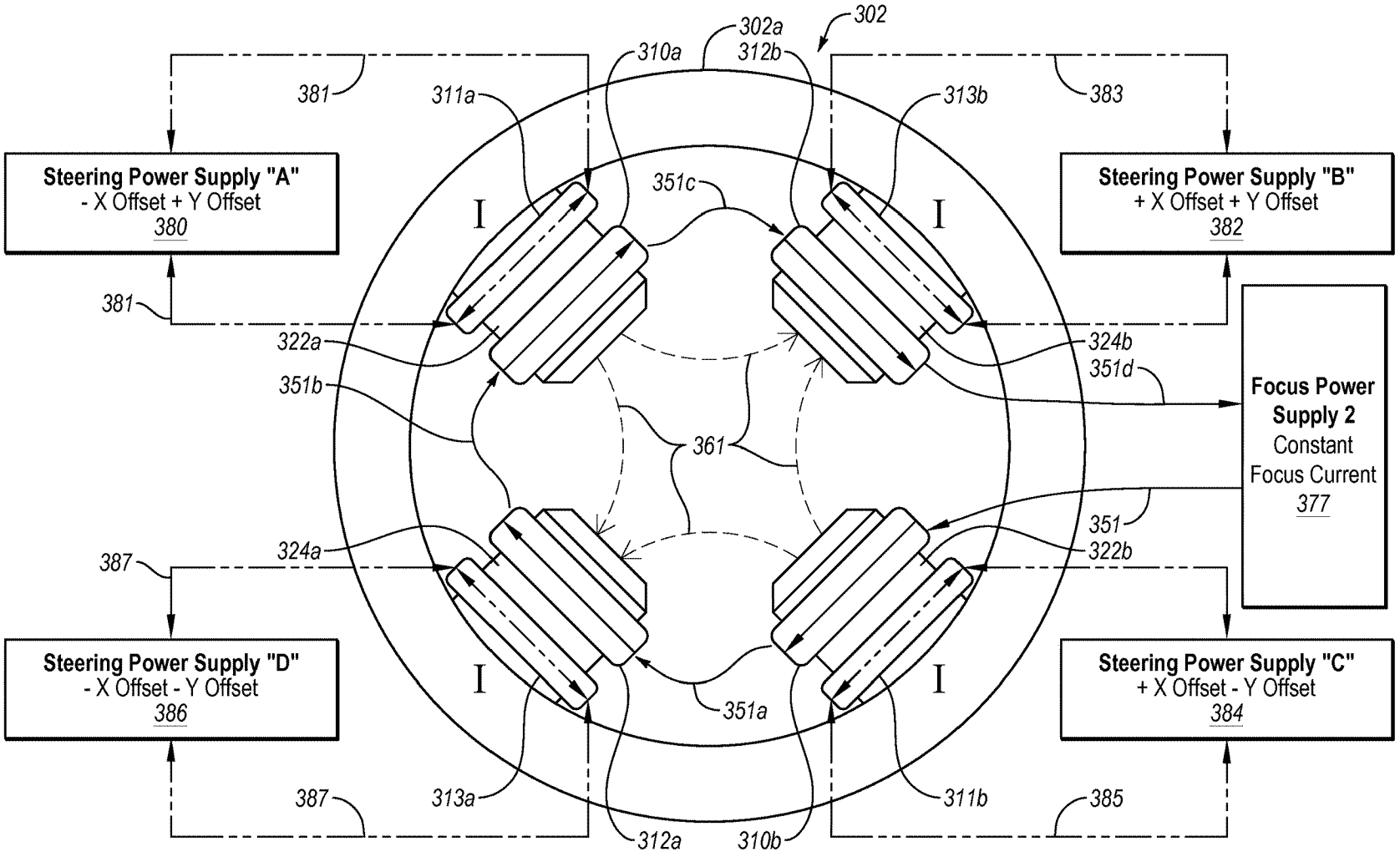

In this context, in conjunction with the embodiments shown in FIGS. 1A-1C, 13, and 14A-14B (with reference to the magnetic system 300 in particular), reference is further made to FIGS. 15A and 15B. FIG. 15A shows an embodiment of a cathode core 304 having a cathode yoke 304*a* and is configured as a quadrupole (e.g., cathode-side magnetic quadrupole 304), and FIG. 15B illustrates an embodiment of an anode core 302 having an anode yoke 302*a*, also configured as a quadrupole (e.g., anode-side magnetic quadrupole 302). As previously described in connection to FIGS. 14A-14B, in this example each core section includes a yoke having four pole projections arranged in an evenly distributed and opposing relationship, pole projections 314*a,b* and

316*a,b* on the cathode yoke 304*a*, and pole projections 322*a,b* and 324*a,b* on the anode yoke 302*a*. Each pole projection includes corresponding quadrupole coils, denoted at 306*a,b* and 308*a,b* on the cathode core 304 and 310*a,b* and 312*a,b* on the anode core 302. Additionally, the pole projections 322*a,b* and 324*a,b* on the anode yoke 302*a* include steering coils, denoted at 311*a,b* and 313*a,b*. The quadrupole coils 310*a,b* and 312*a,b* are closer to an end of the pole projections 322*a,b* and 324*a,b*, and the steering coils 311*a,b* and 313*a,b* are closer to the yoke 202*a*; however, the orientation can be switched. While illustrated as having a substantially circular shape, it will be appreciated that each of the core (or yoke) portions 302*a*, 304*a* can also be configured with different shapes, such as a square orientation, semi-circular, oval, or other. Also, the location of the quadrupole coils and dipole coils on the anode core pole projections can be switched.

The two magnetic cores 302, 304 act as lenses, and may be arranged so that the corresponding quadrupole electromagnets thereof are parallel with respect to each other, and perpendicular to the optical axis defined by the electron beam 112. The cores together deflect the accelerated electrons such that the electron beam 112 is focused in a manner that provides a focal spot with a desired shape and size. Each quadrupole lens creates a magnetic field having a gradient, where the magnetic field intensity differs within the magnetic field. The gradient is such that the magnetic quadrupole field focuses the electron beam in a first direction and defocuses in a second direction that is perpendicular to the first direction. The two quadrupoles can be arranged such that their respective magnetic field gradients are rotated about 90° with respect to each other. As the electron beam traverses the quadrupoles, it is focused to an elongated spot having a length to width ratio of a desired proportion. As such, the magnetic fields of the two quadrupole lenses can have a symmetry with respect to the optical axis or with respect to a plane through the optical axis.

In an example embodiment, the cathode core 304 focuses in a length direction, and defocuses in width direction of the focal spot. The electron beam is then focused in width direction and defocused in length direction by the following anode core 302. In combination the two sequentially arranged magnetic quadrupoles insure a net focusing effect in both directions of the focal spot. However, the focusing and defocusing axes of the two different cores can be switched between the anode core 302 and cathode core 304.

The anode core 302 in one option can be further configured to provide a steering effect that enables a shifting of the focal spot in a plane perpendicular to an optical axis correspondent to electron beam 112 of the X-ray tube 100 by having steering coils collocated on the pole projections along with the quadrupole coils.

With continued reference to FIG. 15A, a top view of a cathode core 304 is shown. A circular core or yoke portion, denoted at 304*a* is provided, which includes four pole projections 314*a*, 314*b*, 316*a*, 316*b* that are directed toward the center of the circular yoke 304*a*. In an example implementation, the yoke 304*a* and the pole projections 314*a*, 314*b*, 316*a*, 316*b* are constructed of core iron. Moreover each coil can be comprised of 22 gauge magnet wire at 60 turns; obviously other configurations can be suitable depending on the needs of a particular application.

As is further shown in FIG. 15A, the illustrated example includes a Focus Power Supply 1 375 for providing a predetermined current to the four quadrupole coils, which are connected in electrical series, as denoted schematically at 350, 350*a*, 350*b* 350*c*, and 350*d*. In this embodiment, the current supplied is substantially constant, and results in a current flow within each coil as denoted by the letter 'I' and corresponding arrow, in turn resulting in a magnetic field schematically denoted at 360. The magnitude of the current is selected so as to provide a desired magnetic field that results in a desired focusing effect. See FIG. 11A, which shows example focusing of the focal spot.

Reference is next made to FIG. 15B, which illustrates an example of a top view of an anode core 302 having a circular core or yoke 302*a*, which includes four pole projections 322*a*, 322*b*, 324*a*, 324*b* also directed toward the center of the circular yoke 302*a*. On each of the pole projections is provided a quadrupole coil, as shown at 310*a*, 310*b*, 312*a* and 312*b*. In addition, a steering coil is collocated on each of the pole projections, as denoted at 311*a*, 311*b* and 313*a*, 313*b*. The anode core 302 and four pole projections 322*a*, 322*b*, 324*a*, 324*b* can be comprised of a low loss ferrite material so as to better respond to steering frequencies (described herein). The coils can utilize similar gauge magnet wire and similar turn ratio, with variations depending on the needs of a given application.

As shown in the example embodiment of FIG. 15B, each of the quadrupole coils 310*a*, 310*b*, 312*a* and 312*b* is connected in electrical series to a Focus Power Supply 2 377 for providing a predetermined focus current, as denoted schematically at 351, 351*a*, 351*b*, 351*c*, 351*d*. For purposes of providing a quadrupole magnetic field, a constant 'Focus Current' is provided to each of the quadrupole coils, as already described. Moreover, as denoted by current flow directional arrows at T, in turn resulting in a magnetic field schematically denoted at 361. The focus current in the anode core 302 is opposite to the cathode core 304 focus current so as to provide for complimentary magnetic fields, and thereby the focusing effect.

As is further shown in the example embodiment of FIG. 15B, and in contrast with the quadrupole coils, each of the steering coils 311*a,b* and 313*a,b* of the anode quadrupole core 302 includes a separate and independent power source for providing current to induce a magnetic field in a respective dipole coil, each power supply being denoted at 380 (Power Supply A), 382 (Power Supply B), 384 (Power Supply C) and 386 (Power Supply D). For purposes of providing a shifted quadrupole field, an AC offset 'Steering Current' is provided to each of the steering coils, as denoted by the schematic electrical circuit associated with each supply (e.g., 381, 383, 385, 387). However, two or more coils may receive zero AC offset.

The anode core 302 is further configured to provide a shifted quadrupole effect with the additional steering coils. To do so, each of the activated steering coils is provided with an X offset AC current and a Y offset AC current, where some steering coils can have zero AC offset. The duration of the offset AC currents are at a predetermined frequency and the respective offset current magnitudes are designed to achieve a desired shifted quadrupole field and, in turn, a resultant shift in the electron beam (and focal spot) from a central axis of the cores. Each steering coil is driven independently so that the steering coil pairs have an appropriate current at the desired focal spot steering frequency by application of desired X offset and Y offset alternating currents in corresponding steering coils or steering coil pairs. Quadrupole field perturbations are created in the magnetic field at the desired focal spot steering frequency by application of desired X offset and Y offset alternating currents in corresponding steering coils or steering coil pairs (e.g., opposing steering coils) of the anode core 302. This effectively moves the center of the magnetic field in the 'x' and/or 'y' direction (see, for example, FIGS. 12B and 12C, which show a representative steering effect), which in turn results in a shifting of the electron beam (and resultant position of the focal spot on the anode target) in a prescribed 'x' and/or 'y' direction.

Figure 15C:
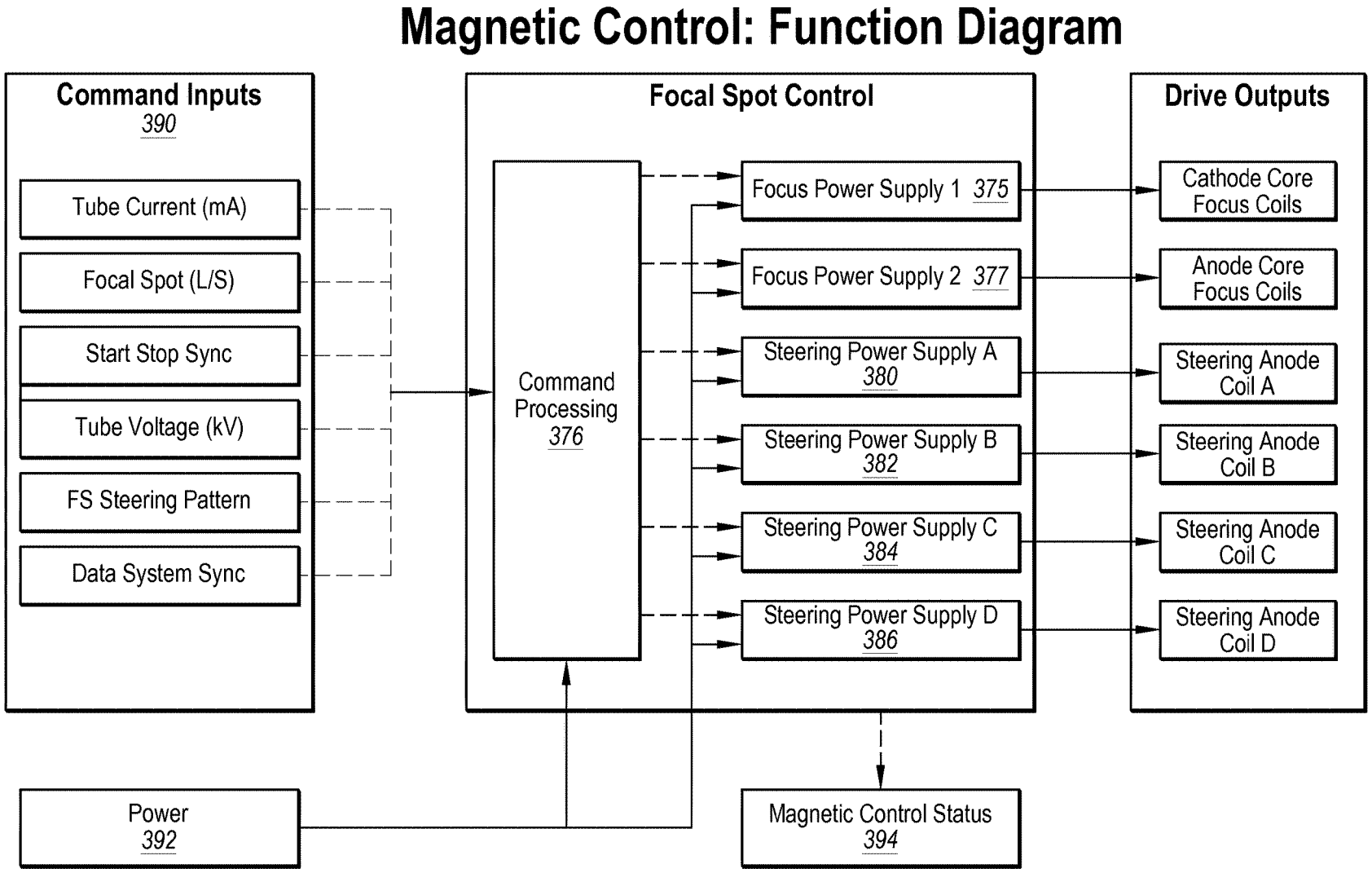
FIG. 15C is a functional block diagram showing one embodiment of a magnetic control for the magnetic system of FIGS. 15A-15B.

Reference is next made to FIG. 15C, which illustrates a functional diagram illustrating an embodiment of a magnetic control system for controlling the operation of the magnetic system of FIGS. 15A-15B. At a high level, the magnetic control system of FIG. 15C provides the requisite control of coil currents supplied to the cores 302 and 304 so as to (1) provide a requisite quadrupole field so as to achieve a desired focus of the focal spot; and (2) provide a shift in the quadrupole field so as to achieve a desired position of the focal spot. As noted, control of the steering coil currents is accomplished in a manner so as to achieve a desired steering frequency.

The embodiment of FIG. 15C includes a Command Processing device 376, which may be implemented with any appropriate programmable device, such as a microprocessor or microcontroller, or equivalent electronics. The Command Processing device 376 controls, for example, the operation of each of the independent power supplies (i.e., which provide corresponding coils operating current to create a magnetic field), preferably in accordance with parameters stored in non-volatile memory, such as that denoted at Command Inputs 390. For example, in an example operational scheme, parameters stored/defined in Command Inputs 390 might include one or more of the following parameters relevant to the focusing and steering of the focal spot: Tube Current (a numeric value identifying the operational magnitude of the tube current, in milliamps); Focal Spot L/S (such as 'large' or 'small' focal spot size); Start/Stop Sync (identifying when to power on and power off focusing); Tube Voltage (specifying tube operating voltage, in kilovolts); Focal Spot Steering Pattern (for example, a numeric value indicating a predefined steering pattern for the focal spot); and Data System Sync (to sync an X-ray beam pattern with a corresponding imaging system).

In an exemplary implementation, Command Inputs 390 can correspond to requisite values in a look-up table arrangement. Focus Power Supply 1 375 supplies AC focus current to the quadrupole coils of the cathode core 304 described above. Focus Power Supply 2 377 supplies DC focus current to the coils of the anode core 302 described above. Similarly, Power Supply A (380), Power Supply B (382), Power Supply C (384) and Power Supply D (386) supply AC offset current to the corresponding steering coils for purposes of a steering effect so as to achieve a required electron beam shift (focal spot movement).

Thus, by way of one example, a Focal Spot size specified as 'small' can cause the Command Processing unit 376 to control the Focus Power Supply 1 375 and Focus Power Supply 2 377 to provide a constant focus current (DC) having the prescribed magnitude (corresponding to a 'small' focal spot) to each of the quadrupole coils of the cathode core 304 and anode core 302. Again, this can result in a quadrupole magnetic field that imposes focusing forces on the electron beam so as to result in a 'small' focal spot on the anode target.

Similarly, a FS Steering Pattern might prescribe a specific focal spot steering frequency and requisite displacement in an 'x' and/or 'y' direction. This can result in Command Processing unit 376 to control each of the Power Supplies 380, 382, 384, and 386 to supply a requisite X-offset and Y-offset AC current magnitudes and amplitudes to the corresponding steering coils of the anode core 302, thereby creating a desired steering effect. Also, the X-offset and Y-offset current can be time varying steering current.

In an example embodiment, each of the Power Supplies 375, 377, 380, 382, 384 and 386 are high-speed switching supplies, and which receive electrical power from a main power supply denoted at 392. Magnetic Control Status 394 receives status information pertaining to the operation of the power supplies and the coils, and may be monitored by command processing unit 376 and/or an external monitor control apparatus (not shown).

Thus, in the embodiment of FIGS. 15A-15C, a magnetic system providing electron beam focusing and two-axis beam steering via two quadrupoles and two pairs of collocated steering coils is provided. While an example embodiment is shown, it will be appreciated that alternate approaches are contemplated. For example, while steering of the electron beam is provided by way of steering coils with the two pair of steering coils formed on the anode core 302, it will be appreciated that both the anode core 302 and the cathode core 304 might be constructed of a ferrite material, and the steering could be "split" between the cores, each having a pair of steering coils (e.g., the pairs are orthogonal) formed thereon to provide a perturbed quadrupole field effect in one direction for example. Other variations would also be contemplated. An operational protocol can be similar to the protocol of FIG. 10 described herein.

Accordingly, the offset can be applied to one coil or two opposing coils. In one example, AC offset is only applied to one coil to get steering in a diagonal direction. In another example, AC offset can be applied to both coils of an opposing coil pair. In one example, one coil of an opposing pair receives AC offset, and the other coil of the opposing pair can be set at zero AC offset. As such one coil can have AC offset in one coil set to zero and the other opposing coil of the pair has an AC offset that is not zero. In one embodiment, the coils of an opposing coil pair can have different offsets. In one embodiment, the AC offset in a pair of opposing coils can be created by having one coil with zero offset while the other has some offset. Application of AC offset to only one coil or having the coils of a coil pair with different AC offset can be applied to all embodiments.

Figure 16A:
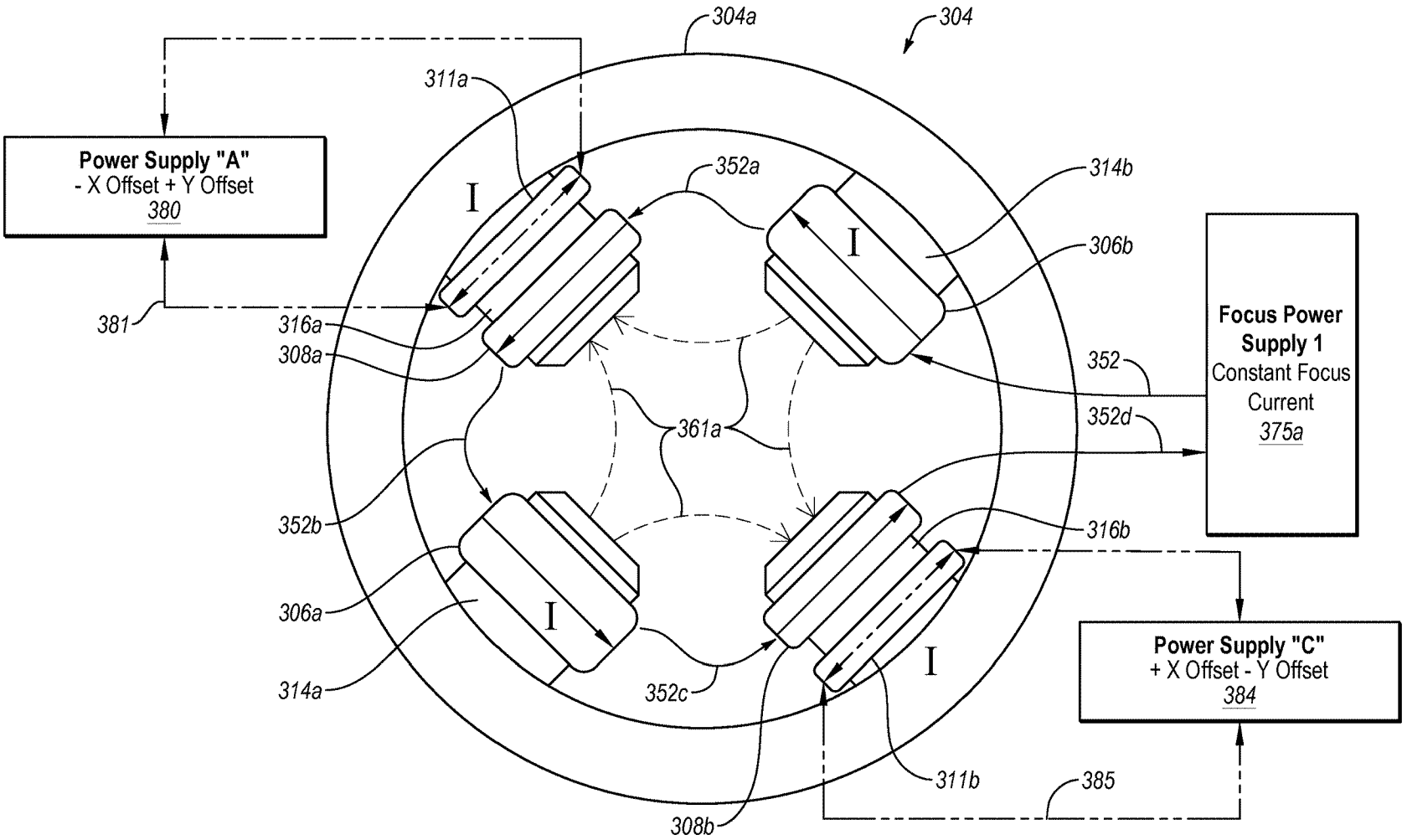
FIGS. 16A-16B are top views of components of one embodiment of a magnet system.
Figure 16B:
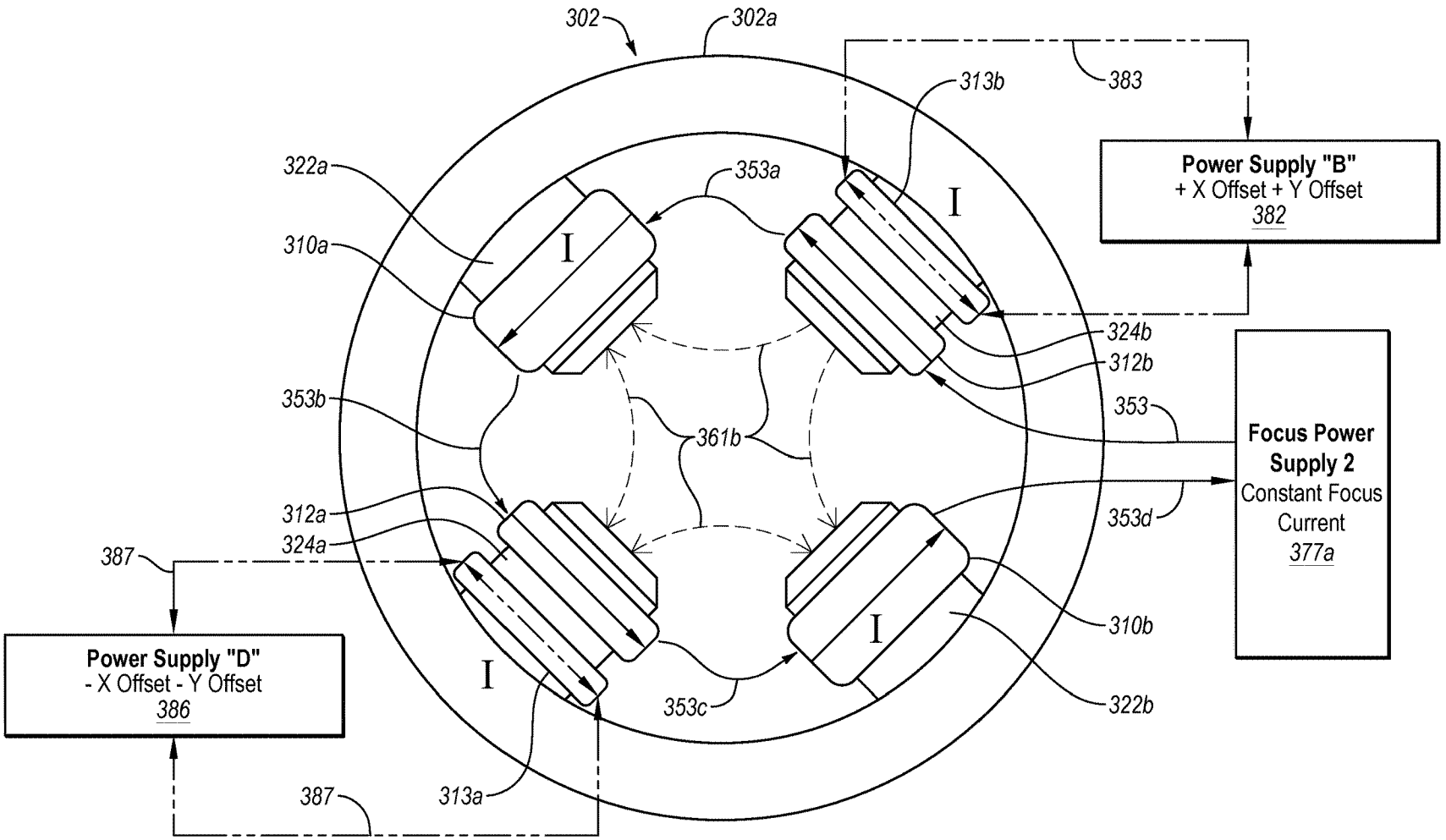

FIG. 16A shows an embodiment of a cathode core 304 having a cathode yoke 304*a* and is configured as a quadrupole (e.g., cathode-side magnetic quadrupole) with a pair of steering coils, and FIG. 16B illustrates an embodiment of an anode core 302 having an anode yoke 302*a*, also configured as a quadrupole (e.g., anode-side magnetic quadrupole) with a pair of steering coils. The subject matter of FIG. 16A can include aspects of FIG. 15A, and the subject matter of FIG. 16B can include aspects of FIG. 15B as described herein.

As is further shown in FIG. 16A, the illustrated example includes a Focus Power Supply 1 375*a* for providing a predetermined current to the quadrupole coils (e.g., 306*a*, 306*b*, 308*a*, 308*b*), which are connected in electrical series, as denoted schematically at 352, 352*a*, 352*b*, 352*c*, and 352*d*. The quadrupole coils are operated with constant focus current as described herein. In this embodiment, the current supplied is substantially constant, and results in a current flow within each quadrupole coil as denoted by the letter 'I' and corresponding arrow, in turn resulting in a magnetic field schematically denoted at 361*a*. The magnitude of the current is selected so as to provide a desired magnetic field that results in a desired focusing effect.

Also, the cathode core 304 is further configured to provide a steering effect. Accordingly, two of the pole projections (e.g., 316*a* and 316*b*) have steering coils 311*a* and 311*b* that each include a separate and independent power source for providing current to induce a magnetic field in a respective steering coil, each power supply being denoted at 380 (Power Supply A) and 384 (Power Supply C). To do so, the steering coils 311*a* and 311*b* are provided with an X-offset current and a Y-offset AC current. The duration of the offset AC currents are at a predetermined frequency and the respective offset current magnitudes are designed to achieve a desired perturbed quadrupole field and, in turn, a resultant shift in the electron beam (and focal spot). Thus, steering coils 311*a* and 311*b* are driven independently with perturbations that are created in the magnetic field at the desired focal spot steering frequency by application of desired X offset and Y offset currents as steering pairs of the cathode core 304. This effectively moves the center of the quadrupole magnetic field in the 'x' and/or 'y' direction, which in turn results in a shifting of the electron beam (and resultant position of the focal spot on the anode target) in a prescribed 'x' and/or 'y' direction.

As is further shown in FIG. 16B, the illustrated example includes a Focus Power Supply 377*a* for providing a predetermined current to the four quadrupole coils (e.g., 310*a*, 310*b*, 312*a*, 312*b*), which are connected in electrical series, as denoted schematically at 353, 353*a*, 353*b*, 353*c*, and 353*d*. The quadrupole coils are operated with constant focus current as described herein. In this embodiment, the current supplied is substantially constant, and results in a current flow within each quadrupole coil as denoted by the letter T and corresponding arrow, in turn resulting in a magnetic field schematically denoted at 361*b*. The magnitude of the current is selected so as to provide a desired magnetic field that results in a desired focusing effect. The focus current in the anode core 302 is opposite to the cathode core 304 focus current so as to provide for complimentary magnetic fields, and required focusing effect.

Also, the anode core 302 is further configured to provide a steering effect. Accordingly, two of the pole projections (e.g., 324*a* and 324*b*) have steering coils 313*a* and 313*b* that each include a separate and independent power source for providing current to induce a magnetic field in a respective steering coil, each power supply being denoted at 382 (Power Supply B) and 386 (Power Supply D). To do so, the steering coils 313*a* and 313*b* are provided with an X-offset current and a Y-offset AC current, where one steering coil can have zero AC offset. The duration of the offset currents are at a predetermined frequency and the respective offset current magnitudes are designed to achieve a desired dipole field and, in turn, a resultant shift in the electron beam (and focal spot). Thus, steering coils 313*a* and 313*b* are driven independently with steering perturbations that are created in the magnetic field at the desired focal spot steering frequency by application of desired X-offset and Y-offset currents as steering coil pairs of the anode core 302. This effectively moves the center of the magnetic field in the 'x' and/or 'y' direction, which in turn results in a shifting of the electron beam (and resultant position of the focal spot on the anode target) in a prescribed 'x' and/or 'y' direction. Thus, the combination of steering coil pairs 311*a,b* and steering coil pairs 313*a,b* provide steering in both the "x" and "y;" directions.

The cores 302, 304 of FIGS. 16A and 16B can be operated the same as described in connection with FIGS. 15A and 15B with FIG. 15C. However, with FIGS. 16A and 16B, the focus power supplies are Focus Power Supply 1 375*a* and Focus Power Supply 2 377*a*. Accordingly, having one pair of steering coils on the anode quadrupole core 302 and having one pair of steering coils on the cathode quadrupole core 304 can provide for both cores 302, 304 implementing focusing, and the cathode core 304 implementing steering in a first direction and the anode core 302 implementing steering in a second direction that is perpendicular with the first direction.

In one embodiment, the steering quadrupole core can be operated under high speed switching with the AC current. Such high speed switching can be at 6.5 to 7 kHz, and may include 20 microsecond transition times. Also, the focusing can have a magnetic flux that is about 400 gauss, whereas the steering can have a magnetic flux of 30-40. However, these values may vary, such as by 1, 2, 5, 10, or 20%.

In one embodiment, an X-ray tube can include: a cathode including an emitter, wherein the emitter has a substantially planar surface configured to emit electrons in an electron beam in a non-homogenous manner; an anode configured to receive the emitted electrons; a first magnetic quadrupole formed on a first yoke and having a magnetic quadrupole gradient for focusing the electron beam in a first direction and defocusing the electron beam in a second direction perpendicular to the first direction; a second magnetic quadrupole formed on a second yoke and having a magnetic quadrupole gradient for focusing the electron beam in the second direction and defocusing the electron beam in the first direction; wherein a combination of the first and second magnetic quadrupoles provides a net focusing effect in both first and second orthogonal directions of a focal spot of the electron beam; and at least one steering coil or a pair of steering coils configured to deflect the electron beam in order to shift the focal spot of the electron beam on a target, the one steering coil or pair of steering coils being on the first yoke or the second yoke, or one coil or a pair of steering coils on the first yoke and one coil or a pair of steering coils on the second yoke.

It will be appreciated that various implementations of the electron beam steering, as described herein, can be used advantageously in connection with the tunable emitter, and that features of each are complementary to one another. However, it will also be appreciated that various features—of either electron beam steering or of the planar emitter—do not need to be used together, and have applicability and functionality in separate implementations.

In one embodiment, an X-ray tube can include: a cathode including an electron emitter that emits an electron beam (e.g., substantially laminar beam); an anode configured to receive the electron beam; a first magnetic quadrupole between the cathode and the anode and having a first yoke with four evenly distributed first pole projections extending from the first yoke and oriented toward a central axis of the first yoke and each of the four first pole projections having a first quadrupole electromagnetic coil; a second magnetic quadrupole between the first magnetic quadrupole and the anode and having a second yoke with four evenly distributed second pole projections extending from the second yoke and oriented toward a central axis of the second yoke and each of the four second pole projections having a second quadrupole electromagnetic coil; and one steering coil on a pole projection or a pair of opposing steering coils on a pair of opposing pole projections of the first or second pole projections. In one aspect, the X-ray tube can include two pairs of steering coils formed from two pairs of opposing steering coils on the first and/or second pole projections. In one aspect, the two pair of steering coils are both in a plane formed by one of the first yoke or second yoke. In one aspect, a first pair of steering coils of the two pair of steering coils is in a first plane (e.g., cathode core) and a second pair of steering coils is in a different second plane (e.g., anode core). In one aspect, the first pole projections each have the steering coils so as to form the two pair of steering coils. In one aspect, the second pole projections each have the steering coils so as to form the two pair of steering coils. In one aspect, the two pair of steering coils are orthogonal. In one aspect, one coil of each coil pair can be omitted or have zero AC offset.

In one embodiment, the X-ray tube can include four power supplies, each being operably coupled with a steering coil. In one aspect, the X-ray tube can include a first focus power supply operably coupled with the first quadrupole electromagnetic coils; and/or a second focus power supply operably coupled with the second quadrupole electromagnetic coils.

In one embodiment, the X-ray tube can include: the first magnetic quadrupole being configured for providing a first magnetic quadrupole gradient for focusing the electron beam in a first direction and defocusing the electron beam in a second direction orthogonal to the first direction; the second magnetic quadrupole being configured for providing a second magnetic quadrupole gradient for focusing the electron beam in the second direction and defocusing the electron beam in the first direction; and wherein a combination of the first and second magnetic quadrupoles provides a net focusing effect in both first and second directions of a focal spot of the electron beam. In one aspect, the X-ray tube can include one steering coil, a pair of steering coils, three coils, or two pairs of steering coils being configured to deflect the electron beam in order to shift a focal spot of the electron beam on a target surface of the anode.

In one aspect, the four first pole projections can be at 45, 135, 225, and 315 degrees, and the four second pole projections can be at 45, 135, 225, and 315 degrees.

In one embodiment, the X-ray tube can include the electron emitter, such as any emitter that can emit a substantially laminar beam. For example, the emitter can have a substantially planar surface configured to emit electrons in an electron beam in a non-homogenous manner. In one aspect, the cathode can have a cathode head surface with one or more focusing elements located adjacent to the electron emitter. The emitter can be any electron emitter having a configuration to emit electrons in the electron beam to be substantially laminar. Any emitter that emits a substantially laminar beam (e.g., significantly laminar beam) can be used with the focusing and steering systems described herein.

In one embodiment, the X-ray tube can include the four second pole projections having the four second quadrupole electromagnetic coils adjacent to pole projection ends. Also, the X-ray tube can include the four second pole projections having four steering coils between the four second quadrupole electromagnetic coils and the second yoke.

In one embodiment, an X-ray tube can include: a cathode including an emitter; an anode configured to receive the emitted electrons; a first magnetic quadrupole formed on a first yoke and having a magnetic quadrupole gradient for focusing the electron beam in a first direction and defocusing the electron beam in a second direction perpendicular to the first direction; a second magnetic quadrupole formed on a second yoke and having a magnetic quadrupole gradient for focusing the electron beam in the second direction and defocusing the electron beam in the first direction; wherein a combination of the first and second magnetic quadrupoles provides a net focusing effect in both first and second directions of a focal spot of the electron beam; and at least one of the first yoke or second yoke has two opposing pole projections each with a steering coil that together perturb the quadrupole field so as to deflect the electron beam in order to shift the focal spot of the electron beam on a target of the anode.

In one embodiment, at least one of the first yoke or second yoke has two pairs of opposing pole projections, each pole projection with a steering coil. In one aspect, each pair of two opposing steering coils deflect the electron beam in order to shift the focal spot of the electron beam on a target of the anode. In one aspect, both pair of steering coils are configured on the first yoke or the second yoke, or one pair of steering coils one each of the first yoke and the second yoke.

In one embodiment, a method of focusing and steering an electron beam in an X-ray tube can include: providing an X-ray tube of one of the embodiments (e.g., having at least one pair of steering coils); operating the electron emitter so as to emit the electron beam from the cathode to the anode along an electron beam axis; operating the first magnetic quadrupole to focus the electron beam in a first direction; operating the second magnetic quadrupole to focus the electron beam in a second direction orthogonal with the first direction; and operating the pair of steering coils so as to steer the electron beam away from the electron beam axis. In one aspect, the method can include operating opposing steering coils of the pair to have different powers to form an asymmetric quadrupole field. In one aspect, the method can include forming a plurality of different focal spots at different locations on the anode for a given time interval, which time interval can be about 0.1, 0.2, 0.25, 0.3, 0.4, 0.5, 0.75, 1, 2, 3, 4, or 5 seconds, and generally less than 30 seconds. In one aspect, the method can include forming a plurality of different focal spots having different focal spot areas for a given time interval, which time interval can be the same or different from above.

In one embodiment, a method of focusing and steering an electron beam in an X-ray tube can include: providing the X-ray tube of one of the embodiments (e.g., having at least two pairs of steering coils); operating the electron emitter so as to emit the electron beam from the cathode to the anode along an electron beam axis; operating the first magnetic quadrupole to focus the electron beam in a first direction; operating the second magnetic quadrupole to focus the electron beam in a second direction orthogonal with the first direction; operating a first pair of steering coils to steer the electron beam away from the electron beam axis in a first direction; and operating a second pair of steering coils to steer the electron beam away from the electron beam axis in a second direction that is orthogonal to the first direction. In one aspect, the method can include operating opposing steering coils of the first pair of steering coils to have different powers to form a first asymmetric quadrupole field. In one aspect, the method can include operating opposing steering coils of the second pair of steering coils to have different powers to form a second asymmetric quadrupole field.

In one embodiment, one or both of the quadrupole cores can be devoid of electromagnetic coils wrapped around the core. The coils are on the pole projections, and the core is devoid of having coils wrapped around the core between the pole projections.

V. Example Embodiments of a Magnetic System Providing Electron Beam Focusing Via Two Quadrupole Cores and Two-Axis Beam Steering Via Two Dipoles on a Dipole Core As noted above, certain embodiments include an electron beam manipulation system that allows for steering and/or focusing of the electron beam so as to control the position and/or size and shape of the focal spot on the anode target.

In one embodiment, this manipulation is provided by way of a magnetic system implemented as two magnetic quadrupole cores and one magnetic dipole core disposed in the electron beam path. For example, in one embodiment, two quadrupole cores are used to provide focusing of the electron beam and the dipole core can also be used for steering. In this approach, focusing magnetic fields would be provided by both quadrupole cores (the anode side quadrupole core and the cathode side quadrupole core) and the electron beam steering magnetic fields would be provided by one of the quadrupole cores (e.g., the anode side quadrupole core) or only by the dipole core. Alternatively, magnetic fields for steering could be done for one direction with one quadrupole and for the other direction with the other quadrupole, or using the dipole for assistance in steering or for performing all steering. In this way, combined beam focusing can be provided using only quadrupoles. In another alternative, the dipole can be used only for steering. Here, the dipole core can be considered to be a steering core and the dipole coils can be steering coils that are operated the same or similarly as the steering coils described herein. Thus, reference of the dipole coils can be indications of steering coils.

Figure 17A:
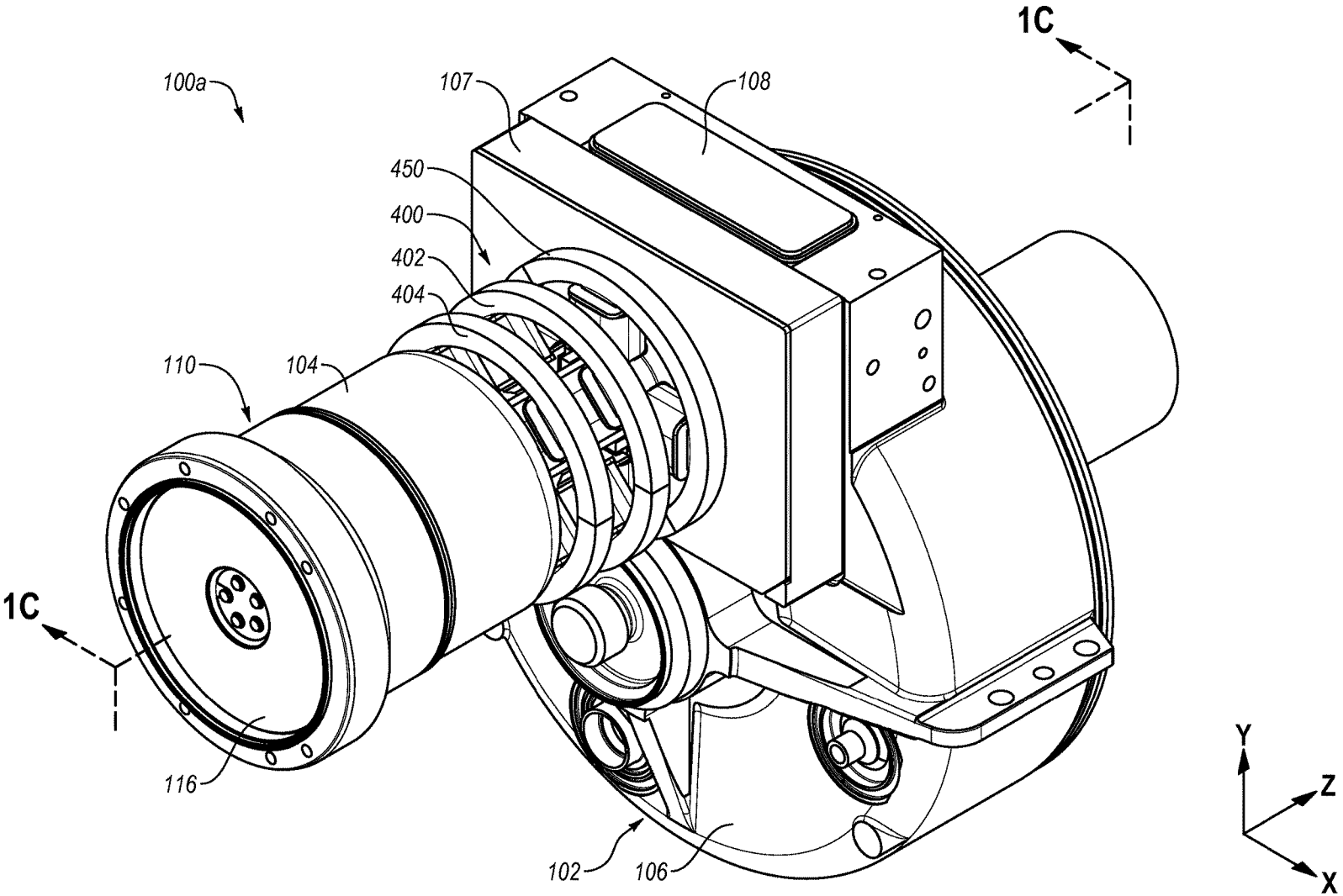
FIG. 17A is a perspective view of an example X-ray tube in which an embodiment of a three core magnetic system is implemented.
Figure 17B:
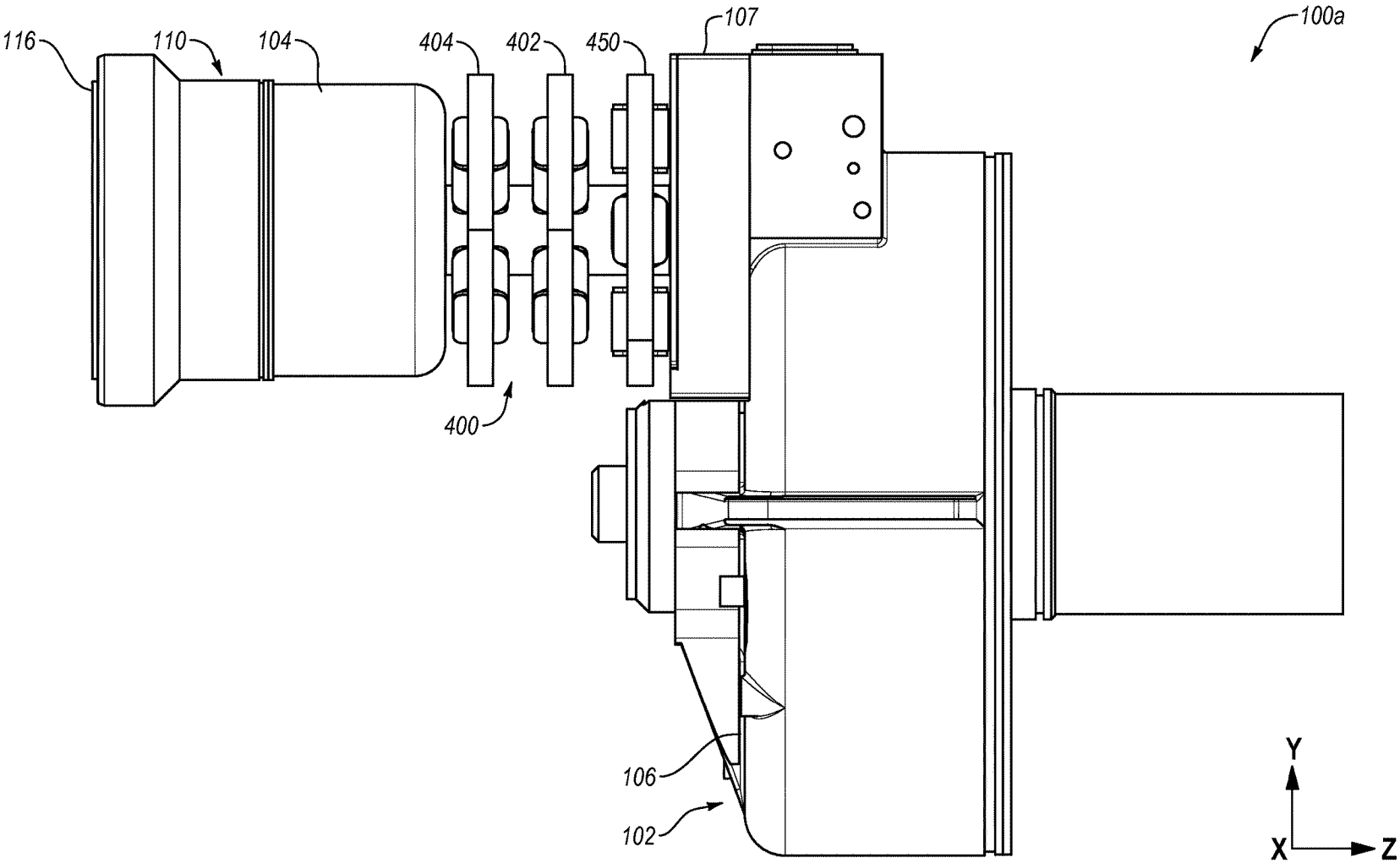
FIG. 17B is a side view of the X-ray tube of FIG. 17A.
Figure 17C:
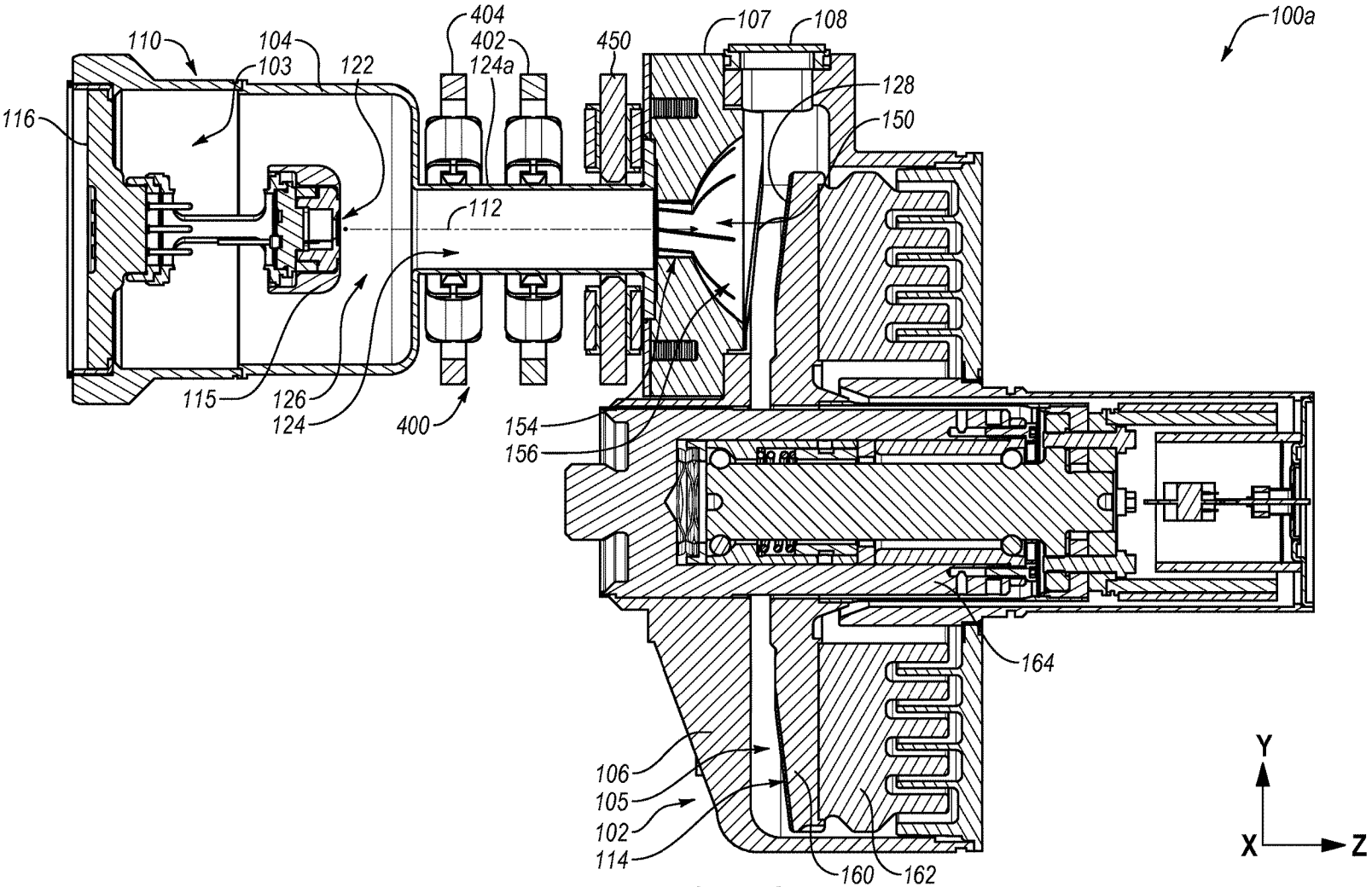
FIG. 17C is a cross-sectional view of the X-ray tube of FIG. 17A.

FIGS. 17A-17C are views of one example of an X-ray tube 100*a* in which one or more embodiments described herein may be implemented, and which include features of the X-ray tube 100, except for the magnetic system 180 of FIGS. 1A-1C is substituted with the magnetic system 400 of FIGS. 17A-17C. Specifically, FIG. 17A depicts a perspective view of the X-ray tube 100*a* and FIG. 17B depicts a side view of the X-ray tube 100*a*, while FIG. 17C depicts a cross-sectional view of the X-ray tube 100*a*. The X-ray tube 100*a* illustrated in FIGS. 17A-17C represents an example operating environment and is not meant to limit the embodiments described herein. As shown, the magnetic system 400 includes a cathode quadrupole core 404, an anode quadrupole core 402, and a dipole core 450.

Figure 17D:
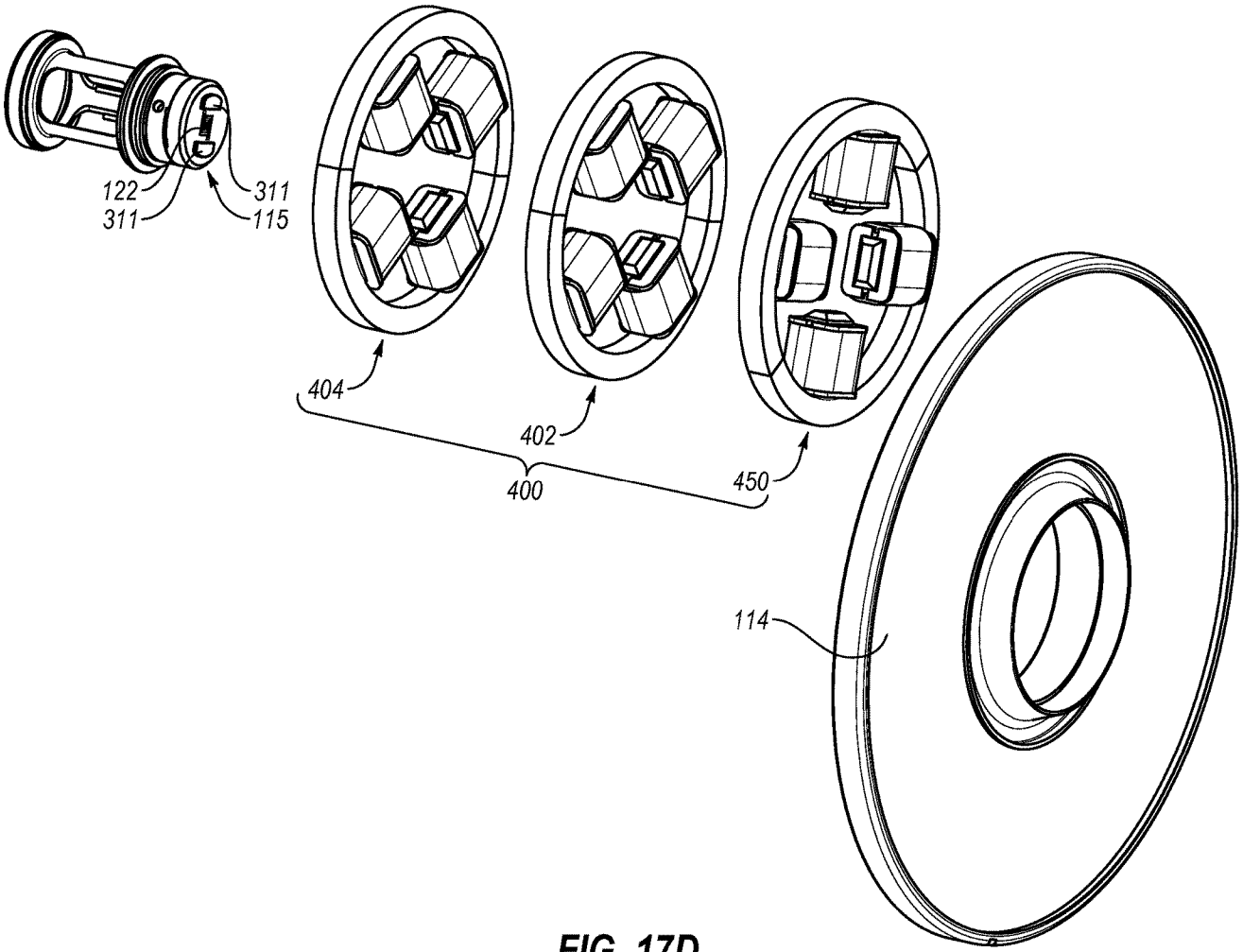
FIG. 17D is a perspective view of internal components of an embodiment of an example X-ray tube having a three core magnetic system.

FIG. 17D shows the components of the X-ray device that are arranged for electron emission, electron beam steering or focusing, and X-ray emission. The cathode head 115 is shown with the planar electron emitter 122 oriented so as to emit electrons in a beam 112 towards the anode 114. In FIG. 17D, disposed within the beam path is the magnetic system 400 configured to focus and steer the electron beam before reaching the anode 114, as noted above. The magnetic system 400 includes a cathode quadrupole core 404, an anode quadrupole core 402, and a dipole core 450. A portion of the cathode assembly 110 has the cathode head 115 with the electron emitter 122 on an end of the cathode head 115 so as to be oriented or pointed toward the anode 114 (see FIG. 17C for orientation. The cathode head 115 also includes electron beam focusing elements 311 located on opposite sides of the electron emitter 122.

Optionally, one or more electron beam manipulation components can be provided. Such devices can be implemented so as to "focus," "steer" and/or "deflect" the electron beam 112 as it traverses the drift region 124, thereby manipulating or "toggling" the position and/or dimension of the focal spot on the anode target surface 128. Additionally or alternatively, a manipulation component can be used to alter or "focus" the cross-sectional shape (e.g., length and width) of the electron beam and thereby change the shape and dimension of the focal spot on the anode target surface 128.

Figure 18A:
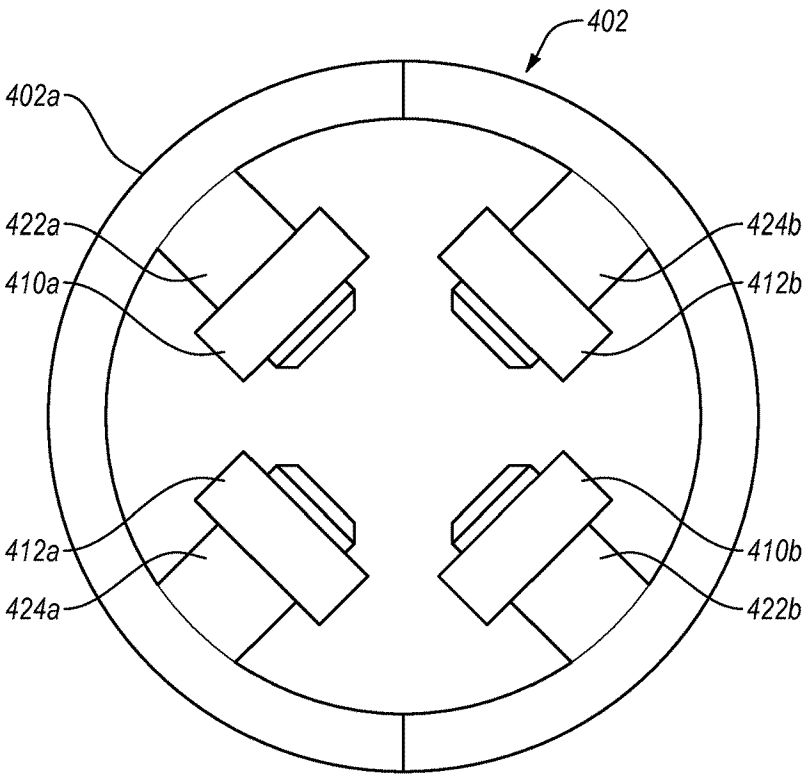
FIG. 18A is a top view of an embodiment of an anode quadrupole core.
Figure 18B:
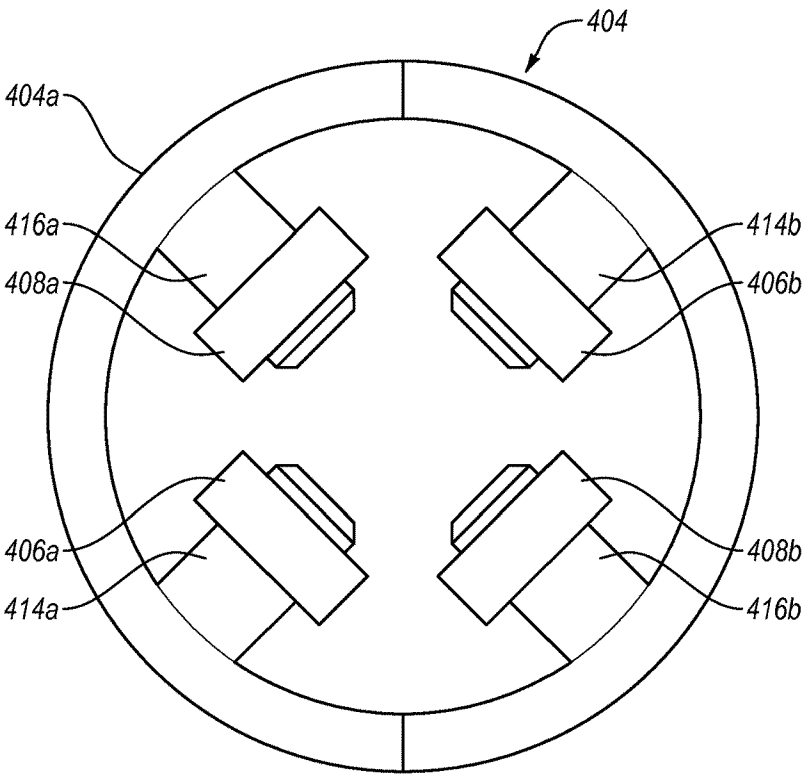
FIG. 18B is a top view of an embodiment of a cathode quadrupole core.
Figure 18C:
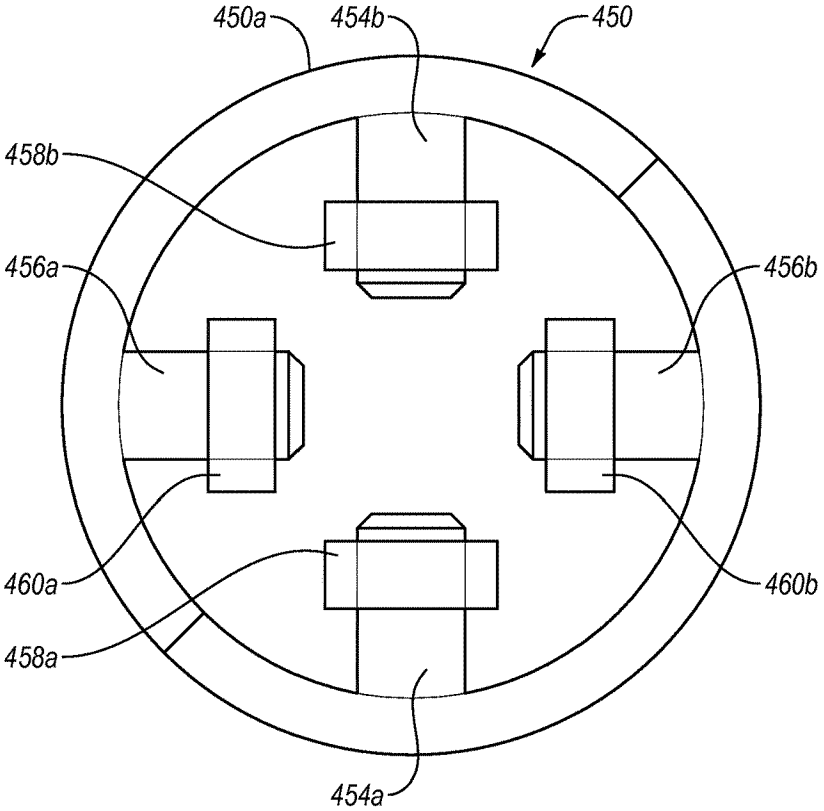
FIG. 18C is a top view of an embodiment of a dipole core.

One example of the magnetic system 400 and components thereof is shown in FIGS. 18A-18C. In this embodiment, the magnetic system 400 is implemented as two magnetic quadrupole cores 402, 404 and one magnetic dipole core 450 disposed in the electron beam path 112 of the X-ray tube 100*a*. The two quadrupole cores 402, 404 are configured to (a) focus in both directions perpendicular to the beam path, and optionally (b) to steer the beam in both directions perpendicular to the beam path. In this way, the two quadrupole cores 402, 404 act together to form a magnetic lens (sometimes referred to as a "doublet"), and the focusing is accomplished as the electron beam passes through the quadrupole "lens." The steering is accomplished by the dipole. The "focusing" provides a desired focal spot shape and size, and the "steering" effects the positioning of the focal spot on the anode target surface 128. Each quadrupole core 402, 404 is implemented with a core section, or a yoke, denoted as a cathode quadrupole yoke at 404*a*, and an anode quadrupole yoke at 402*a*. FIG. 18A shows an embodiment of an anode quadrupole core 402 having an anode quadrupole yoke 402*a*, and FIG. 18B shows an embodiment of a cathode quadrupole core 404 having a cathode quadrupole yoke 404*a*. Each quadrupole yoke 402*a*, 404*a* includes four pole projections arranged in an opposing relationship, cathode projections 414*a,b* (e.g., first cathode projections) and 416*a,b* (e.g., second cathode projections) on the cathode yoke 404*a*, and anode projections 422*a,b* (e.g., first anode projections) and 424*a,b* (e.g., second anode projections) on the anode yoke 402*a*. Each quadrupole pole projection includes corresponding coils, denoted at cathode coils 406*a,b* (e.g., first cathode coils) and 408*a,b* (e.g., second cathode coils) on the cathode yoke 404*a* and anode coils 410*a,b* (e.g., first anode coils) and 412*a,b* (e.g., second anode coils) on the anode yoke 402*a*. Current is supplied to the coils so as to provide the desired focusing and/or steering effect, as will be described in further detail below.

The dipole core 450 as shown in FIG. 18C is implemented with a core section or yoke, denoted at dipole yoke 450*a*. The dipole yoke 450*a* includes four pole projections arranged in opposing relationships, dipole projections 454*a,b* (e.g., first dipole projections) and 456*a,b* (e.g., second dipole projections). Each dipole projection includes corresponding coils, denoted at dipole coils 458*a,b* (e.g., first dipole coils) and 460*a,b* (e.g., second dipole coils). Current is supplied to the dipole coils so as to provide the desired steering effect, as will be described in further detail below.

Figure 18D:
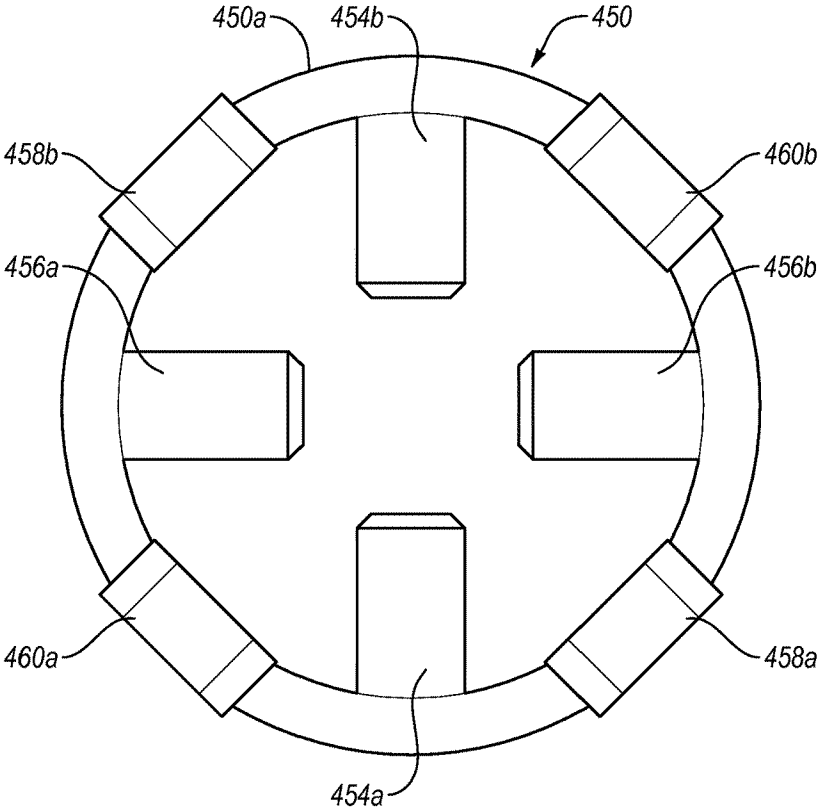
FIG. 18D is a top view of another embodiment of a dipole core.

The dipole core 450 as shown in FIG. 18D is implemented with a core section or yoke, denoted at dipole yoke 450*a*. The dipole yoke 450*a* includes four pole projections arranged in opposing relationships, pole projections 454*a,b* (e.g., first dipole projections) and 456*a, b* (e.g., second dipole projections). Between the dipole projections are corresponding dipole coils, denoted at dipole coils 458*a,b* (e.g., first dipole coils) and 460*a,b* (e.g., second dipole coils). Current is supplied to the coils so as to provide the desired steering effect, as will be described in further detail below. Here, the dipole coils are not on the protrusions, but between the protrusions. In the embodiments that utilize three cores, one being a dedicated dipole core, the embodiment of FIG. 18D can be utilized with the power and operability described herein, such as in connection to FIGS. 20A-20B and 21A-21B.

Figure 19A:
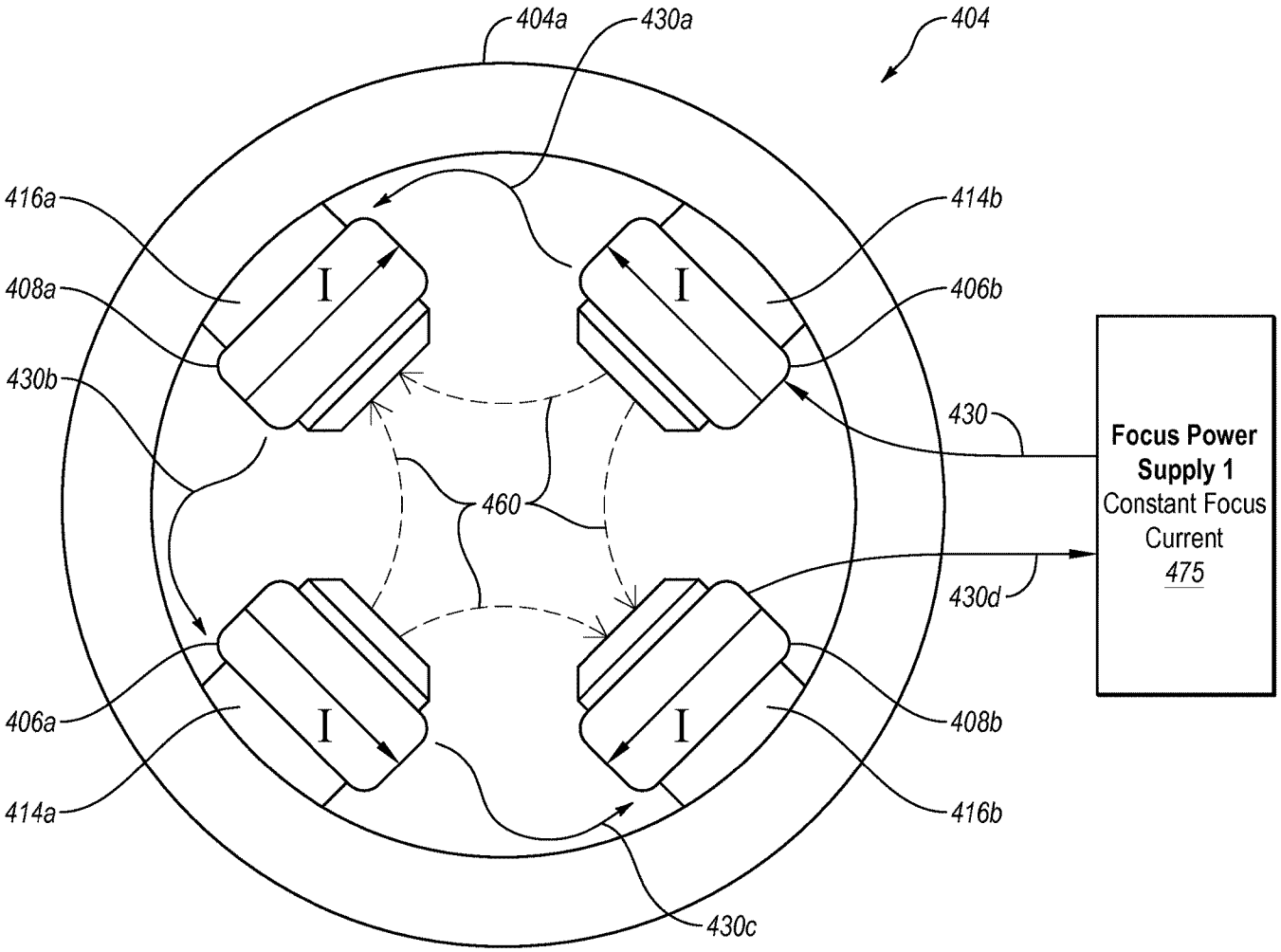
FIG. 19A is a top view of one embodiment of a cathode quadrupole magnet system.
Figure 19B:
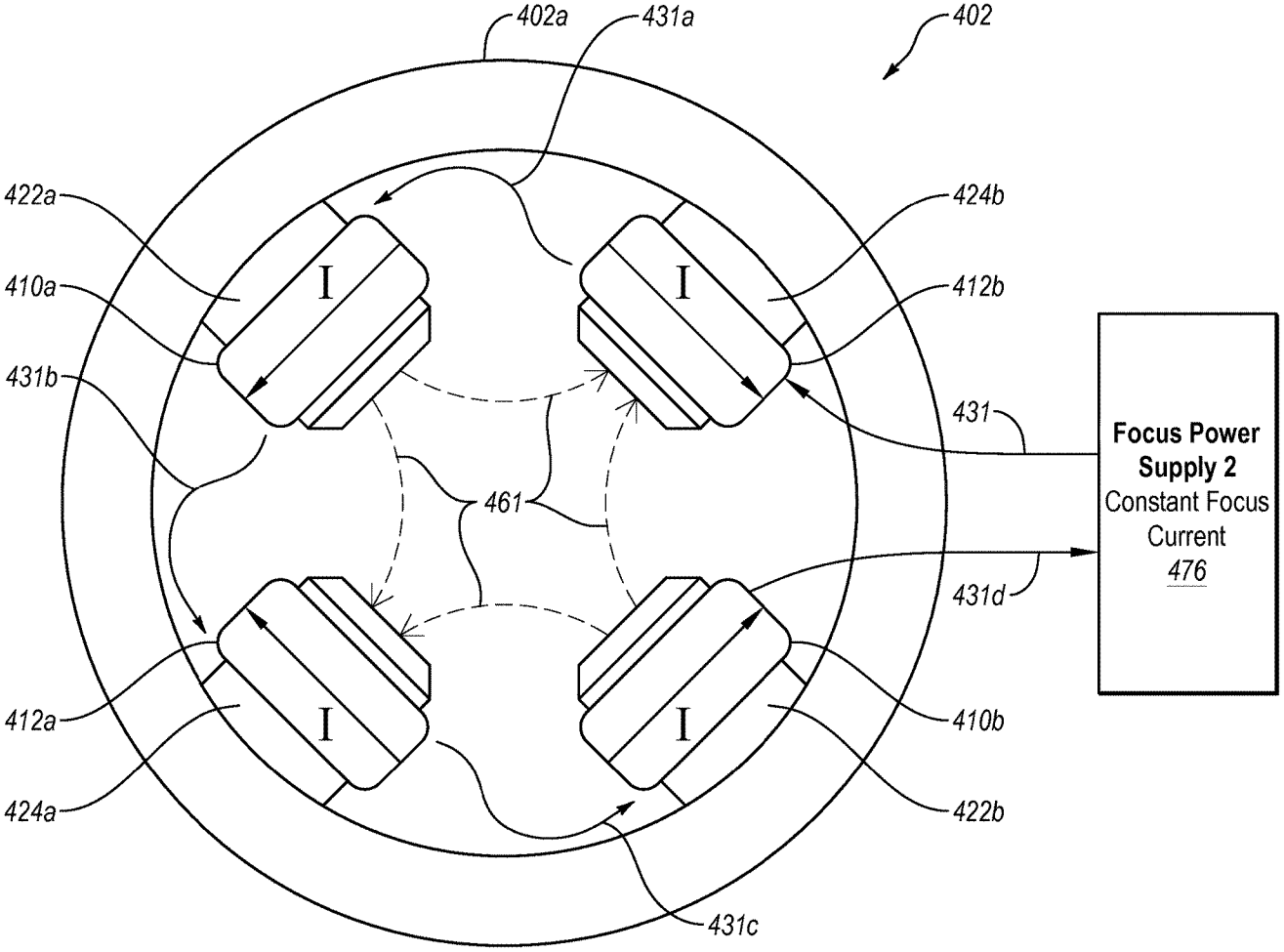
FIG. 19B is a top view of one embodiment of an anode quadrupole magnet system.

FIG. 19A shows an embodiment of a cathode core 404 having a cathode yoke 404*a* configured as a quadrupole (e.g., cathode-side magnetic quadrupole 404), and FIG. 19B illustrates an embodiment of an anode core 402 having an anode yoke 402*a*, also configured as a quadrupole (e.g., anode-side magnetic quadrupole 402). As previously described, in this example each core section includes a yoke having four pole projections arranged in an opposing relationship, 414*a,b* and 416*a,b* on the cathode yoke 404*a*, and 422*a,b* and 424*a,b* on the anode yoke 402*a*. Each pole projection includes corresponding coils, denoted at 406*a,b* and 408*a,b* on the cathode core 404 and 412*a,b* and 410*a,b* on the anode core 402. While illustrated as having a substantially circular shape, it will be appreciated that each of the core (or yoke) portions 402*a*, 404*a* can also be configured with different shapes, such as a square orientation, semi-circular, oval, or other.

The two magnetic quadrupole cores 402, 404 act as lenses, and may be arranged so that the corresponding electromagnets thereof are in parallel with respect to each other, and perpendicular to the optical axis defined by the electron beam 112. The quadrupole cores together deflect the accelerated electrons such that the electron beam 112 is focused in a manner that provides a focal spot with a desired shape and size. Each quadrupole lens creates a magnetic field having a gradient, where the magnetic field intensity differs within the magnetic field. The gradient is such that the magnetic quadrupole field focuses the electron beam in a first direction and defocuses in a second direction that is perpendicular to the first direction. The two quadrupoles can be arranged such that their respective magnetic field gradients are rotated about 90° with respect to each other. As the electron beam traverses the quadrupoles, it is focused to an elongated spot having a length to width ratio of a desired proportion. As such, the magnetic fields of the two quadrupole lenses can have a symmetry with respect to the optical axis or with respect to a plane through the optical axis.

With continued reference to the figures, the double magnetic quadrupole includes an anode-side magnetic quadrupole core, generally designated at 402 and a second cathode-side magnetic quadrupole core, generally designated at 404, that are together positioned approximately between the cathode and the target anode and disposed around the neck portion 124*a* as previously described. The anode side quadrupole core 402 in one option can be further configured to provide a dipole field effect that enables a shifting of the focal spot in a plane perpendicular to an optical axis correspondent to electron beam 112 of the X-ray tube 100. In an example embodiment, the cathode-side magnetic quadrupole core 404 focuses in a length direction, and defocuses in width direction of the focal spot. The electron beam is then focused in a width direction and defocused in length direction by the following anode-side magnetic quadrupole core 402. In combination the two sequentially arranged magnetic quadrupoles insure a net focusing effect in both directions of the focal spot.

With continued reference to FIG. 19A, a top view of a cathode-side magnetic quadrupole core 404 is shown. A circular core or yoke portion, denoted at 404*a* is provided, which includes four pole projections 414*a*, 414*b*, 416*a*, 416*b* that are directed toward the center of the circular yoke 404*a*. On each of the pole projections is provided a coil, as shown at 406*a*, 406*b*, 408*a* and 408*b*. In an example implementation, the yoke 404*a* and the pole projections 414*a*, 414*b*, 416*a*, 416*b* are constructed of core iron. Moreover each coil is comprised of 22 gauge magnet wire at 60 turns; obviously other configurations would be suitable depending on the needs of a particular application.

As is further shown in FIG. 19A, the illustrated example includes a Focus Power Supply 1 475 for providing a predetermined constant current to the four coils, which are connected in electrical series, as denoted schematically at 430, 430*a*, 430*b* 430*c*, and 430*d*. In this embodiment, the constant current supplied is substantially constant, and results in a current flow within each coil as denoted by the letter 'I' and corresponding arrow, in turn resulting in a magnetic field schematically denoted at 460. The magnitude of the current is selected so as to provide a desired magnetic field that results in a desired focusing effect.

Reference is next made to FIG. 19B, which illustrates an example of a top view of an anode-side magnetic quadrupole core 402. As with quadrupole core 404, a circular core or yoke portion, denoted at 402*a* is provided, which includes four pole projections 422*a*, 422*b*, 424*a*, 424*b* also directed toward the center of the circular yoke 402*a*. On each of the pole projections is provided a coil, as shown at 410*a*, 410*b*, 412*a* and 412*b*. In conjunction with quadrupole core 404, the yoke 402*a* and projections on quadrupole core 402 is comprised of the same material as for the cathode quadrupole core 404, which can be core iron. However, the anode quadrupole core 402 can be prepared from a low loss ferrite material so as to better respond to steering frequencies (described below). The coils can utilize similar gauge magnet wire and similar turn ratio, with variations depending on the needs of a given application.

As is further shown in FIG. 19B, the illustrated example includes a Focus Power Supply 2 476 for providing a predetermined constant current to the four coils, which are connected in electrical series, as denoted schematically at 431, 431*a*, 431*b*, 431*c*, and 431*d*. In this embodiment, the constant current supplied is substantially constant, and results in a constant current flow within each coil as denoted by the letter 'I' and corresponding arrow, in turn resulting in a magnetic field schematically denoted at 461. The magnitude of the current is selected so as to provide a desired magnetic field that results in a desired focusing effect.

FIG. 20A shows an embodiment of a dipole core 450 having a dipole yoke 450*a*. Dipole coils 458*a,b* (e.g., first dipole coils) and 460*a,b* (e.g., second dipole coils) are located on each of the pole projections 454*a,b* (e.g., first dipole projections) and 456*a,b* (e.g., second dipole projections). The first dipole coils 458*a,b* are shown to be energized with AC offset by a first dipole power supply (Steering Power Supply "A"), denoted at 575, and the second dipole coils 460*a,b* are shown to be energized with AC offset by the second dipole power supply (Steering Power Supply "B"), denoted at 585. The first dipole coils 458*a,b* cooperate to form the first dipole magnetic field 560, and the second dipole coils 460*a,b* cooperate to form the second dipole magnetic field 561. The dipole core coils can be controlled independently, thereby the dipole pole protrusions are offset or staggered compared to the quadrupole pole protrusions that are at 45, 135, 225 and 315 degrees, in one example, and thereby the dipole pole protrusions can be at 0, 90, 180, and 270 degrees. Accordingly, one coil of a coil pair can have zero AC offset.

Another example of the dipole core 450 is shown in FIG. 20B, where each of the dipole coils 458*a*, 458*b*, 460*a* and 460*b* is connected to a separate and independent power source for providing AC current to induce a magnetic field in the respective coil. The power supplies are denoted at 580 (Steering Power Supply A), 582 (Steering Power Supply B), 584 (Steering Power Supply C) and 586 (Steering Power Supply D) and are electrically connected as denoted by the schematic electrical circuit associated with each supply (e.g., 581, 583, 585, 587). The dipole core coils can be controlled independently, thereby the dipole pole protrusions are in line with the quadrupole pole protrusions at 45, 135, 225 and 315 degrees, in one example.

The configurations of FIGS. 20A and 20B provide for dipole steering. The dipole pairs (e.g., 458*a,b* are a first dipole pair and 460*a,b* are a second dipole pair) are configured to provide a dipole magnetic effect, and the requisite dipole effect is provided by supplying each of the dipole coils with an X-offset AC current and a Y-offset AC current. The duration of the offset AC currents are at a predetermined frequency and the respective offset current magnitudes are designed to achieve a desired dipole field and, in turn, a resultant shift in the electron beam (and focal spot). Thus, each coil is driven independently (FIG. 20B) or each dipole coil pair is driven independently (FIG. 20A) with an appropriate current at the desired focal spot steering frequency by application of desired X-offset and Y-offset AC currents in corresponding dipole coils. This effectively moves the center of the magnetic field in the 'x' and/or 'y' direction. The dipoles provide a lateral force on the electrons as they pass through the region between the pole faces. This force modulates the beam and during the drift time, the electrons travel their modulated path and end up at a desired focal spot. Due to the minimal mass of an electron, they follow the changes in this magnetic field practically instantaneously. Hence, operation of the X-ray tube can achieve fast switching as the magnetic field acts on successive electrons in the stream.

Figure 21A:
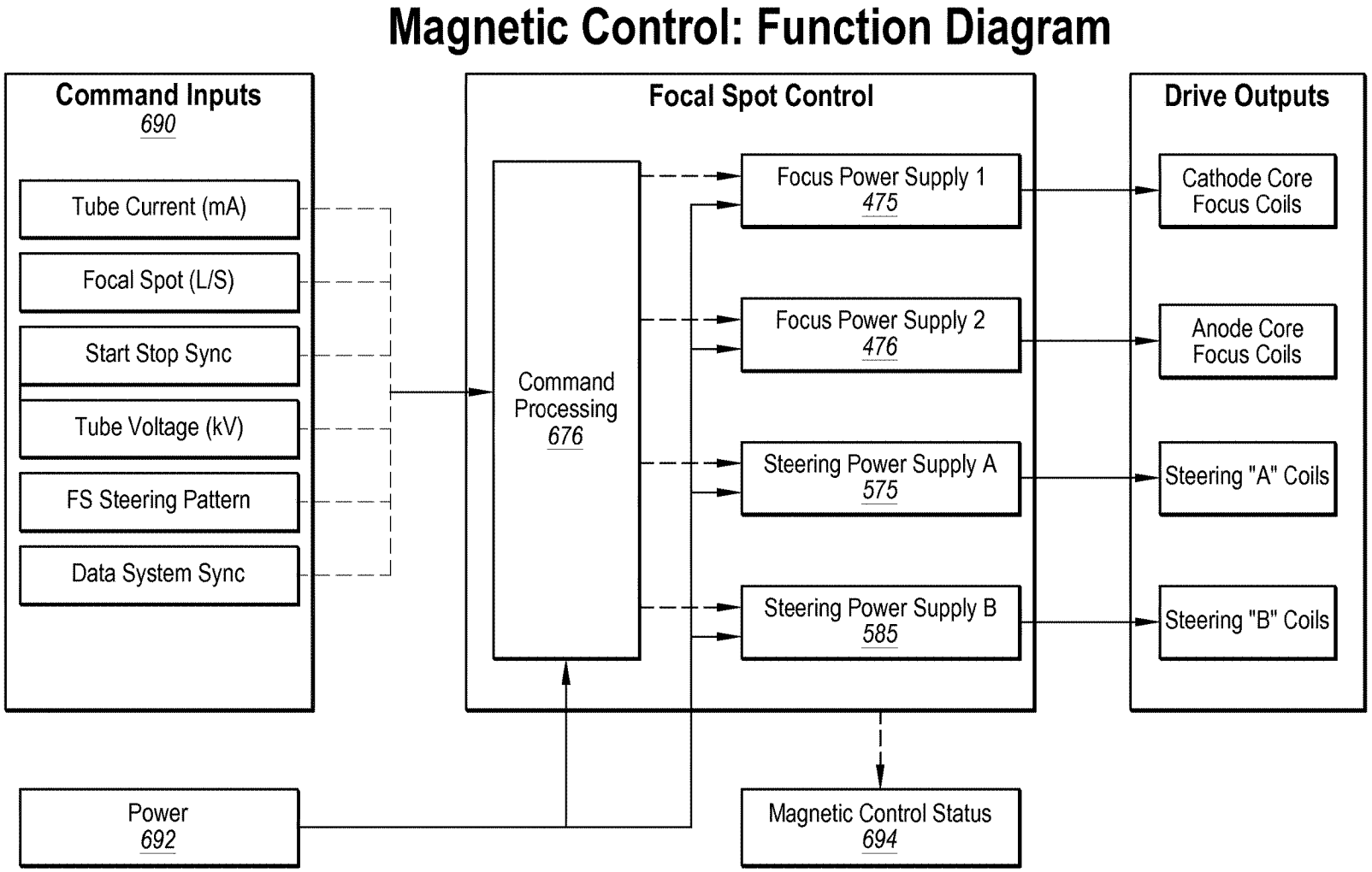
FIGS. 21A-21B are functional block diagrams, each showing one embodiment of a magnetic control.
Figure 21B:
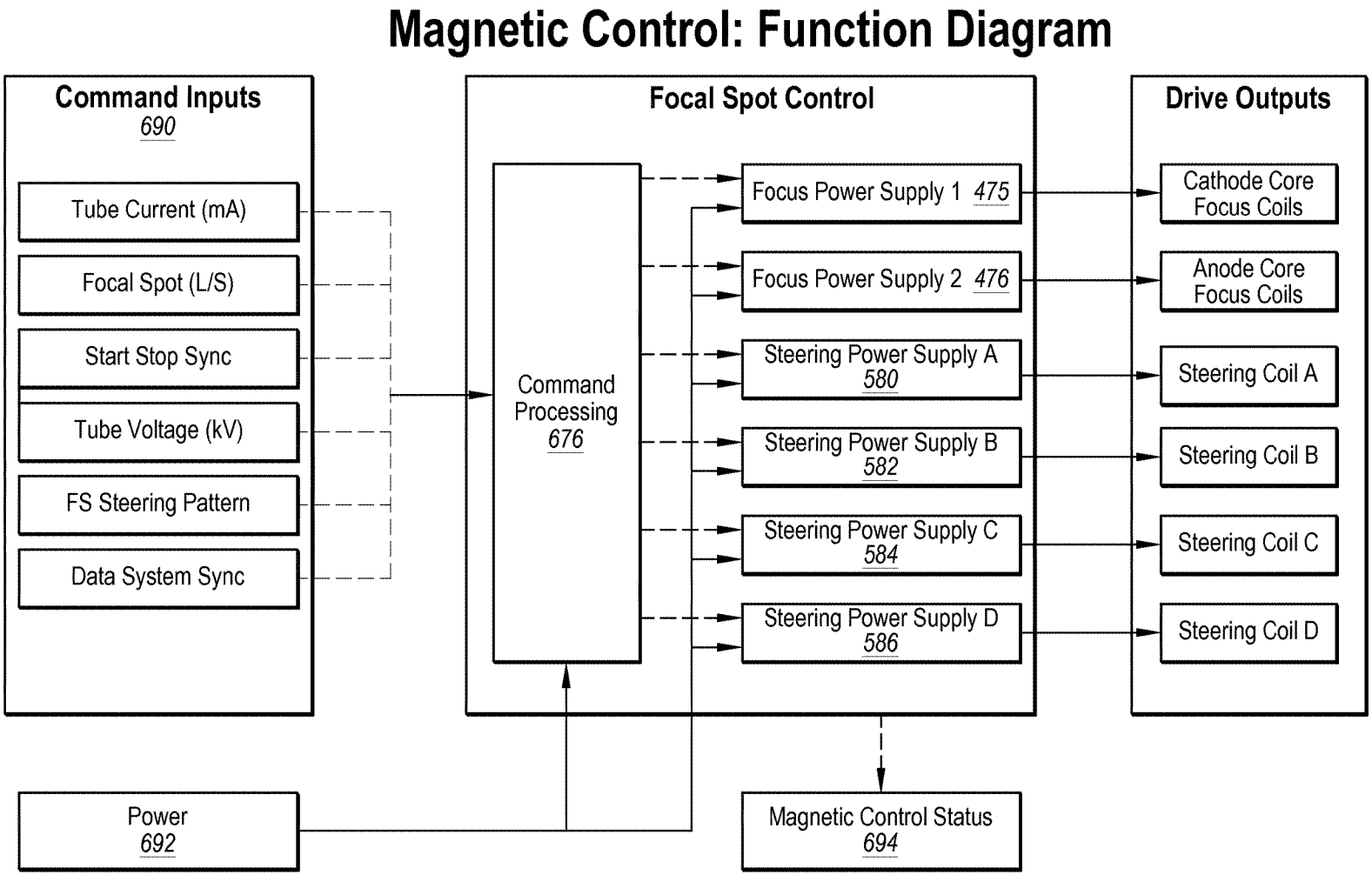

Reference is next made to FIGS. 21A-21B, which illustrate functional diagrams illustrating an embodiment of a magnetic control system for controlling the operation of the quadrupole systems of FIGS. 19A-19B and dipoles of FIGS. 20A-20B. At a high level, the magnetic control systems of FIGS. 21A-21B provide the requisite control of coil currents supplied to the quadrupole core pair 402 and 404 and/or dipole core 450 so as to (1) provide a requisite quadrupole field so as to achieve a desired focus of the focal spot; and (2) provide a requisite dipole field so as to achieve a desired position of the focal spot. As noted, control of the dipole coil AC currents is accomplished in a manner so as to achieve a desired steering frequency.

The embodiment of FIG. 21A includes a Command Processing device 676, which may be implemented with any appropriate programmable device, such as a microprocessor or microcontroller, or equivalent electronics. The Command Processing device 676 controls, for example, the operation of each of the independent power supplies of FIGS. 19A-19B and 20A (i.e., which provide corresponding coils operating current to create a magnetic field), preferably in accordance with parameters stored in non-volatile memory, such as that denoted at Command Inputs 690. For example, in an example operational scheme, parameters stored/defined in Command Inputs 690 might include one or more of the following parameters relevant to the focusing and/or steering of the focal spot: Tube Current (a numeric value identifying the operational magnitude of the tube current, in milliamps); Focal Spot L/S (such as 'large' or 'small' focal spot size); Start/Stop Sync (identifying when to power on and power off focusing); Tube Voltage (specifying tube operating voltage, in kilovolts); Focal Spot Steering Pattern (for example, a numeric value indicating a predefined steering pattern for the focal spot; and Data System Sync (to sync an X-ray beam pattern with a corresponding imaging system).

In an exemplary implementation for the quadrupoles of FIGS. 19A and 19B and dipole of FIG. 20A as shown in FIG. 21A, the Command Inputs 690 can be provided to Command Processing 676, which then communicates with the Focus Power Supply 1 (475) and Focus Power Supply 2 (476) for the quadrupoles and Steering Power Supply A 575 and Steering Power Supply B 585 for the dipoles, which then provide drive outputs for the cathode core focus coils and anode core focus coils as well as the dipole steering coils.

Thus, by way of one example, a Focal Spot size specified as 'small' would cause the Command Processing unit 676 to control the Focus Power Supply 1 475 to provide a constant focus current having the prescribed magnitude (corresponding to a 'small' focal spot) to each of the coils (406*b*, 408*a*, 406*a*, 408*b*) of the cathode-side magnetic quadrupole 404, as described above. Similarly, the Focus Power Supply 2 476 would also be controlled to provide a constant focus current, having the same magnitude as supplied by Focus Power Supply 1 475, to each of the coils of the anode-side magnetic quadrupole 402. Again, this would result in a quadrupole magnetic field that imposes focusing forces on the electron beam so as to result in a 'small' focal spot on the anode target.

Also, a FS Steering Pattern might prescribe a specific focal spot steering frequency and requisite displacement in an 'x' and/or 'y' direction. This would result in Command Processing unit 676 to control each of the Steering Power Supply A 575 and Steering Power Supply B 585 to supply a requisite X-offset and Y-offset AC current magnitudes to the corresponding coils of the dipole 450, thereby creating a desired dipole steering effect, in addition to the beam (focal spot) focus, as described above.

In an example embodiment, each of the Power Supplies 475, 476, 575, and 585 are high-speed switching supplies, and which receive electrical power from a main power supply denoted at 692. Magnetic Control Status 694 receives status information pertaining to the operation of the power supplies and the coils, and may be monitored by Command Processing unit 676 and/or an external monitor control apparatus (not shown).

In yet another example embodiment, a magnetic system implemented as two magnetic quadrupoles and a dipole can be disposed in the electron beam path of an X-ray tube is provided. Similar to the embodiment described above, the two magnetic quadrupoles are configured to focus the electron beam path in both directions perpendicular to the beam path. However, instead of implementing a dipole function via a quadrupole as described above, two dipoles are collocated on a dipole core to steer the beam in both directions ('x' and 'y') perpendicular to the beam path. The steering is accomplished by the two dipoles of the dipole core 450 which are created by dipole coils wound on one of the dipole core 450 pole projections 454*a,b* and 456*a,b*, while the quadrupole coils maintain the focusing coil current. Steering of the electron beam (and resulting shifting of the focal spot) occurs through appropriate dipole coil pair energizing and can be done in one axis or a combination of axes. In one embodiment, one quadrupole is used to focus in the first direction and the second quadrupole to focus in the second direction and the dipole core with two separate dipoles to steer in both directions.

Reference is next made to FIGS. 19A-19B and 20B, which together illustrate one example. Here, the dipole coils are configured to provide a dipole magnetic effect, and the requisite dipole effect is provided by supplying each of the dipole coils with an X-offset AC current and a Y-offset AC current, where one or more dipole coils can have zero AC offset. The duration of the offset AC currents are at a predetermined frequency and the respective offset current magnitudes are designed to achieve a desired dipole field and, in turn, a resultant shift in the electron beam (and focal spot). Thus, each coil is driven independently, the quadrupole coils with a constant focus current, and dipole coil pairs with an appropriate AC current at the desired focal spot steering frequency by application of desired X-offset and Y-offset currents in corresponding dipole coils. This effectively moves the center of the magnetic field in the 'x' and/or 'y' direction, which in turn results in a shifting of the electron beam (and resultant position of the focal spot on the anode target) in a prescribed 'x' and/or 'y' direction.

Reference is next made to FIG. 21B, which illustrates a functional diagram illustrating an embodiment of a magnetic control system for controlling the operation of the quadrupole and dipole systems of FIGS. 19A-19B and 20B. At a high level, the magnetic control system of FIG. 21B provides the requisite control of coil currents supplied to the quadrupole coils and the dipole coils so as to (1) provide a requisite quadrupole field so as to achieve a desired focus of the focal spot; and (2) provide a requisite dipole field so as to achieve a desired position of the focal spot. As noted, control of the individual coil currents is accomplished in a manner so as to achieve a desired steering frequency.

The functional processing associated with the magnetic control system of FIG. 21B is similar in most respects to that of FIG. 21A except that each of the Focus Power Supplies 1 (475) and 2 (476) provide a requisite focus DC current to the quadrupole coils, and the Steering Power Supplies A (580), B (582), C (584) and D (586) provide a requisite steering AC current and amplitude to the dipole coils to provide a desired dipole magnetic effect so as to achieve a required electron beam shift (focal spot movement).

Thus, in the embodiment of FIGS. 19A-19B, 20B, and 21B, a magnetic system providing electron beam focusing and two-axis beam steering via two quadrupoles and two dipoles (both on the same dipole core) is provided. While an example embodiment is shown, it will be appreciated that alternate approaches are contemplated. For example, while steering of the electron beam is provided by way of a dipole effect provided completely by the two dipoles, it will be appreciated that both the anode core 402 and the cathode core 404 can facilitate focusing. Other variations would also be contemplated.

In one aspect, the magnetic controller can be operated by command inputs. For example, the following inputs (e.g., input by user into controller) can be used to run the magnetic control system: Implemented for focusing: Tube Current (mA), Numeric Input: ex 450; Focal Spot (L/S), Large or Small Focal Spot; Start Stop Sync, to determine when to power on focus and power off; Implemented for focusing and steering: Tube Voltage (kV), Numeric Input: ex 120; Implemented for Steering: FS Steering Pattern, Pattern 1, 2, or 3, etc.; and Implemented for data collection: Data System Sync, to sync beam pattern with imaging system.

In one aspect, the magnetic controller can be operated with command inputs for focal spot control. For example, the following inputs (e.g., input by user into controller) can be used to control the focal spot. The user can implement command processing. This can include the use of command inputs and lookup/calibration table to determine: Focus Power Supply 1 current, which can be for cathode core focus coils; Focus Power Supply 2 current, which can be for anode core focus coils; Steering Power Supply A current and wave form, which can be for Y-direction beam movement; Steering Power Supply B current and wave form, which can be X-direction beam movement; and Magnetic Control Status. If sources do not energize then feedback can stop system from operating.

It will be appreciated that various implementations of the electron beam focusing and steering, as described herein, can be used advantageously in connection with the tunable emitter, and that features of each are complementary to one another. However, it will also be appreciated that various features—of either electron beam steering or of the planar emitter—do not need to be used together, and have applicability and functionality in separate implementations.

In one embodiment, an X-ray tube can include: a cathode including an electron emitter that emits an electron beam; an anode configured to receive the emitted electrons of the electron beam; a first magnetic quadrupole between the cathode and the anode and having a first quadrupole yoke with four first quadrupole pole projections extending from the first quadrupole yoke and oriented toward a central axis of the first quadrupole yoke and each of the four first quadrupole pole projections having a first quadrupole electromagnetic coil; a second magnetic quadrupole between the first magnetic quadruple and the anode and having a second quadrupole yoke with four second quadrupole pole projections extending from the second quadrupole yoke and oriented toward a central axis of the second quadrupole yoke and each of the four second quadrupole pole projections having a second quadrupole electromagnetic coil; and a magnetic dipole between the cathode and anode and having a dipole yoke with four dipole electromagnetic coils.

In one embodiment, an X-ray tube can include: the first magnetic quadrupole being configured for providing a first magnetic quadrupole gradient for focusing the electron beam in a first direction and defocusing the electron beam in a second direction orthogonal to the first direction; the second magnetic quadrupole being configured for providing a second magnetic quadrupole gradient for focusing the electron beam in the second direction and defocusing the electron beam in the first direction; and wherein a combination of the first and second magnetic quadrupoles provides a net focusing effect in both first and second directions of a focal spot of the electron beam. In one aspect, the magnetic dipole can be configured to deflect the electron beam in order to shift the focal spot of the electron beam on a target. In one aspect, the magnetic dipole has the dipole yoke with four dipole pole projections extending from the dipole yoke that are oriented toward a central axis of the dipole yoke and each of the four dipole pole projections have one of the dipole electromagnetic coils. In one aspect, the four dipole magnetic coils are wrapped around the dipole yoke in an even distribution. In one aspect, the magnetic dipole can have the dipole yoke with four dipole pole projections extending from the dipole yoke and oriented toward a central axis of the dipole yoke, and the dipole magnetic coils are between the dipole pole projections In one embodiment, the four first quadrupole pole projections having the first quadrupole electromagnetic coils are at 45, 135, 225, and 315 degrees; the four second quadrupole pole projections having the second quadrupole electromagnetic coils are at 45, 135, 225, and 315 degrees; and the four dipole electromagnetic coils are at 0, 90, 180, and 270 degrees.

In one embodiment, the four first quadrupole pole projections having the first quadrupole electromagnetic coils are at 45, 135, 225, and 315 degrees; the four second quadrupole pole projections having the second quadrupole electromagnetic coils are at 45, 135, 225, and 315 degrees; and the four dipole electromagnetic coils are at 45, 135, 225, and 315 degrees.

In one embodiment, the X-ray tube has the following order along the emitted electrons: cathode; first magnetic quadrupole (cathode quadrupole); second magnetic quadrupole (anode quadrupole); magnetic dipole; and anode.

In one embodiment, the electron emitter has a substantially planar surface configured to emit electrons in an electron beam in a non-homogenous manner.

In one embodiment, the first magnetic quadrupole can be operably coupled with a first focus power supply; the second magnetic quadruple can be operably coupled with a second focus power supply; a first dipole pair of the magnetic dipole can be operably coupled with a first steering power supply; and a second dipole pair of the magnetic dipole can be operably coupled with a second steering power supply.

In one embodiment, the first magnetic quadrupole can be operably coupled with a first focus power supply; the second magnetic quadruple can be operably coupled with a second focus power supply; and each electromagnet of the magnetic dipole can be operably coupled with a different steering power supply.

In one embodiment, an X-ray tube can include: a cathode including an emitter, wherein the emitter has a substantially planar surface configured to emit electrons in an electron beam in a non-homogenous manner; an anode configured to receive the emitted electrons; a first magnetic quadrupole formed on a first yoke and having a magnetic quadrupole gradient for focusing the electron beam in a first direction and defocusing the electron beam in a second direction perpendicular to the first direction; a second magnetic quadrupole formed on a second yoke and having a magnetic quadrupole gradient for focusing the electron beam in the second direction and defocusing the electron beam in the first direction; wherein a combination of the first and second magnetic quadrupoles provides a net focusing effect in both first and second directions of a focal spot of the electron beam; and a magnetic dipole configured to deflect the electron beam in order to shift the focal spot of the electron beam on a target, the magnetic dipole configured on a dipole yoke that is separate and different from the second yoke and/or the first and the second yoke.

In one embodiment, a method of focusing and steering an electron beam in an X-ray tube can include: providing the X-ray tube of one of the embodiments; operating the electron emitter so as to emit the electron beam from the cathode to the anode along an electron beam axis; operating the first magnetic quadrupole to focus the electron beam in a first direction; operating the second magnetic quadrupole to focus the electron beam in a second direction orthogonal with the first direction; and operating the magnetic dipole to steer the electron beam away from the electron beam axis.

In one embodiment, a method of focusing and steering an electron beam in an X-ray tube can include providing the X-ray tube of one of the embodiments, and operating the electron emitter so as to emit the electron beam from the cathode to the anode along an electron beam axis, implementing one or more of the following: operating the first magnetic quadrupole to focus the electron beam in a first direction; operating the second magnetic quadrupole to focus the electron beam in a second direction orthogonal with the first direction; or operating the magnetic dipole to steer the electron beam away from the electron beam axis.

The present disclosure is not to be limited in terms of the particular embodiments described in this application, which are intended as illustrations of various aspects. Many modifications and variations can be made without departing from its spirit and scope, as will be apparent to those skilled in the art. Functionally equivalent methods and apparatuses within the scope of the disclosure, in addition to those enumerated herein, will be apparent to those skilled in the art from the foregoing descriptions. Such modifications and variations are intended to fall within the scope of the appended claims. The present disclosure is to be limited only by the terms of the appended claims, along with the full scope of equivalents to which such claims are entitled. It is to be understood that this disclosure is not limited to particular methods, reagents, compounds, compositions or biological systems, which can, of course, vary. It is also to be understood that the terminology used herein is for the purpose of describing particular embodiments only, and is not intended to be limiting.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations. In addition, even if a specific number of an introduced claim recitation is explicitly recited, those skilled in the art will recognize that such recitation should be interpreted to mean at least the recited number (e.g., the bare recitation of "two recitations," without other modifiers, means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

As will be understood by one skilled in the art, for any and all purposes, such as in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. As will also be understood by one skilled in the art all language such as "up to," "at least," and the like include the number recited and refer to ranges which can be subsequently broken down into subranges as discussed above. Finally, as will be understood by one skilled in the art, a range includes each individual member. Thus, for example, a group having 1-3 cells refers to groups having 1, 2, or 3 cells. Similarly, a group having 1-5 cells refers to groups having 1, 2, 3, 4, or 5 cells, and so forth.

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the following claims.

The invention claimed is:

1. An X-ray tube comprising:

a cathode including an electron emitter that emits an electron beam;

an anode configured to receive the electron beam;

a first magnetic quadrupole between the cathode and the anode and having a first yoke with four evenly distributed first pole projections extending from the first yoke and oriented toward a central axis of the first yoke and each of the four first pole projections having a first quadrupole electromagnetic coil operably coupled to a power supply system that provides a constant current to each first quadrupole electromagnetic coil to produce a first focusing magnetic quadrupole field;

a second magnetic quadrupole between the first magnetic quadrupole and the anode and having a second yoke with four evenly distributed second pole projections extending from the second yoke and oriented toward a central axis of the second yoke and each of the four second pole projections having a second quadrupole electromagnetic coil operably coupled to the power supply system that provides a constant current to each second quadrupole electromagnetic coil to produce a second focusing quadrupole field;

at least two coils operably coupled to the power supply system that provides an alternating current offset separately to each of the two coils, wherein the power supply system comprises:

a first focusing power supply operably coupled with the four first quadrupole electromagnetic coils to produce the first focusing magnetic quadrupole field;

a second focusing power supply operably coupled with the four second quadrupole electromagnetic coils to produce the second focusing magnetic quadrupole field;

a first steering power supply operably coupled with at least one first steering coil and configured for steering the electron beam in a first direction, the at least one first steering coil being one of: at least one first quadrupole electromagnetic coil; at least one second quadrupole electromagnetic coil; or a dipole coil co-located on a pole projection to be radially adjacent with one first quadrupole electromagnetic coil or with one second quadrupole electromagnetic coil relative to the electron beam; and a second steering power supply operably coupled with at least one second steering coil and configured for steering the electron beam in a second direction, the at least one second steering coil being one of: at least one first quadrupole electromagnetic coil; at least one second quadrupole electromagnetic coil; or a dipole coil co-located on a pole projection to be radially adjacent with one first quadrupole electromagnetic coil or with one second quadrupole electromagnetic coil relative to the electron beam, wherein the at least one first steering coil is different from the at least one second steering coil, and the at least one first steering coil and the at least one second steering coil are the at least two coils, and the first direction is at an angle with the second direction.

2. The X-ray tube of claim 1, comprising two opposing steering coils coupled in series to the first steering power supply or second steering power supply of the power supply system that provides an alternating current offset to the two opposing steering coils.

3. The X-ray tube of claim 1, comprising two pairs of opposing steering coils coupled to the power supply system that provides an alternating current offset to the two pairs of opposing coils, a first pair of the two pairs of opposing steering coils being coupled with the first steering power supply and a second pair of the two pairs of opposing steering coils being coupled with the second steering power supply.

4. The X-ray tube of claim 3, wherein the first pair of the two pairs of opposing steering coils is in a first plane and the second pair of the two pairs of opposing coils is in a different second plane.

5. The X-ray tube of claim 3, wherein the first pair of the two pairs of opposing steering coils is in a first plane and the second pair of the two pairs of opposing coils is also in the first plane.

6. A method of focusing and steering an electron beam in an X-ray tube, the method comprising:

providing the X-ray tube of claim 3;

operating the electron emitter so as to emit the electron beam from the cathode to the anode along an electron beam axis;

operating the first magnetic quadrupole to focus the electron beam in a first axis;

operating the second magnetic quadrupole to focus the electron beam in a second axis orthogonal with the first axis;

operating at least one coil of a first pair of the opposing steering coils with alternating current offset to steer the electron beam away from the electron beam axis in a first direction; and operating at least one coil of a second pair of the opposing steering coils with alternating current offset to steer the electron beam away from the electron beam axis in a second direction.

7. The method of claim 6, further comprising inputting command inputs into a command input controller in order to control focusing in the first axis, focusing in the second axis, and/or steering away from the electron beam in a first direction and/or second direction, wherein a command processor is operably coupled with the command input controller to receive the command inputs therefrom, and operably coupled with the first focusing power supply, second focusing power supply, first steering power supply and second steering power supply to provide the inputs thereto in order to control focusing and steering of the electron beam.

8. The method of claim 7, comprising, in response to the command inputs, the command processor determining:

a first current for focusing in a first axis;

a second current for focusing in a second axis that is orthogonal with the first axis;

a first wave form and amplitude for steering in the first direction; and a second wave form and amplitude for steering in the second direction orthogonal with the first direction.

9. The X-ray tube of claim 1, comprising:

the first magnetic quadrupole being configured for providing a first magnetic quadrupole gradient for focusing the electron beam in a first direction and defocusing the electron beam in a second direction orthogonal to the first direction;

the second magnetic quadrupole being configured for providing a second magnetic quadrupole gradient for focusing the electron beam in the second direction and defocusing the electron beam in the first direction; and wherein a combination of the first and second magnetic quadrupoles provides a net focusing effect in both first and second directions of a focal spot of the electron beam.

10. The X-ray tube of claim 9, comprising two magnetic dipoles being configured to deflect the electron beam in order to shift a focal spot of the electron beam on a target surface of the anode.

11. The X-ray tube of claim 1, comprising:

the four first pole projections being at 45, 135, 225, and 315 degrees; and the four second pole projections being at 45, 135, 225, and 315 degrees.

12. The X-ray tube of claim 1, comprising the electron emitter having a surface configured to emit electrons in a substantially laminar electron beam.

13. The X-ray tube of claim 12, the cathode having a cathode head surface with one or more focusing elements located adjacent to the electron emitter.

14. A method of focusing and steering an electron beam in an X-ray tube, the method comprising:

providing the X-ray tube of claim 1;

operating the electron emitter so as to emit the electron beam from the cathode to the anode along an electron beam axis;

operating the first magnetic quadrupole to focus the electron beam in a first axis;

operating the second magnetic quadrupole to focus the electron beam in a second axis orthogonal with the first axis; and operating the at least two coils with alternating current offset to steer the electron beam away from the electron beam axis.

15. The method of claim 14, further comprising inputting command inputs into a command input controller in order to control focusing in the first axis, focusing in the second axis, and/or steering away from the electron beam in a first direction and/or second direction, wherein a command processor is operably coupled with the command input controller to receive the command inputs therefrom, and operably coupled with the first focusing power supply, second focusing power supply, first steering power supply and second steering power supply to provide the inputs thereto in order to control focusing and steering of the electron beam.

16. The method of claim 15, comprising, in response to the command inputs, the command processor determining:

a first current for focusing in a first axis;

a second current for focusing in a second axis that is orthogonal with the first axis;

a first wave form and amplitude for steering in a first direction; and a second wave form and amplitude for steering in a second direction orthogonal with the first direction.

17. The X-ray tube of claim 1, wherein the power supply system further comprises:

a command input controller; and a command processor operably coupled with the command input controller to receive command inputs therefrom, and operably coupled with the first focusing power supply, second focusing power supply, first steering power supply and second steering power supply to provide the inputs thereto in order to control focusing and steering of the electron beam.

18. The X-ray tube of claim 17, wherein the command input controller is configured for command inputs of: current; large focal spot; small focal spot; voltage; and steering toggle pattern.

19. The X-ray tube of claim 17, wherein the command processor is configured to determine:

a first current for focusing in a first axis;

a second current for focusing in a second axis that is orthogonal with the first axis;

a first wave form and amplitude for steering in a first direction; and a second wave form and amplitude for steering in a second direction orthogonal with the first direction.

20. The X-ray tube of claim 1, wherein:

the first focusing power supply is operably coupled with the four first quadrupole electromagnetic coils in series;

the second focusing power supply is operably coupled with the four second quadrupole electromagnetic coils in series;

the first steering power supply is operably coupled with two first steering coils in series; and the second steering power supply is operably coupled with two second steering coils in series.

* * * * *